US008814045B1

(12) United States Patent
Brockhouse et al.

(10) Patent No.: US 8,814,045 B1
(45) Date of Patent: Aug. 26, 2014

(54) VOTING STATION AND VOTING SYSTEM

(71) Applicant: Election Systems & Software, LLC, Omaha, NE (US)

(72) Inventors: Sean Brockhouse, Elkhorn, NE (US); Dean Baumert, Omaha, NE (US); James Schmidt, Omaha, NE (US); Kenneth Carbullido, Omaha, NE (US)

(73) Assignee: Election Systems & Software, LLC, Omaha, NE (US)

( * ) Notice: Subject to any disclaimer, the term of this patent is extended or adjusted under 35 U.S.C. 154(b) by 0 days.

(21) Appl. No.: 14/177,714

(22) Filed: Feb. 11, 2014

Related U.S. Application Data

(60) Provisional application No. 61/765,303, filed on Feb. 15, 2013.

(51) Int. Cl.
*G07C 13/00* (2006.01)
*G07C 13/02* (2006.01)

(52) U.S. Cl.
CPC ..... *G07C 13/02* (2013.01)
USPC ..... 235/386; 235/51

(58) Field of Classification Search
USPC ..... 235/386, 51; 705/12
See application file for complete search history.

(56) References Cited

U.S. PATENT DOCUMENTS

| | | | |
|---|---|---|---|
| 5,821,508 | A | 10/1998 | Willard |
| 6,824,053 | B2 | 11/2004 | Bluemer |
| 7,128,263 | B1 | 10/2006 | Nguyen et al. |
| 7,210,617 | B2 | 5/2007 | Chaum |
| 7,516,891 | B2 | 4/2009 | Chaum |
| 8,162,215 | B2 | 4/2012 | Chaum |
| 8,191,764 | B2 | 6/2012 | Bolton |
| 8,195,505 | B2 | 6/2012 | Poulos et al. |
| 2002/0106620 | A1 | 8/2002 | Barnum |
| 2002/0107724 | A1 | 8/2002 | Openshaw, II et al. |
| 2003/0121975 | A1 | 7/2003 | Bluemer |
| 2003/0158775 | A1 | 8/2003 | Chaum |
| 2005/0161507 | A1 | 7/2005 | Openshaw, II et al. |
| 2005/0247783 | A1 | 11/2005 | Poulos et al. |
| 2007/0095909 | A1 | 5/2007 | Chaum |

(Continued)

FOREIGN PATENT DOCUMENTS

| | | |
|---|---|---|
| WO | WO/03/071491 | 8/2003 |
| WO | WO/2008/113058 | 9/2008 |

OTHER PUBLICATIONS

Stanton, Michael, *The Importance of recounting votes*, originally published as "*A importancia da recontagem de votes*", on the website of the Agencia O Estado de Soa Paulo on Nov. 13, 2000.

(Continued)

*Primary Examiner* — Jamara Franklin
(74) *Attorney, Agent, or Firm* — Stinson Leonard Street LLP

(57) ABSTRACT

A voting system including a universal voting station and a tabulation device. The voting station is operable to receive an activation card on which it prints a voter's voting selection. The voter may choose to have the voting station transmit the voting selection to the tabulation device and deposit the activation card into a ballot box, or return the activation card to the voter. The tabulation device is operable to scan and tabulate the voting selections on both marked paper ballots and printed activation cards. The ballot box is preferably a common ballot box that is positioned to receive activation cards from the voting station and paper ballots and activation cards from the tabulation device.

22 Claims, 49 Drawing Sheets

(56) References Cited

U.S. PATENT DOCUMENTS

| | | | | |
|---|---|---|---|---|
| 2007/0267493 | A1 | 11/2007 | Coutts | |
| 2008/0272194 | A1 | 11/2008 | Chaum | |
| 2008/0308633 | A1 | 12/2008 | Bolton et al. | |
| 2008/0308634 | A1 | 12/2008 | Bolton et al. | |
| 2009/0173778 | A1* | 7/2009 | Cummings et al. | 235/51 |
| 2009/0256703 | A1 | 10/2009 | Bolton | |
| 2010/0145774 | A1 | 6/2010 | Veshnyakov et al. | |
| 2011/0114724 | A1* | 5/2011 | Lee | 235/386 |
| 2011/0145150 | A1 | 6/2011 | Onischuk | |
| 2012/0232963 | A1 | 9/2012 | Poulos et al. | |
| 2012/0259680 | A1 | 10/2012 | Poulos et al. | |
| 2012/0259681 | A1 | 10/2012 | Poulos et al. | |
| 2013/0248599 | A1 | 9/2013 | Bolton et al. | |
| 2013/0301873 | A1 | 11/2013 | Hoover et al. | |

OTHER PUBLICATIONS

*Voluntary Voting System Guidelines*, adopted by the Election Assistance Commission (EAC) on Dec. 13, 2005 (vols. I and II) (190 pgs).

Selker, Ted, *Fixing the Vote*, Scientific American, Oct. 2004, pp. 90-97.

*Alternative Ballot Techniques*, Hearing before the Subcommittee on Elections, Second Session, Washington DC, Sep. 22, 1994.

Election Systems and Software, *Voting Equipment Sustainability*, 37th Annual Legislation Conference, Scare (South Carolina Association of Registration & Election Officials Inc.), Mar. 7-10, 2012 (26 pgs).

Election Systems and Software, 38th Annual Legislation Conference, SCARE (South Carolina Association of Registration & Election Officials Inc.), Jan. 31, 2013 (25 pgs).

* cited by examiner

Clear and Initialize

Valid EQC Media was found

New Election Qualification Data

Election ID: MERCUNIV
Election Date: 03/30/2012

Current Election Qualification Data

Election ID: MERCUNIV
Election Date: 03/30/2012

Do you want to continue the Clear and Initialize process?

Continue

Cancel

*FIG. 13B*

Clear and Initialize

Cleared and initialized with new Election Qualification data.

The new Election Qualification data will remain in the unit until it is replaced by the next Clear and Initialize process.

Please remove the inserted media device.

*FIG. 13C*

Access Election Definition

Valid Election Media was found

Election Definition from Inserted media

Election ID: MERCUNIV
Election Date: 03/30/2012

Do you want to continue the Access Election process?

Continue

Cancel

*FIG. 13E*

Accessed Election Definition is now ready for use.

Keep the Election Definition Media Device Inserted in the ExpressVote unit to allow for voting while the unit remains powered–on.

Exit

*FIG. 13F*

VOTING STATION AND VOTING SYSTEM

CROSS-REFERENCE TO RELATED APPLICATIONS

This application is based on and claims priority to U.S. Provisional Application Ser. No. 61/765,303, filed on Feb. 15, 2013, which is incorporated herein by reference in its entirety.

STATEMENT REGARDING FEDERALLY SPONSORED RESEARCH OR DEVELOPMENT

Not applicable.

BACKGROUND OF THE INVENTION

1. Field of the Invention

The present invention relates generally to voting systems, and, more particularly, to a universal voting station and tabulation device.

2. Description of Related Art

A variety of different types of voting equipment are used in the United States and throughout the world. In many jurisdictions, a voter receives a paper ballot on which is printed the various races to be voted on. The voter votes by darkening or otherwise marking the appropriate mark spaces on the paper ballot. The voter-marked paper ballot may then be inserted into a vote tabulator that scans and tabulates the marked voting selections on the ballot. A variety of electronic voting terminals have also been developed to assist voters who have a physical impairment that would interfere with the manual marking of a ballot. For example, the AutoMARK® voting terminal sold by Election Systems and Software, LLC is designed to receive a blank paper ballot, i.e., the same paper ballot provided to voters who choose to hand-mark the ballot. The voting terminal presents the appropriate election contests to the voter either visually on a display or audibly through a pair of headphones, receives the voter's voting selections through an input device, and machine-marks the appropriate marks spaces on the paper ballot. The machine-marked paper ballot is then inserted into a vote tabulator that processes the ballot in the same manner as a voter-marked paper ballot.

BRIEF SUMMARY OF THE INVENTION

The present invention is directed to a voting system that includes a universal voting station optionally connected to a tabulation device. In one embodiment, the voting station is connected to the tabulation device, both of which are mounted above a common ballot box. The voting station receives an activation card, presents at least one election contest to a voter, receives at least one voting selection corresponding to the election contest from the voter, and prints the voting selection on the activation card. If the voter chooses to cast his/her vote via an electronic vote option, the voting station transmits the voting selection to the tabulation device and the printed activation card is deposited into the common ballot box. On the other hand, if the voter chooses a return activation card option, the voting station returns the printed activation card to the voter who may then insert the activation card into the tabulation device in order to cast his/her vote. The tabulation device is operable to receive either a conventional paper ballot on which a voter has marked his/her voting selections, or, a printed activation card that has been returned to a voter via the return activation card option of the voting station. In both cases, the tabulation device scans the paper ballot or printed activation card and decodes the voting selections for tabulation. The paper ballot or printed activation card is then deposited into the common ballot box. An advantage of this embodiment is that an election official only needs to transport and store a single, common ballot box that contains all of the paper ballots and printed activation cards that have been processed by the voting system in the precinct or polling place. The use of just one ballot box simplifies the logistics, security procedures, and warehousing/storage of the ballot box compared to that of two ballot boxes that may be different. In addition, one ballot box is less expensive than two ballot boxes for the jurisdiction.

Another embodiment of the present invention is directed to a universal voting station configured to operate in a tethered mode, in which it is connected to a tabulation device, or a standalone mode, in which it operates as a standalone unit. In both modes, the voting station receives an activation card, presents at least one election contest to a voter, receives at least one voting selection corresponding to the election contest from the voter, and prints the voting selection on the activation card. When the voting station operates in the standalone mode, the printed activation card is returned to the voter who may then deposit the activation card into a ballot box for later tabulation or insert the activation card into a tabulation device, or the activation card may be deposited into an attached ballot box. When the voting station operates in the tethered mode, the voter may select between an electronic vote option and a return activation card option as described above. Thus, an advantage of this embodiment is that the voting station may be used in the standalone mode or the tethered mode as desired for a particular deployment. Preferably, the voting station does not store votes, which allows it to be used as an early voting station (which typically ends before election day) and quickly redeployed to a polling place for use on election day. Thus, the voting station offers a double-use in the same election.

In another embodiment, the present invention is directed to a tabulation device configured to operate in a paper ballot tabulation mode and an activation card tabulation mode. When operating in the paper ballot tabulation mode, the tabulation device receives a conventional paper ballot on which a voter has marked his/her voting selections. The tabulation devices creates an image of the paper ballot, decodes the voting selections, and tabulates the decoded voting selections. When operating in the activation card tabulation mode, the tabulation device receives a printed activation card that has been returned to a voter via the return activation card option of the voting station. The tabulation device creates an image of the printed activation card, decodes the voting selections, and tabulates the decoded voting selections. Thus, an advantage of this embodiment is that the tabulation device may process and tabulate both conventional paper ballots marked by voters and printed activation cards generated by the voting station. Voters may feel more assured knowing that a single tabulation device processes their votes whether they mark their votes on a conventional paper ballot or use the voting station. Preferably, the tabulation device can switch between processing and tabulating conventional paper ballots and printed activation cards automatically without change to the software/firmware or hardware of the tabulation device. Another advantage of this embodiment is that the tabulation device provides a single point of vote data collection, such as a USB stick, that is convenient and secure. The tabulation device contains only one software/firmware program that needs to be maintained, which provides one process, machine, vote storage, opening procedure, closing procedure, tape, documentation, etc. instead of two of the same.

BRIEF DESCRIPTION OF THE DRAWINGS

FIGS. 13A-F are screen shots of the display of the voting station of FIG. 1 when opening a poll;

DETAILED DESCRIPTION OF EXEMPLARY EMBODIMENTS

The present invention is directed to a voting system and method for tabulating marked paper ballots and votes cast with a universal voting station. While the invention will be described in detail below with reference to various exemplary embodiments, it should be understood that the invention is not limited to the specific system configurations or methodologies of these embodiments. In addition, although the exemplary embodiments are described as embodying several different inventive features, one skilled in the art will appreciate that any one of these features could be implemented without the others in accordance with the invention.

Exemplary Configuration of Voting System

Figure 1:
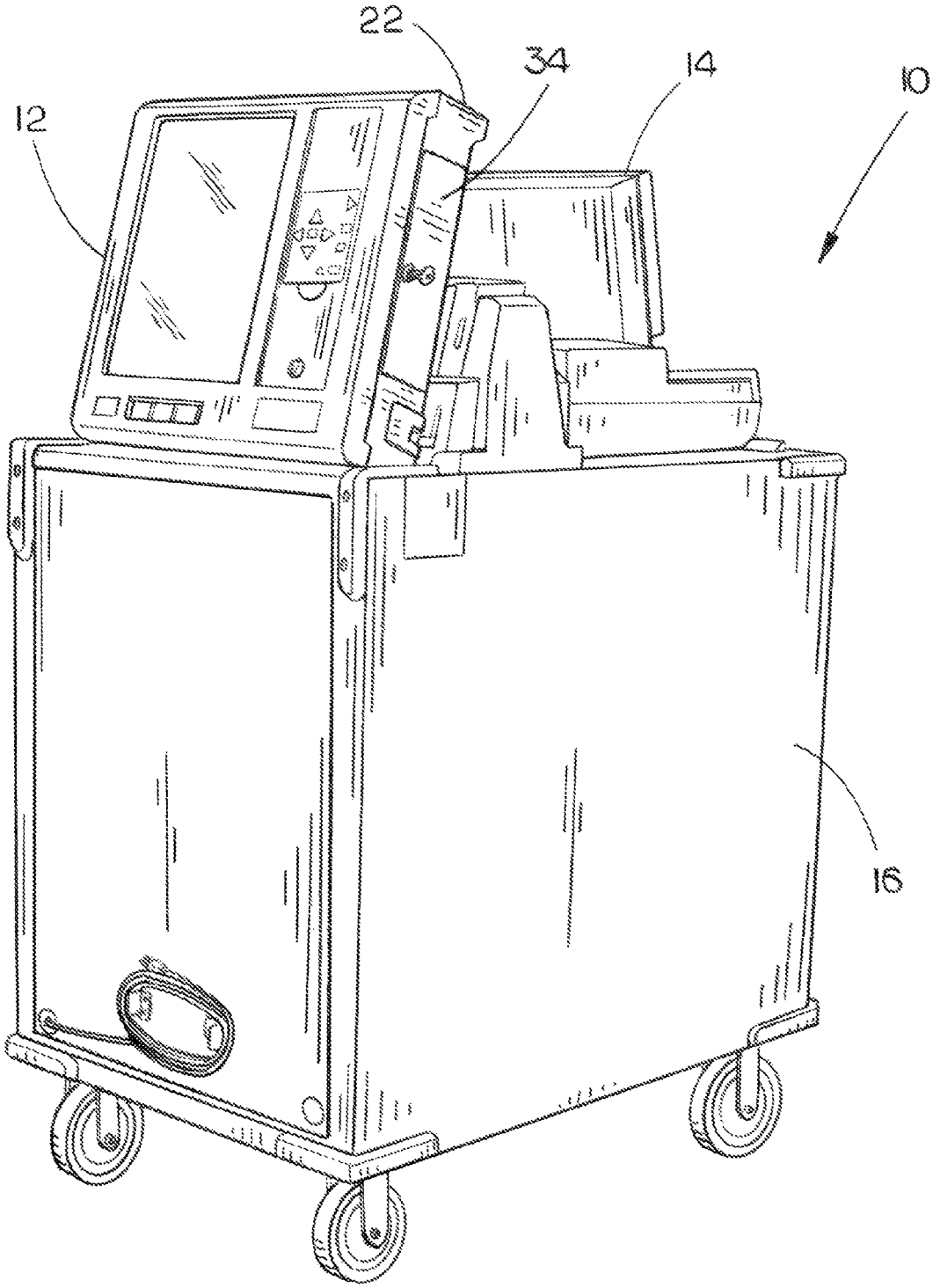
FIG. 1 is a front perspective view of an exemplary embodiment of a voting system in accordance with the present invention, which shows the universal voting station of the system.
Figure 2:
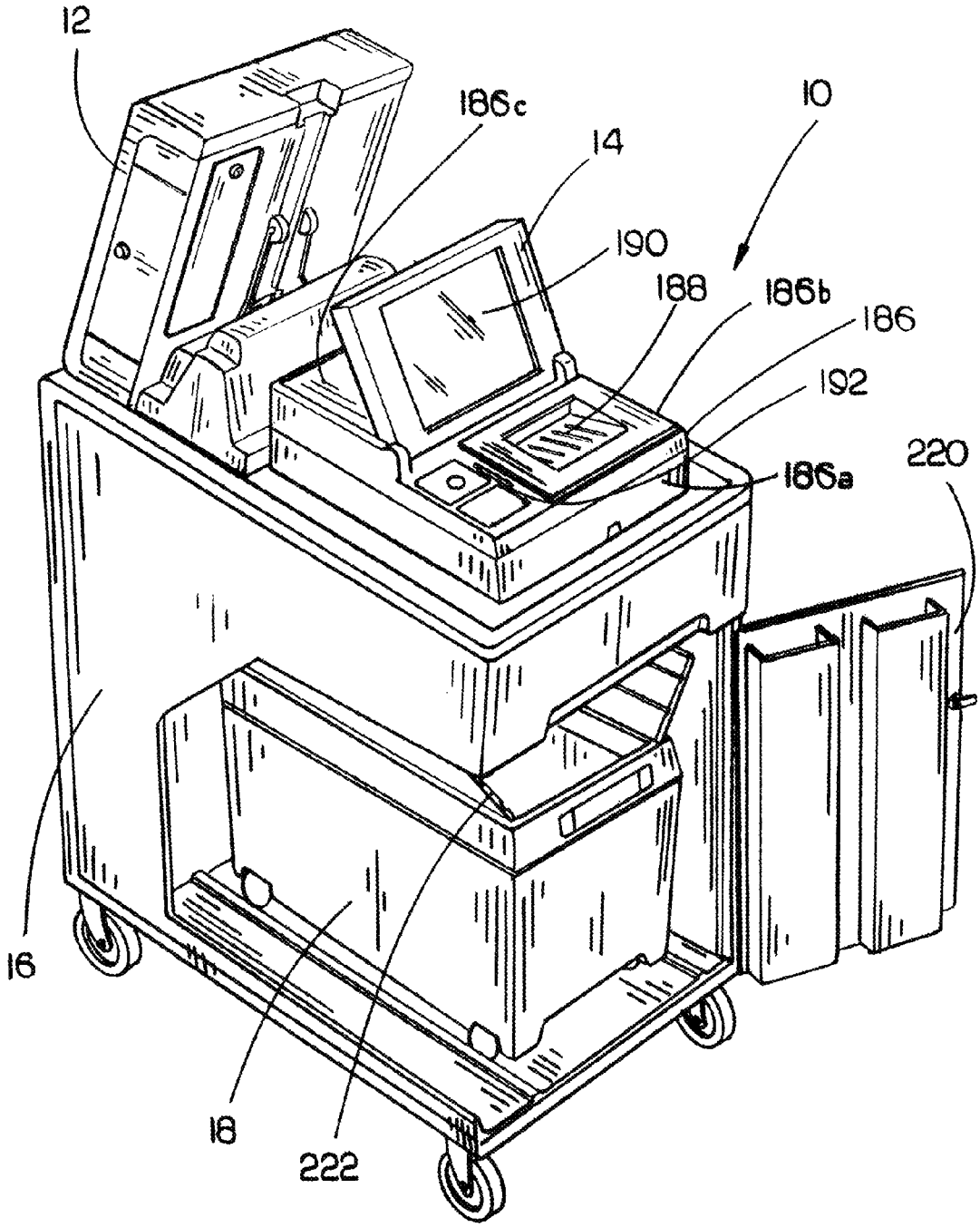
FIG. 2 is a rear perspective view of the voting system of FIG. 1, which shows the tabulation device of the system.

Referring to FIGS. 1 and 2, an exemplary embodiment of a voting system in accordance with the present invention is shown as reference numeral 10. Voting system 10 includes a universal voting station 12 and a tabulation device 14 each mounted on a cart 16 containing a common ballot box 18. As discussed below, universal voting station 12 is configured to allow voters with different physical disabilities and/or voters who speak different languages to cast votes, as well as non-disabled voters who choose to cast their votes using voting station 12. Tabulation device 14 is configured to scan and tabulate the voting selections from both conventional paper ballots marked with voting selections by a voter and activation cards with voting selections printed thereon by universal voting station 12. Tabulation device 14 also has the ability to electronically receive voting selections from the universal voting station 12 and tabulate those voting selections along with the voting selections scanned from the activation cards and paper ballots. The voting system 10 preserves a human readable, verifiable, auditable paper record for each vote cast by a voter. In an alternative embodiment of voting system 10, universal voting station 12 and tabulation device 14 may be part of an integral unit instead of two separate units that are mounted on cart 16 as shown in FIGS. 1 and 2.

Universal Voting Station

The universal voting station 12 may be used by voters who are blind, vision-impaired, speak a different language than the language of the preprinted paper ballots, or have a disability or condition that would make it difficult or impossible to hand-mark a standard full-page paper ballot in the usual way, e.g., by darkening marking spaces such as circles or ovals on the paper ballot for each of the contests in the election. Preferably, universal voting station 12 complies with the requirements of the Americans with Disabilities Act (ADA), the 2002 and 2005 voluntary voting system guidelines (VVSG), and the Help America Vote Act of 2002. In addition, non-disabled voters may choose to cast their votes using universal voting station 12. Thus, the voting station is "universal" in the sense that it may be used by all voters.

Figure 5:
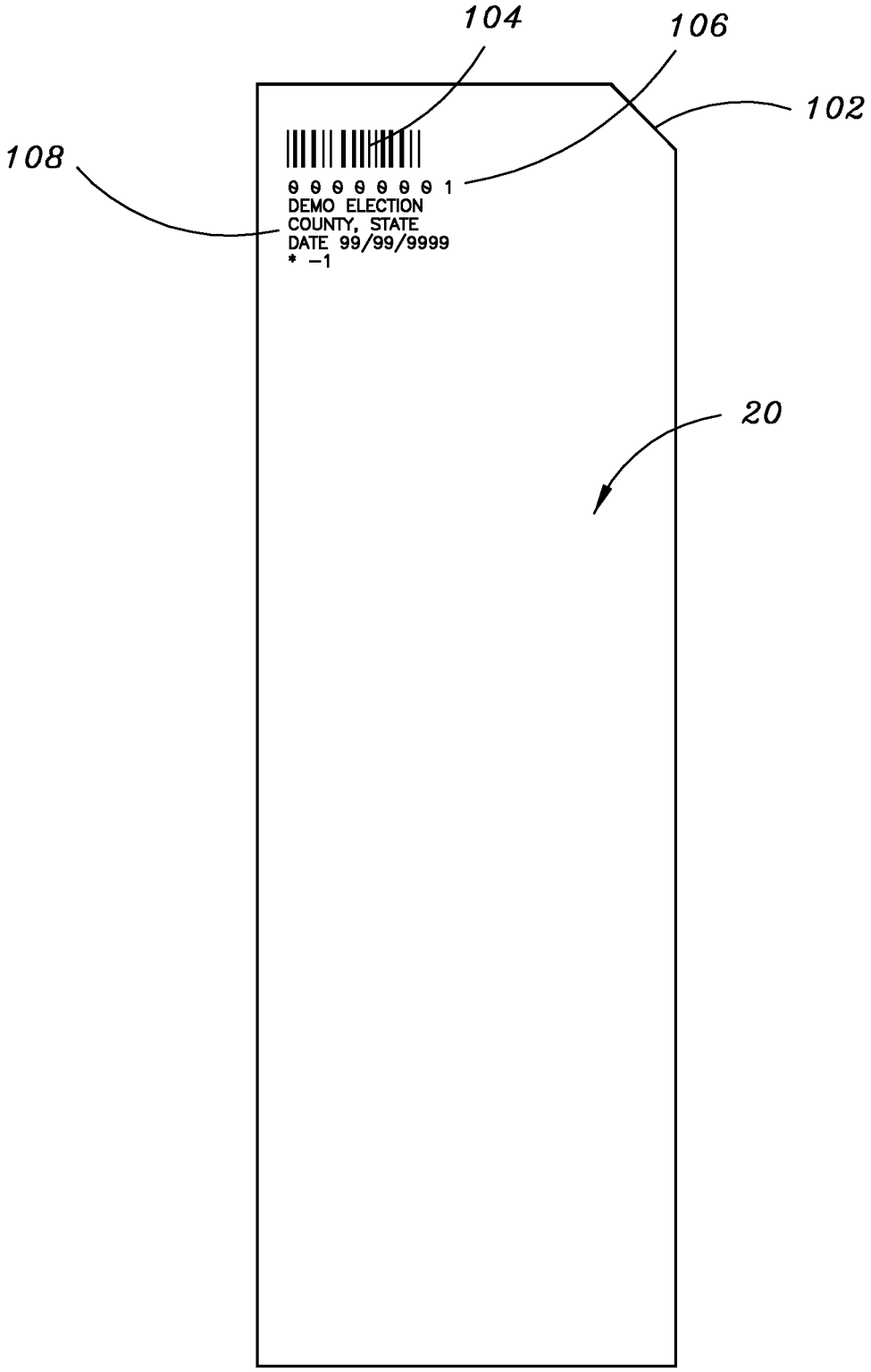
FIG. 5 is an activation card for use with the voting station of FIG. 1.
Figure 6:
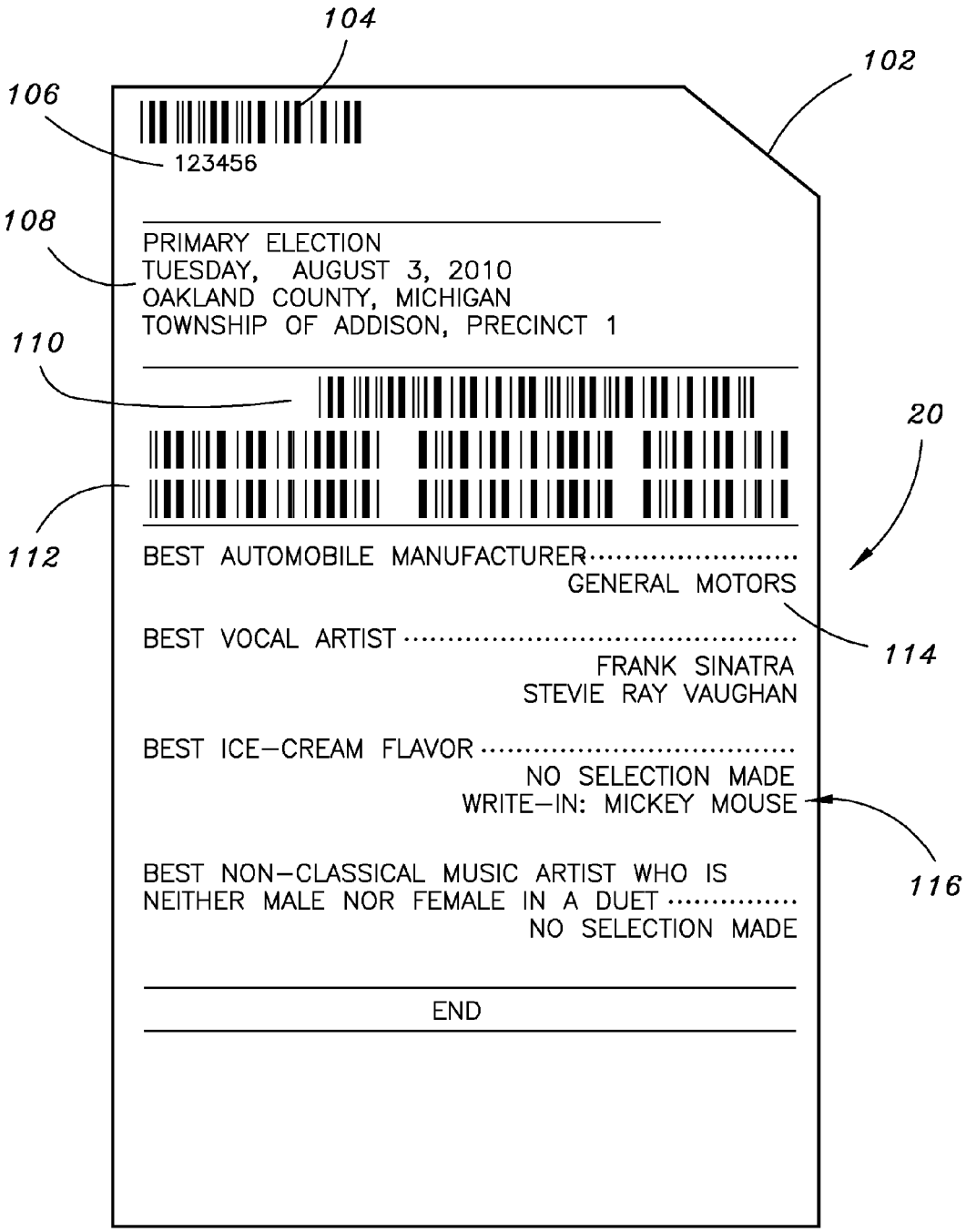
FIG. 6 is an activation card as shown in FIG. 5 with a voting record printed thereon.

In use, universal voting station 12 receives an activation card 20, shown in FIG. 5, from a voter that preferably includes a barcode which is read by universal voting station 12 and causes universal voting station 12 to display the appropriate electronic ballot for the voter. After the voter makes his/her voting selections, universal voting station 12 prints the voting selections on the activation card 20, such as shown in FIG. 6. When operating in a tethered mode (described in greater detail below), universal voting station 12 either returns the activation card 20 to the voter, in which case the voter may insert it in tabulation device 14 for tabulation, or deposits the activation card 20 in ballot box 18 and electronically transmits the voting selections to tabulation device 14 for tabulation. When operating in a standalone mode (described in greater detail below), universal voting station 12 is not connected to tabulation device 14 and may not be mounted on cart 16. In this configuration, after the voting selections are printed on the activation card 20, universal voting station 12 returns the activation card 20 to the voter, or, the activation card 20 may be deposited into an attached ballot box. Advantageously, universal voting station 12 eliminates the need for preprinted ballots. Preferably, universal voting station 12 does not function as a tabulation device, and does not retain vote data after a voting session is complete.

Figure 3:
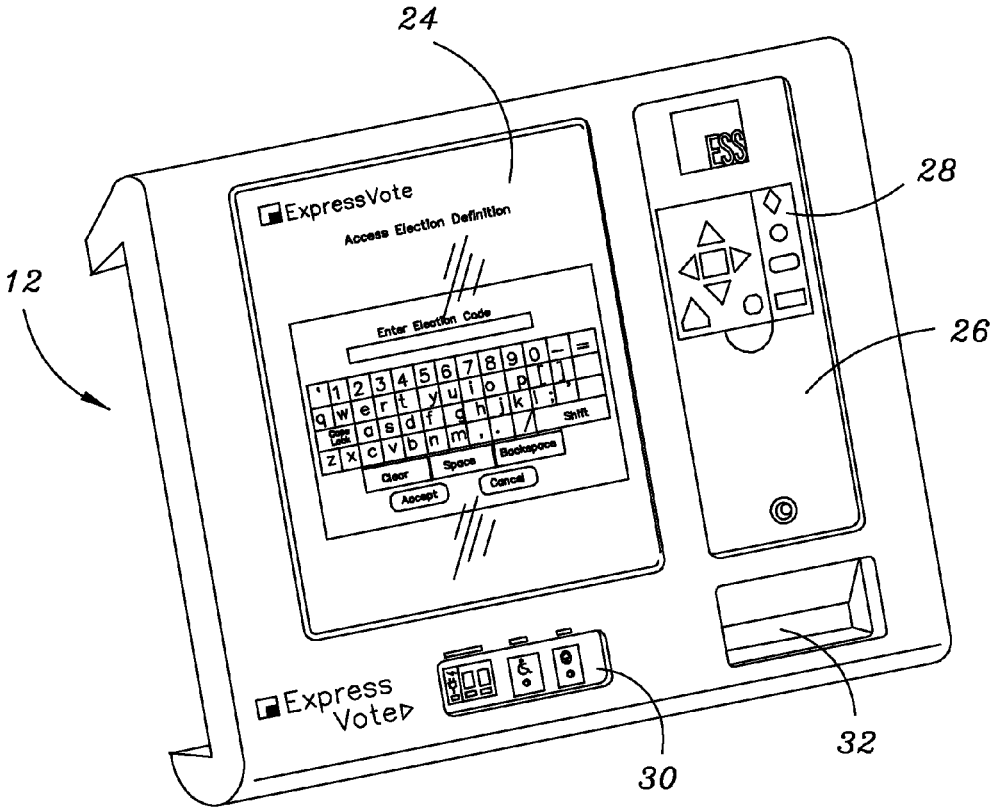
FIG. 3 is a perspective view of the voting station of FIG. 1.
Figure 7A:
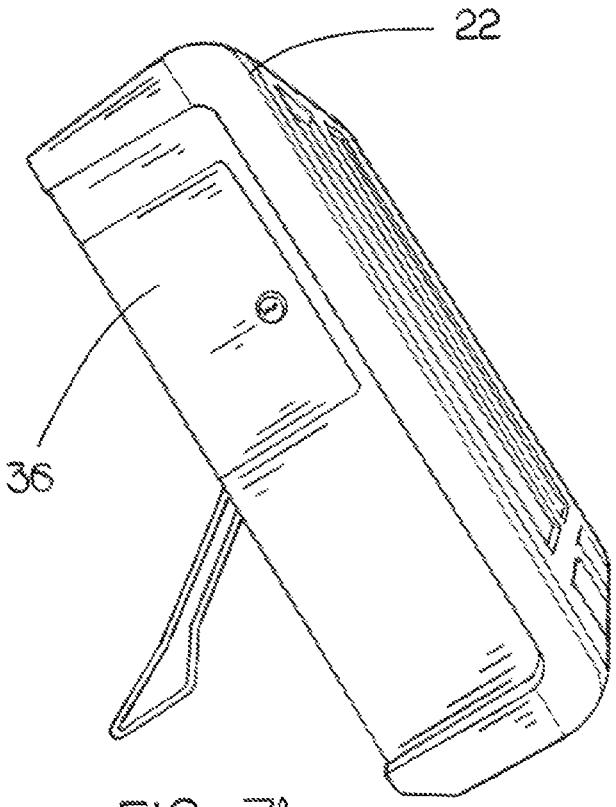
FIGS. 7A-7B show doors of the voting station of FIG. 1.
Figure 7B:
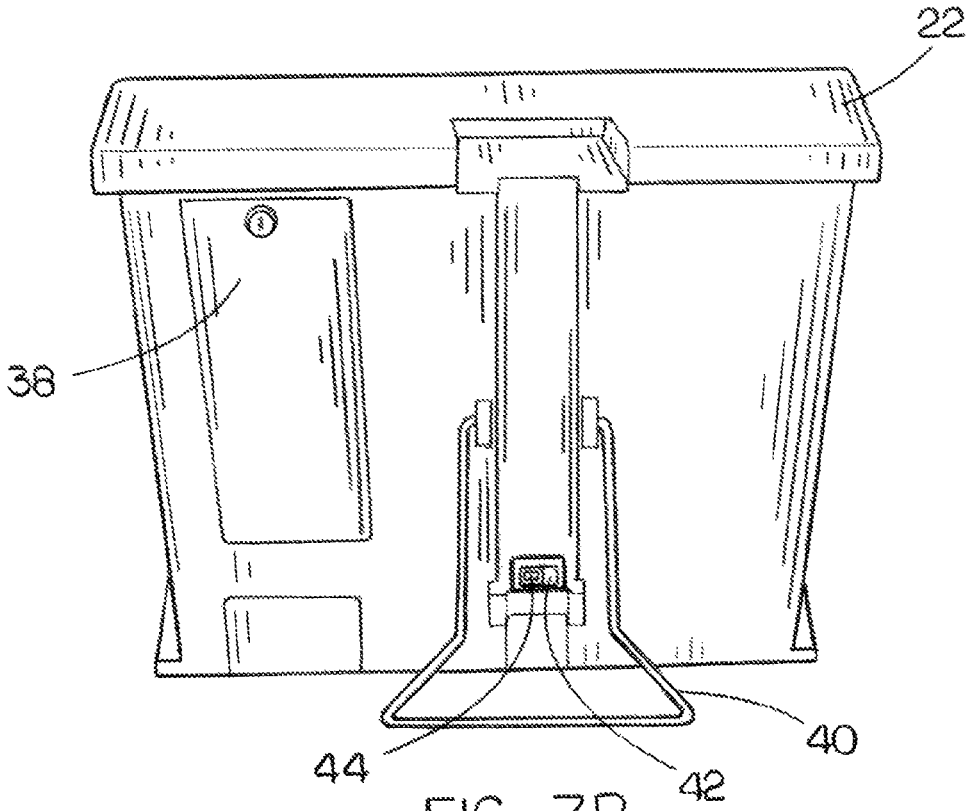

Universal voting station 12 includes a housing 22 that is securely mounted to cart 16. Referring to FIG. 3, a touch screen display 24, front access door 26, keypad 28, and auxiliary panel 30 are mounted within housing 22 and are accessible through openings in the front of housing 22. The front of housing 22 also includes an opening 32 for receiving an activation card 20. As shown in FIG. 1, the right side of housing 22 includes a paper path access door 34. The left side of housing 22, shown in FIG. 7A, includes a security compartment door 36. As shown in FIG. 7B, the rear of housing 22 has a rear access door 38. A kickstand 40 is mounted to the rear of housing 22 for positioning universal voting station 12 at any angle when not tethered to tabulation device 14. A power inlet 42 and Ethernet port 44 extend through the rear of housing 22. The front access door 26, paper path access door 34, security compartment door 36, and rear access door 38 include locks that are operable to secure them to the housing 22. The front access door 26, paper path access door 34, and rear access door 38 allow an operator to access a paper path module 46, shown in FIG. 9A, of universal voting station 12 for removal or maintenance. The security compartment door 36 allows an operator to access USB ports 122*a-c* (FIG. 10A) of universal voting station 12. Universal voting station 12 may also include a privacy screen to shield a voter's selections.

Touch screen display 24 preferably includes a 15 inch LCD display screen 24*a* (FIG. 10A) manufactured by LG and a transparent resistive touch screen 24*b* (FIG. 10A) manufactured by ELO Touch Solutions that allows tactile interaction with universal voting station 12. A voter may use the touch screen display 24 to enter his/her voting selections and navigate through menus of universal voting station 12. The LCD display screen 24*a* is preferably a high-contrast thin-film transistor (TFT) device suitable for use in environments with bright ambient light. The LCD display screen 24*a* is preferably backlit using CCFL (cold cathode fluorescent lamp) devices.

Figure 8:
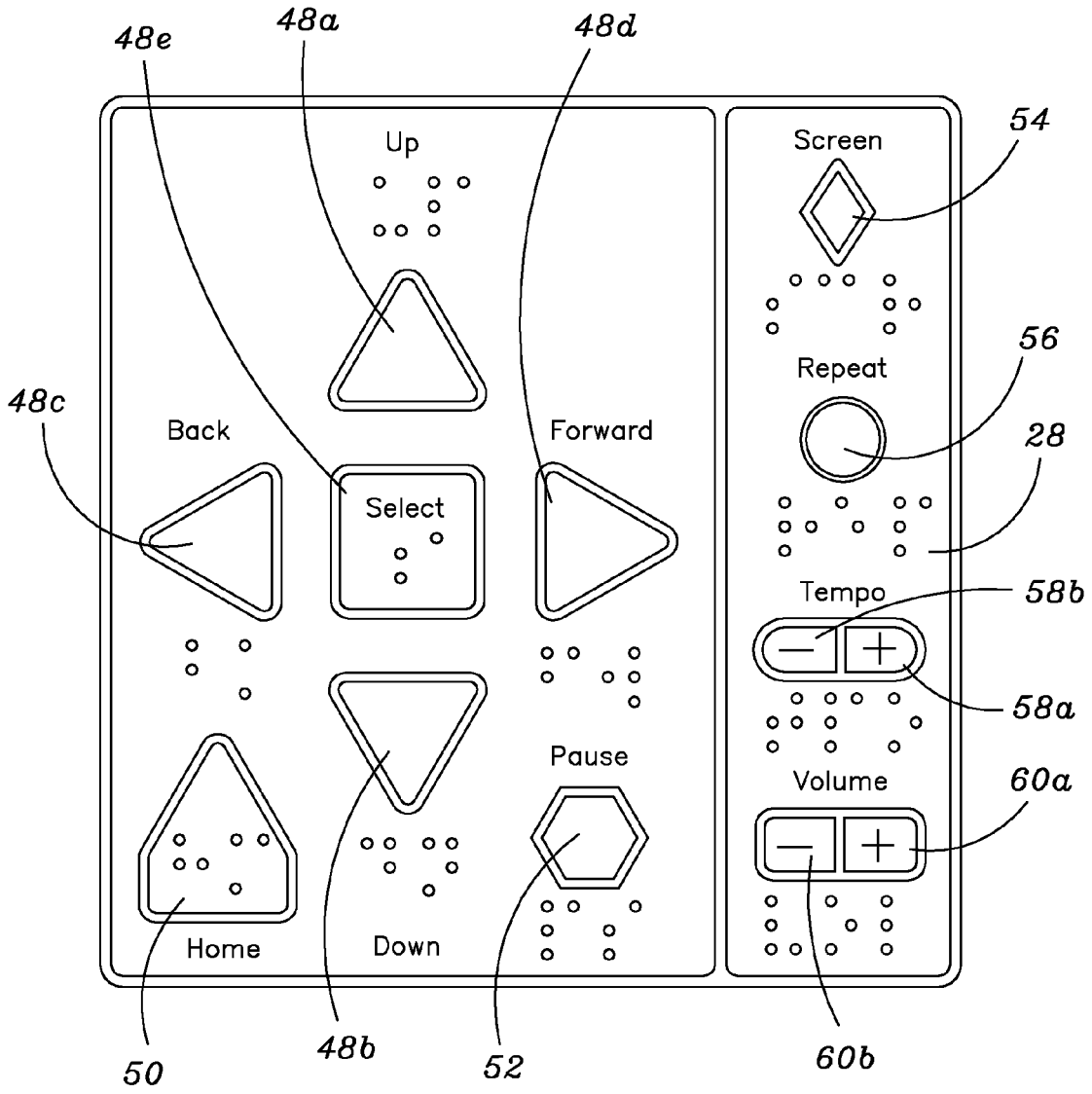
FIG. 8 shows a keypad of the voting station of FIG. 1.

Keypad 28 allows a voter to enter his/her voting selections and navigate through menus of universal voting station 12 as an alternative to touch screen display 24. As best shown in FIG. 8, keypad 28 is embossed with Braille descriptions making it suitable for blind and vision impaired voters. Keypad 28 is detachably mounted to the front access door 26 and is electrically coupled to hardware of universal voting station 12 with a coiled cable for ease of use. The keys of keypad 28 are color coded, have unique shapes, and have Braille descriptions to accommodate as many users as possible. The keypad includes "up" 48*a*, "down" 48*b*, "back" 48*c* and "forward" 48*d* buttons which allow a user to navigate through an audio ballot or menu, and a center "select" button 48*e* allowing a user to select a candidate or option. A "home" button 50 opens a screen with voting instructions. Pressing the "home" button does not reset the vote selections, i.e., any selections made prior to pressing the "home" button are retained. A "pause" button 52 may be pressed to momentarily pause and then resume an audio ballot. A "screen" button 54 controls a privacy darkening option. Pressing the "screen" button 54 darkens the display 24, and pressing it again makes the display 24 viewable. A "repeat" button 56 repeats the last spoken phrase of an audio ballot. "Tempo" plus and minus buttons 58*a*, 58*b* allows a voter to control the speed or rate of speech of an audio ballot. "Volume" plus and minus buttons 60*a*, 60*b* allow a voter to control the audio volume of an audio ballot. It can be appreciated that voters who are blind or vision-impaired would use the Braille markings on the keypad 28 to select the appropriate button.

Figure 4:
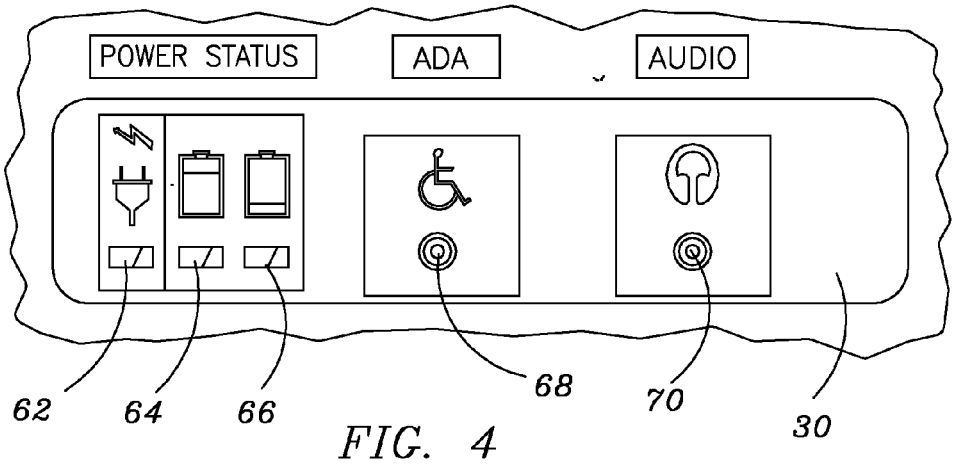
FIG. 4 is a close-up view of an auxiliary panel of the voting station of FIG. 1.

Auxiliary panel 30, shown in FIG. 4, includes a power cord status LED 62, a green battery charge status LED 64, a red battery charge status LED 66, a dual switch access port 68, and an audio port 70. The power cord status LED 62 is lit when universal voting station 12 is connected to an AC power source. The green battery charge status LED 64 and red battery charge status LED 66 are off when a power switch 146 (FIG. 10B) of universal voting station 12 is turned off. When the power switch 146 is turned on, either the green battery charge status LED 64 or red battery charge status LED 66 is lit. The green battery charge status LED 64 is lit when universal voting station 12 is connected to an AC power source or a backup battery 138 (FIG. 10B) is substantially charged. The red battery charge status LED 66 is lit when the backup battery 138 is nearly discharged.

Dual switch access port 68 permits the connection of a dual switch access device, such as a sip and puff device, paddle switch, floor switch, or any similar two position switching device known in the art, for voters who cannot use the touch screen display 24 or keypad 28. In this embodiment, the dual switch access port 68 is a 3.5 mm input jack.

A voter may connect headphones to audio port 70 to listen to an audio ballot listing the voting choices for each of the contests in the election. A blind or vision impaired voter listening to the audio ballot may use the keypad 28 described above to make his/her voting selections. The audio ballot may be played in a number of different languages for voters that do not speak the native language of the jurisdiction. The audio ballot is generated with either speech synthesis or pre-recorded audio.

Figure 9A:
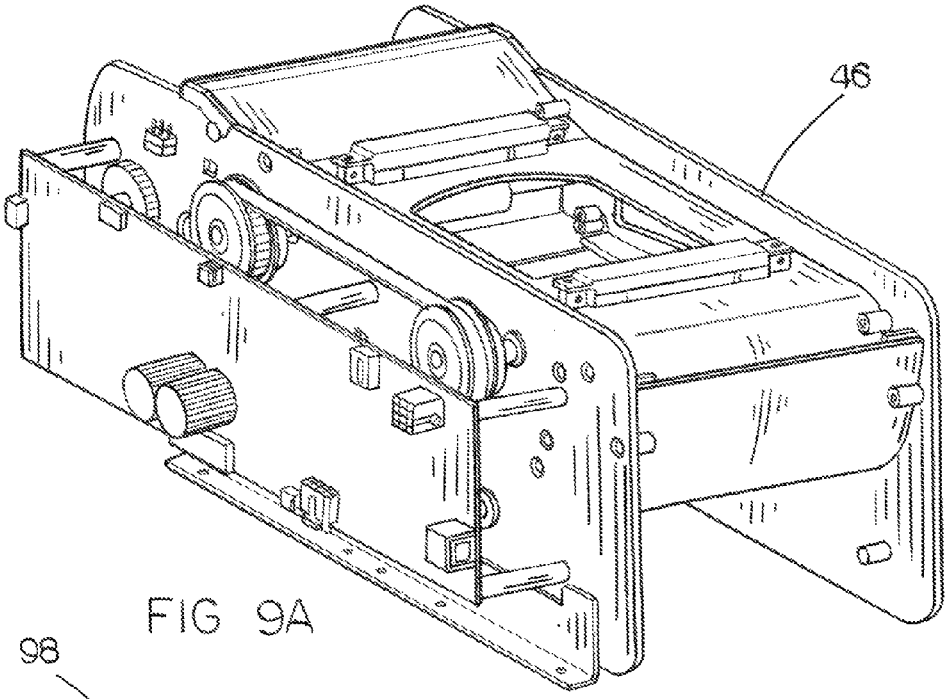
FIGS. 9A-9B show a paper path module of the voting station of FIG. 1.

Paper path module 46, shown in FIG. 9A, is mounted within housing 22 behind front access door 26. Referring to FIG. 10B, paper path module 46 includes the following components in a single assembly that may be removed from the housing 22 for maintenance or replacement: a printer 72 operable to thermally print on an activation card 20, a scanner 74 operable to scan an activation card 20, a paper path motor 76 connected to rollers (not shown) for moving an activation card 20 through the module, a diverter motor 78 and diverter 100 (FIG. 9C) for guiding an activation card 20 within the module, and paper path sensors 80 that detect the position of an activation card 20 within the module.

Figure 9B:
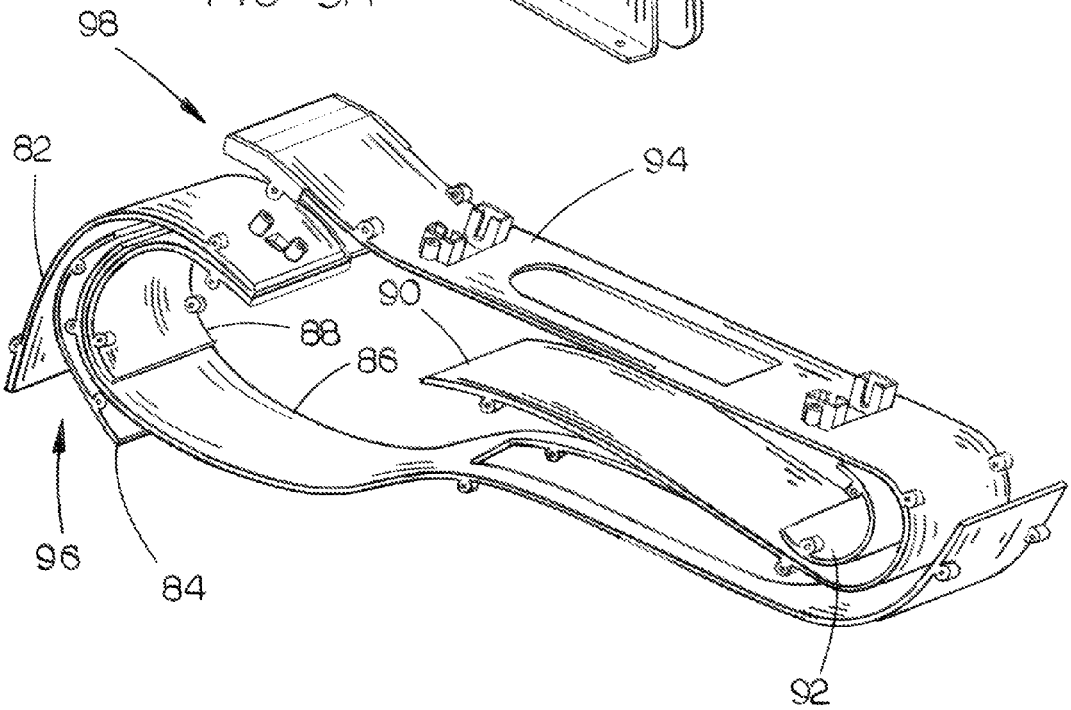
Figure 9D:
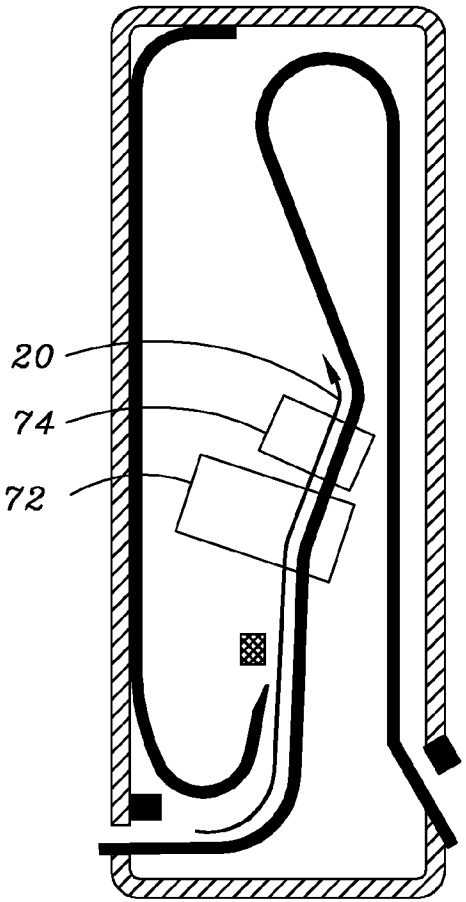
FIGS. 9C-9H show an activation card at different positions within the paper path module shown in FIGS. 9A-B.
Figure 9C:
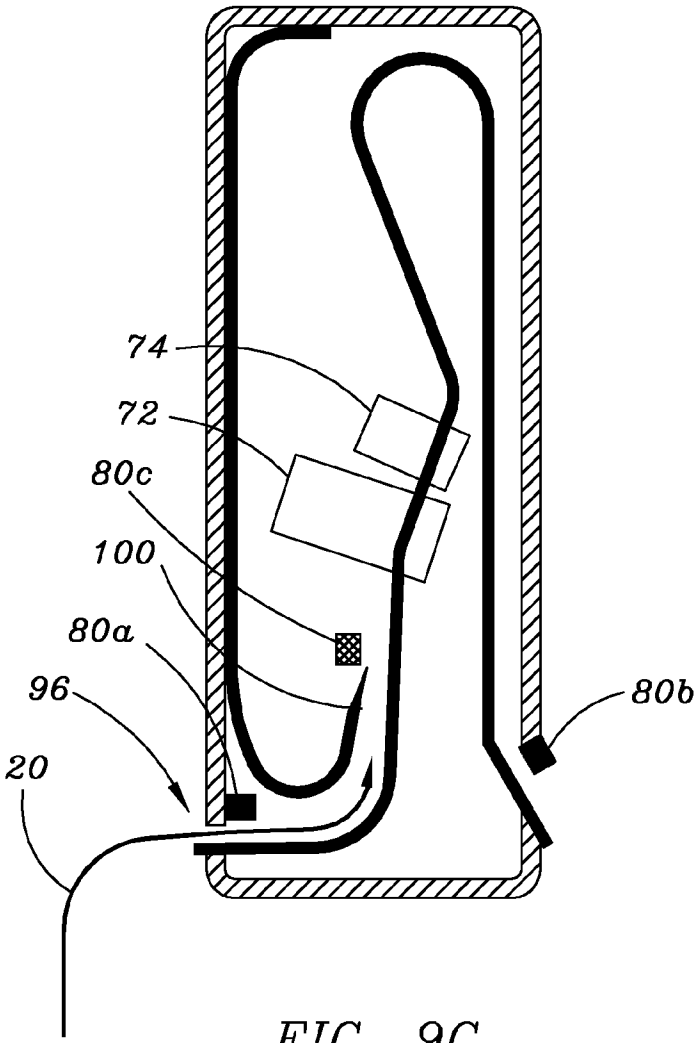
Figure 9F:
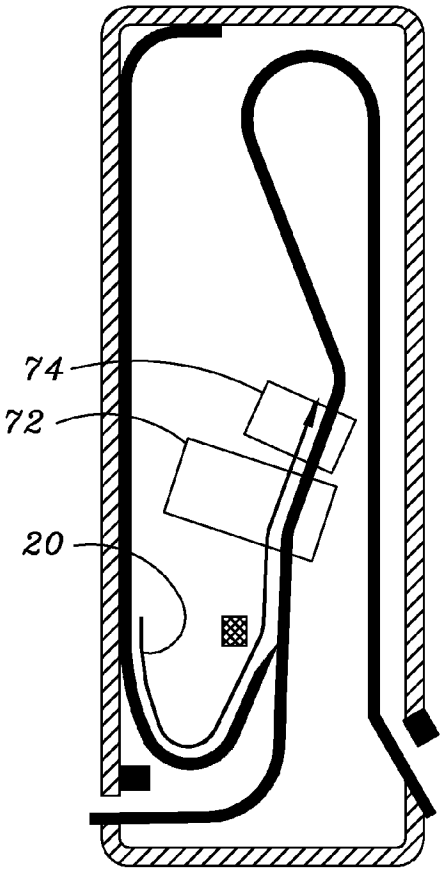
Figure 9E:
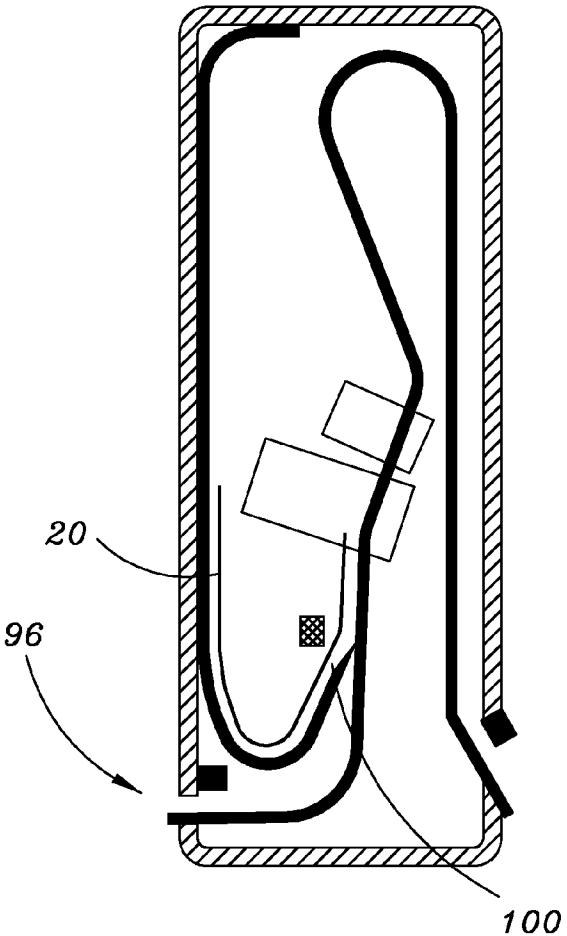
Figure 9H:
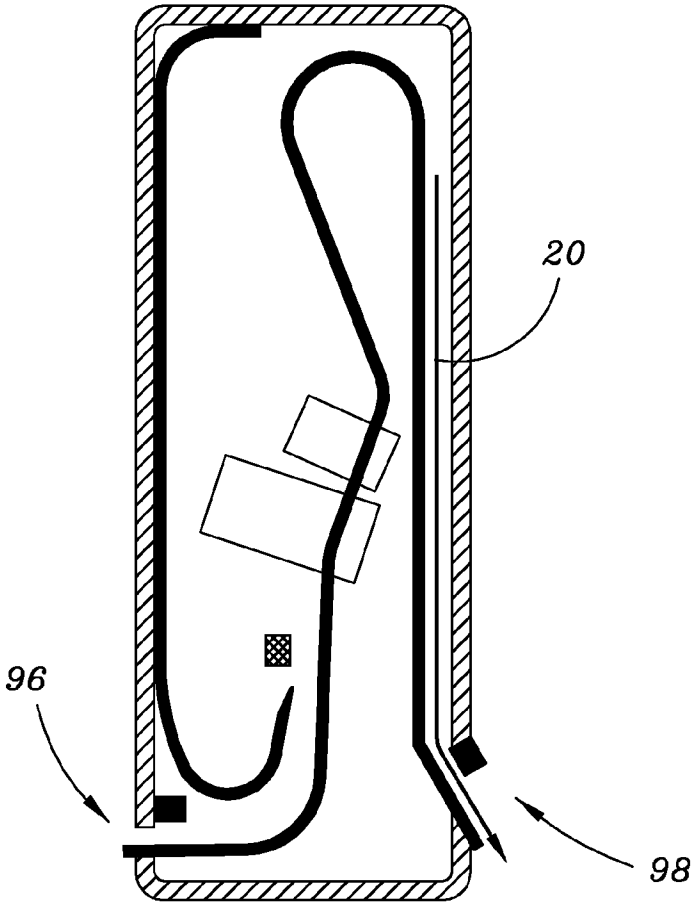
Figure 9G:
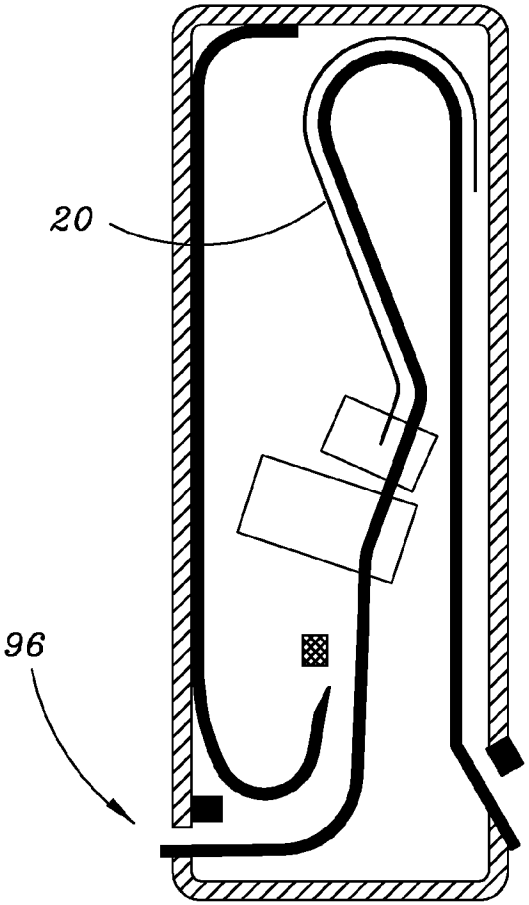

Referring to FIG. 9B, paper path module 46 includes the following components that guide an activation card 20 through the module: an entry path 82, entry cover 84, holder path 86, holder cover 88, main paper path 90, u-turn cover 92, and exit path 94. An entrance 96 for paper path module 46 between entry path 82 and entry cover 84 receives activation cards 20. An exit 98 at the end of exit path 94 deposits activation cards 20 in ballot box 18 (FIG. 2). Activation cards 20 may also exit through the entrance 96 if universal voting station 12 when a voter chooses to receive his/her activation card 20 after it is marked. FIG. 9C shows an activation card 20 being inserted in entrance 96. FIG. 9D shows the activation card 20 in a position where the scanner 74 may scan the activation card 20 and determine which election contests to display on touch screen display 24. In this position, activation card 20 is between the entry path 82 and entry cover 84 and along the main paper path 90 underneath the printer 72 and scanner 74. FIG. 9E shows the activation card 20 being backed into a pre-print position, in which a portion of the activation card 20 is positioned between the holder path 86 and holder cover 88. A diverter 100 moves into a pre-print position to guide the rear portion of activation card 20 between the holder path 86 and holder cover 88 and prevent it from exiting entrance 96. This prevents a portion of activation card 20 from sticking out of entrance 96 during the voting process and being visible and/or accessible to a voter. FIG. 9F shows the activation card 20 moving along the main paper path 90 while the printer 72 prints on the activation card 20 and the scanner 74 scans the activation card 20. FIG. 9G shows the activation card 20 in an accept or reject decision position, in which the card 20 is positioned between u-turn cover 92 and exit path 94 while the voter determines whether to accept or reject the voting selections displayed on touch screen display 24. FIG. 9H shows the card moving along the exit path 94 and out the exit 98. It should be understood that the activation card 20 may also exit through entrance 96 by moving from the position shown in FIG. 9G in the opposite direction as shown in FIG. 9H.

The paper path motor 76, rollers (not shown), diverter motor 78, an entry path 82, entry cover 84, holder path 86, holder cover 88, main paper path 90, u-turn cover 92, and exit path 94, and diverter 100 in combination form a transport mechanism of paper path module 46 that is operable to receive an activation card 20, move the activation card 20 past printer 72 and scanner 74, return the activation card 20 to the voter when universal voting station 12 operates in the standalone mode described below, and deposit the activation card 20 into ballot box 18 when universal voting station 12 operates in the tethered mode described below. All of the components of the paper path module 46 described above are integrated in a single unit.

Printer 72 is preferably a thermal printer manufactured by Seiko that is operable to print voting selections entered by the voter on an activation card 20 moving through paper path module 46.

Scanner 74 preferably comprises at least one contact image sensor, and preferably three, that is mounted adjacent to printer 72 and close to the path through which an activation card 20 moves. The scanner 74 is positioned so that it is operable to image material printed on an activation card 20. The scanner 74 allows universal voting station 12 to identify the orientation and style of an activation card 20 after it is inserted, and allows universal voting station 12 to image voting selections printed on an activation card 20 by printer 72 for verification by a voter. Scanner 74 is preferably made up of multiple photoelectric sensor integrated circuits with a standard resolution of 8 pixels per millimeter (203.2 per inch). Scanner contains an array of red LEDs for its own light source. It should be understood that other types of imaging devices besides scanner 74 may be used in universal voting station 12 for producing an image of the activation card 20 and transmitting that image to the processor of single board computer 118.

Referring to FIG. 9C, entrance and exit paper sensors 80*a* and 80*b* are positioned in the paper path module 46 adjacent the entrance 96 and exit 98, respectively, and a main path paper sensor 80*c* is positioned adjacent diverter 100. The paper sensors 80*a-c* are operable to detect the position of an activation card 20 in the paper path module 46. The sensors 80*a-c* are preferably infrared optical reflective sensors. The sensors 80*a-c* are operable to: perform VSA style decoding by reading barcodes printed on an activation card 20 that indicate the style of the card 20; check whether an activation card 20 has already been marked; validate that the printer 72 has printed each mark corresponding to the voter's contest selections at the correct positions on the activation card 20; and provide more accurate alignment of marks printed on an activation card 20.

Universal voting station 12 includes a double sheet detector sensor (not shown) that is operable to detect if more than one activation card 20 is inserted at one time into the paper path module 46. The sensor prevents the insertion of multiple activation cards 20 into the paper path module 46 at the same time, and returns the cards 20 back to the voter. The sensor prevents incorrectly marked cards, jams, and equipment damage that could result if more than one card at a time were inserted into the paper path module 46. The sensor may be any of the following: a controlled aperture including a mechanical structure with a slot that is operable to accept a single card, but will block double sheet insertions; a mechanical thickness sensor including an electromechanical switch calibrated to sense paper thickness in excess of the specified maximum; and/or an ultrasonic sheet detector including a pair of ultrasonic transducers that can discriminate between no sheets of paper, one sheet, or two sheets of paper. Ultrasonic technology can make this discrimination independent of the thickness of the thermal paper.

Referring to FIG. 5, activation card 20 is rectangular and includes a chamfer 102 on one corner to assist a voter in inserting the card 20 into the paper path module 46 in the correct orientation. The activation card 20 is preferably thermal paper stock having a width of 4.25 inches and a length of 11, 14, 17, or 19 inches. Activation card 20 is preferably preprinted with an activation barcode 104, verification digits 106, and ballot header text 108. Referring to FIG. 6, after a voter has made his/her voting selections with universal voting station 12, printer 72 prints a master barcode 110, vote selection barcodes 112, and vote selections 114 on activation card 20. The ballot header text 108 may optionally be printed by printer 72 at the same time that the voting selections are printed on card 20. Alternatively, a poll worker may insert the activation card 20 into an external printer (not shown) that prints the activation barcode 104, verification digits 106, and ballot header text 108 before the poll worker hands the card 20 to a voter.

The activation barcode 104 identifies the proper ballot style for a particular voter. Scanner 74 images the activation barcode 104 to verify that the activation card 20 is valid and to determine the proper ballot style associated with the card 20 that is loaded into universal voting station 12 as part of the election definition described in more detail below. In an alternate embodiment, the activation card 20 may not include an activation barcode 104, in which case a poll worker would select the correct ballot style for the voter after a blank activation card 20 is inserted into universal voting station 12. The verification digits 106 verify the accuracy of the printed activation barcode 104. The ballot header text 108 specifies the election name, date, and location based on the activation barcode 104.

The master barcode 110 is a 26 digit code that includes the following: a ten digit precinct ID, a ten digit logical ballot ID, three digits representing the number of write-in votes, and three digits representing the total number of voting selections. Each of the vote selection barcodes 112 identifies the location of the mark space on a conventional paper ballot used for the election that corresponds with the particular voting selection made by the voter for a particular contest. Each vote selection barcode 112 is a six digit code that includes the following: two digits that identify the column or horizontal position of the mark space on a conventional paper ballot associated with the particular voting selection made by the voter, two digits that identify the row or vertical position of the mark space on a conventional paper ballot associated with the particular voting selection made by the voter, one digit that identifies the side of the conventional paper ballot on which the mark space associated with the particular voting selection made by the voter is positioned (preferably the number 1 identifies the front of the ballot and the number 2 identifies the back of the ballot), and one digit that identifies the sheet number from 1-9 of the conventional paper ballot on which the mark space associated with the particular voting selection made by the voter is positioned. The vote selection barcode 112 corresponding to a write-in voting selection is in the same format as described above because a conventional paper ballot has a mark space that must be filled in to indicate that the voter is selecting a write-in candidate for a particular contest. The scanner 74 and/or tabulation device 14 are operable to read the master barcode 110 and vote selection barcodes 112 during verification and/or tabulation, respectively.

The vote selections 114 are human readable text identifying each voting selection made by the voter (e.g., "General Motors") and a brief description of the contest and/or candidate (e.g., "BEST AUTOMOBILE MANUFACTURER"). A write in vote selection 116 is identified by including "WRITE-IN:" before the candidate's name and an arrow pointing to the left after the candidate's name. Alternatively, a write in vote selection 116 is printed in white text on a black background for ease of identification, while the remainder of vote selections 114 are printed in black text on a white background. The "BEST VOCAL ARTIST" and "BEST ICE-CREAM FLAVOR" contests shown in FIG. 6 allow for the selection of two candidates, while the "BEST AUTOMOBILE MANUFACTURER" contest only allows for the selection of one candidate. The voter chose the two candidates "FRANK SINATRA" and "STEVIE RAY VAUGHAN" for the "BEST VOCAL ARTIST" contest, but only chose one candidate, the write in selection for "MICKEY MOUSE," for the "BEST ICE-CREAM FLAVOR" contest. Thus, the activation card displays "NO SELECTION MADE" under the "BEST ICE-CREAM FLAVOR" contest to indicate that the voter under voted the contest by only choosing one candidate. The activation card 20 including the master barcode 110, vote selection barcodes 112, and vote selections 114 serves as a voter verifiable, auditable record of a voter's voting selections. It should be understood that all of the information printed on the activation card 20 is human-readable except for the barcodes, which are printed in a machine-readable format. Of course, other activation card configurations are also within the scope of the present invention. For example, in lieu of having an activation barcode 104, the activation card 20 may have an identification grid with a matrix of squares. The squares may be machine-marked or hand-marked by a poll-worker in a manner that when scanned by universal voting station 12 provides information on the proper ballot style that is associated with the activation card 20. The activation card 20 may include other types of identification codes which may be scanned and detected by universal voting station 12 to identify a proper ballot style.

When operational, universal voting station 12 preferably has a width of approximately 19 inches, a depth of approximately 5.5 inches, and a height of approximately 17 inches. When closed, universal voting station 12 preferably has a width of approximately 22.5 inches, a depth of approximately 17 inches, and a height of approximately 11 inches. Universal voting station 12 preferably has a weight of approximately 20 pounds.

Figure 10A:
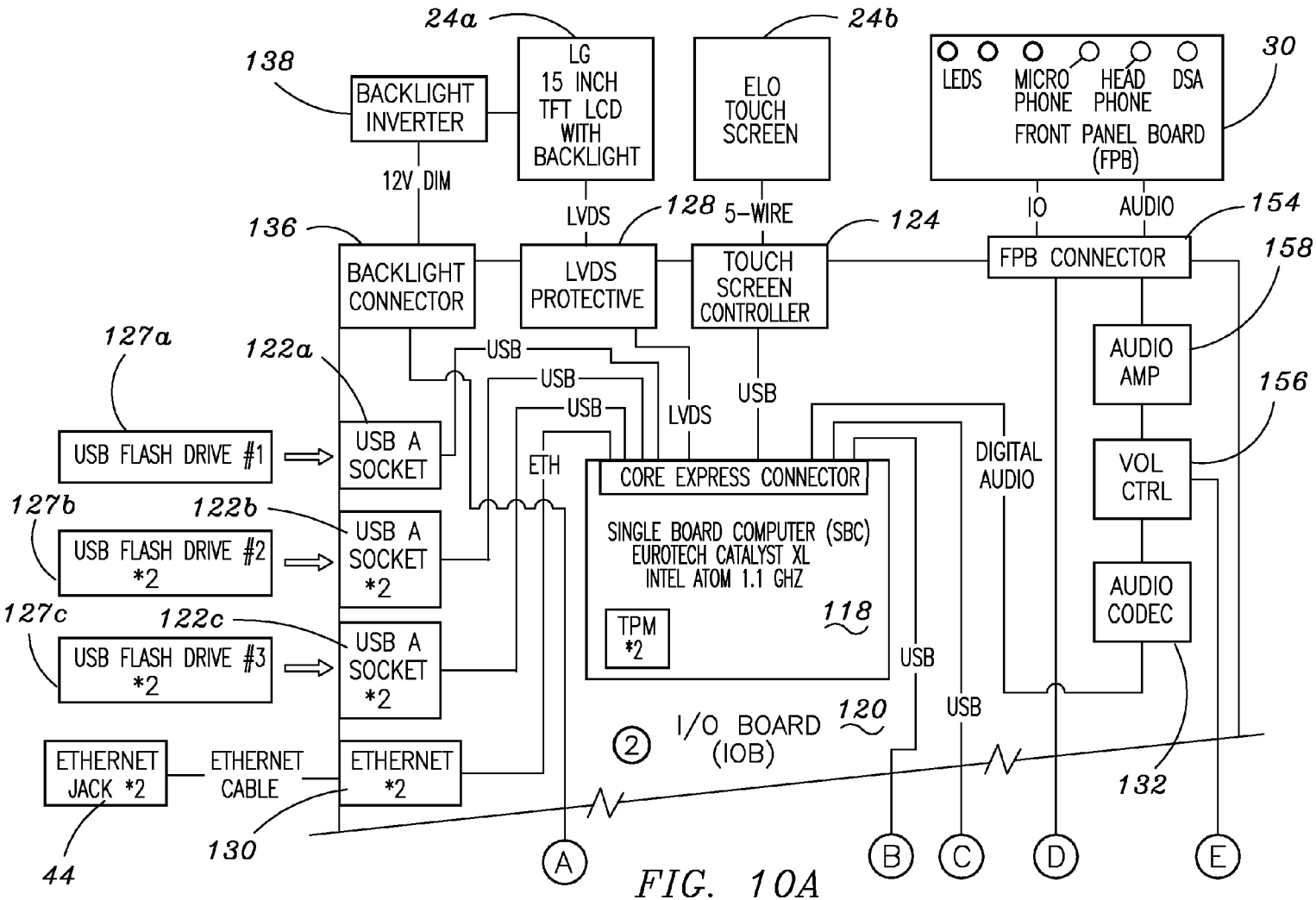
FIGS. 10A-B show a diagram of the hardware of the voting station of FIG. 1.
Figure 10B:
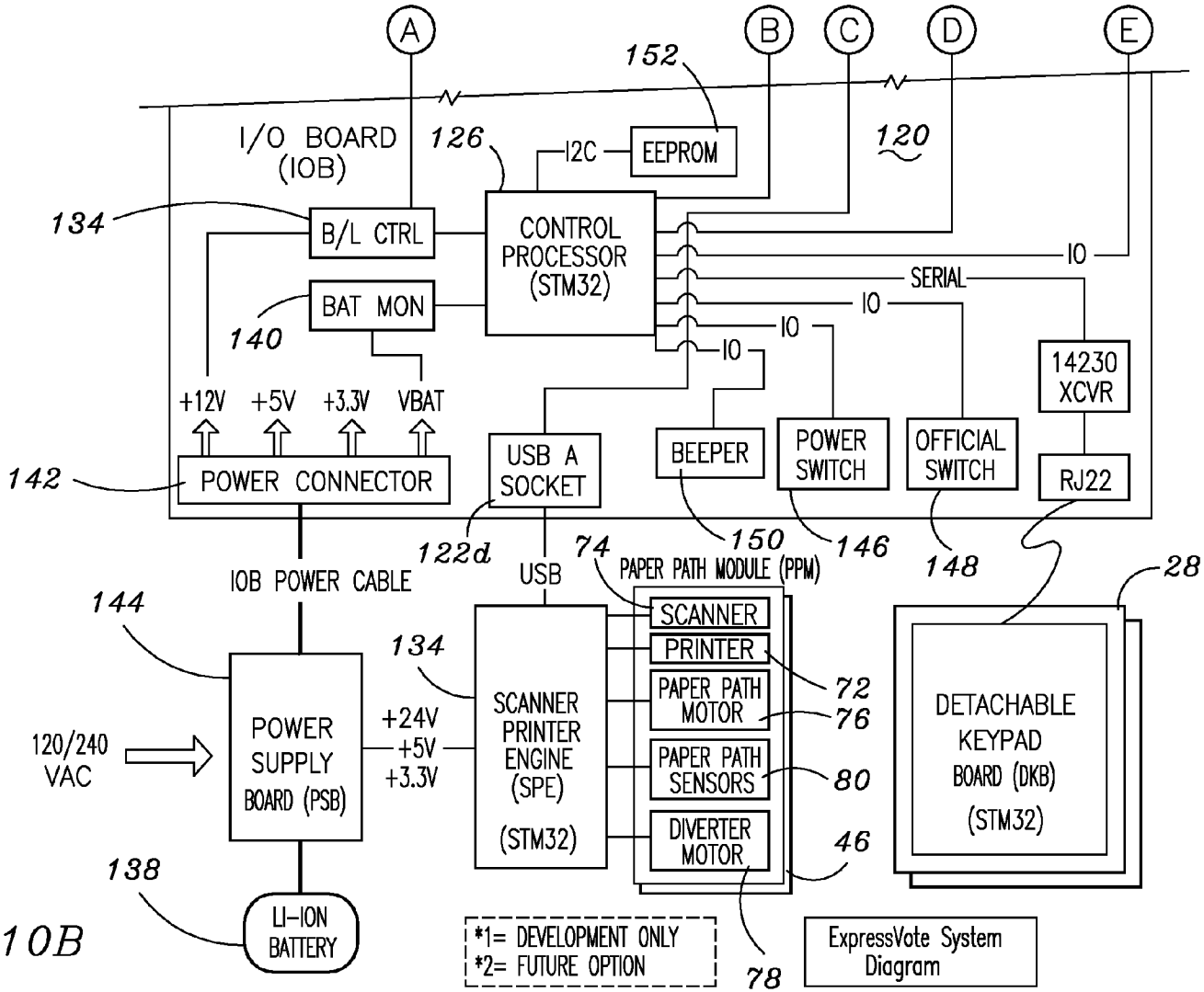

Referring to FIGS. 10A-B, universal voting station 12 includes a single board computer 118 mounted within housing 22 that controls operation of the various hardware components of universal voting station 12 including the touch screen display 24, keypad 28, auxiliary panel 30, and paper path module 46. Single board computer 118 is a commercial off the shelf printed circuit board preferably manufactured by Eurotech. It preferably includes a 1.1 GHz Intel Atom processor. The single board computer 118 is mounted in a socketed connector on an input/output board 120 ("I/O board"). Single board computer 118 supports Windows CE and Linux operating systems. Single board computer 118 is vibration resistant because it uses solder-down memory chips (as opposed to plug-in memory modules) to meet federal election guidelines that require election machines to be subjected to rigorous vibration testing. Single board computer 118 provides the future option for a Trusted Platform Module, which provides enhanced security that may be needed for future election systems. Single board computer 118 also contains a 3V lithium ion cell battery, which is replaceable only by authorized service personnel.

Single board computer 118 includes USB interfaces to the following components on I/O board 120: four USB A ports 122*a*, 122*b*, 122*c* and 122*d*, a touch screen controller 124, and a control processor 126. USB ports 122*a-c* are preferably accessible through a security compartment door 36 and are operable to receive USB flash drives 127*a-c* that may contain election qualification codes or the election definition necessary to operate universal voting station 12 as discussed in more detail below. USB port 122*d* connects to a scanner printer engine 134 and touch screen controller 124 connects to touch screen 24*b*. Touch screen controller 124 includes circuitry that continually scans the resistive touch screen 24*b* and generates commands when it detects that a voter has tapped a button on the screen, which are sent to single board computer 118. Single board computer 118 has a low voltage differential signal (LVDS) interface with an LVDS protective connector 128 on I/O board 120 that connects to display screen 24*a*, an Ethernet interface with an Ethernet port 130 on I/O board 120 that connects to Ethernet port 44, and a digital audio interface with an audio codec 132 on I/O board 120.

Single board computer 118 implements a protection scheme that allows a media device containing the election definition and inserted into one of USB ports 122*a-c* to be utilized only as a source of election data. Single board computer 118 prevents an external USB device from accessing the operating system, or the ability to modify firmware. A board support package for the single board computer 118 includes a custom USB driver for interfacing with scanner printer engine 134 through a USB port 122*d* that is available as a one-way interface through the rear access port.

The single board computer 118 contains circuitry for interfacing to scanner 74. The single board computer 118 generates a clock signal and a start pulse that are sent to scanner 74 using LVDS. The scanner 74 outputs clocked digital pixel data which is coupled to serial data interface channels on a digital signal processor (DSP) on the single board computer 118. The DSP drives a three-channel digital to analog converter (DAC) chip, providing programmable black/white thresholds, and allowing calibration firmware running on the single board computer 118 to adjust for variations in scanner performance and production. The DSP accumulates scanner data in its internal RAM memory which it receives from the scanner 74. As it receives each complete scan line of 2,048 pixels, it generates a hardware interrupt to the IXP425 main processor. The main processor then copies the scan data by accessing dual-port RAM within the DSP over the DSP's host port interface (HPI), a parallel bus interface.

I/O board 120 is a printed circuit board that is designed specifically to provide circuitry and connectors to interface single board computer 118 to the peripheral components of universal voting station 12. Control processor 126 on I/O board 120 is connected to a backlight controller 134, which is connected to a backlight connector 136 that is connected to LCD display screen 24*a*. Control processor 126 is operable to turn the backlight of LCD display screen 24*a* on and off and dim the screen 24*a* through these connections. Control processor 126 is connected to a backup battery 138 through a battery monitor 140, power connector 142, and power supply board 144. The control processor 126 is operable to monitor the charge condition of battery 138 through these connections. The control processor 126 is connected to and monitors a power switch 146 that turns universal voting station 12 on and off, and a voter/official switch 148 that controls whether the system is in voter mode or official mode. The power switch 146 is located inside the compartment enclosed by security compartment door 36 shown in FIG. 7C. The control processor 126 is also connected to a beeper 150 on I/O board 120. The control processor 126 provides a serial interface to a printed circuit board of keypad 28.

Control processor 126 is capable of writing to EEPROM memory 152 mounted on I/O board 120 which is a non-volatile memory chip for storing system data. EEPROM memory 152 can be programmed in-circuit by firmware running in single board computer 118. EEPROM memory 152 is used for storing factory calibrations, as well as data that can change during operation of universal voting station 12, such as a running tally of activation cards 20. The size of the EEPROM array available for this purpose is 1,024 bytes.

Control processor 126 is connected to an auxiliary panel connector 154 that is connected to a printed circuit board of auxiliary panel 30. Control processor 126 is also connected to a volume control 156 which is connected to audio codec 132 and an audio amplifier 158. Audio amplifier 158 is connected to auxiliary panel 30 through auxiliary panel connector 154. Through these connections, control processor 126 is operable to control the volume on headphones plugged into auxiliary board 30. Control processor 126 is also operable to process instructions from the dual switch access port 68 (FIG. 4) on auxiliary panel 30, and determine whether LEDs 62, 64, and 66 are lit.

Scanner printer engine board 134 is a printed circuit board that contains a microprocessor which controls all the components of paper path module 46. It communicates with single board computer 118 via a USB cable. It is operable to actuate printer 72 and paper path motor 76 in such a way that permits the appropriate marking on activation card 20. Scanner printer engine board 134 monitors the printing process, detects a paper jam if it occurs, and provides a message to single board computer 118 in that event.

Power supply board 144 is a printed circuit board that controls power distribution to the components of universal voting station 12. Power supply board 144 has inputs of 120 or 240 Volts AC line voltage and the backup battery 138. Outputs of power supply board 144 include +24V, +5V, and +3.3V to scanner printer engine 134, and +12V, +5V, +3.3V, and the voltage of backup battery 138 to I/O board 120 through power connector 142. Power supply board 144 provides 12V to backlight inverter 138. Power supply board 144 generates the DC voltages required by the circuitry within universal voting station 12 and provides the following functions: automatic switching to the backup battery 130 when the AC line voltage goes out, charging of backup battery 130, and voltage conversion.

When power switch 146 (FIG. 10B) is in the "on" position, power control circuitry on I/O board 120 turns on power to single board computer 118 and scanner printer engine 134. Power is then turned on for the touch screen display 24, backlight inverter 138, scanner 74, printer 72, and other related system components. When power switch 146 is moved to the "off" position, control processor 126 first communicates with single board computer 118 to make sure that all single board computer 118 system processes are complete. Upon acknowledgement from single board computer 118 of its readiness to shut down, or after the expiration of a time-out period, I/O board 120 turns off power to single board computer 118, scanner printer engine 134, and connected system components. This scheme provides an orderly shut-down without loss of system data. If the power supply board 144 is connected to AC power, it will stay on in a low-power mode even when power switch 146 is off to keep backup battery 138 fully charged.

Backup battery 138 can supply power to universal voting station 12 for at least 2 hours in the event of AC power loss. If the AC power is lost or removed, power supply board 144 automatically switches to battery back-up power. Backup battery 138 is preferably an 18V, 4,300 mAh lithium ion battery.

Figure 11:
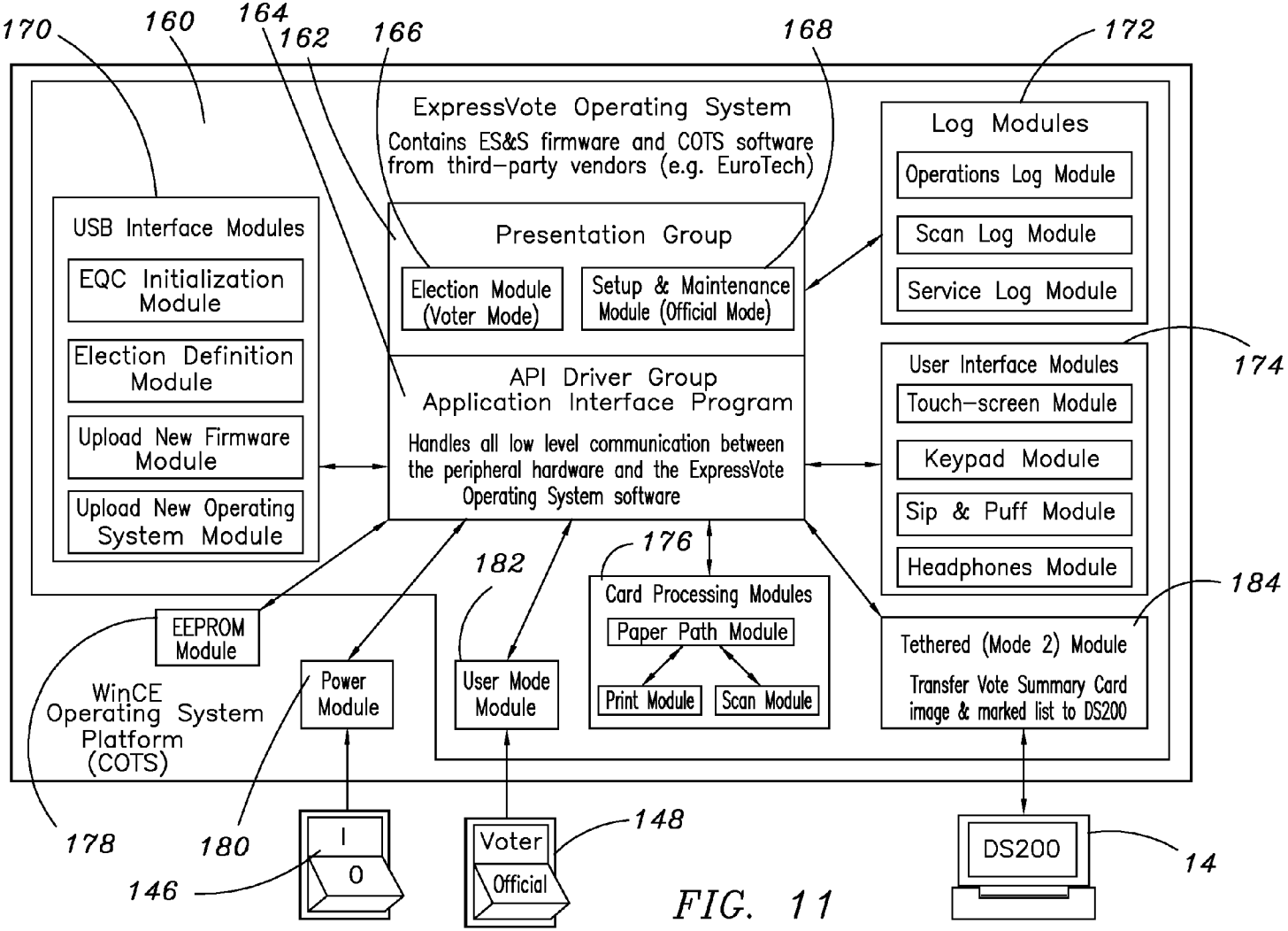
FIG. 11 is a diagram of the operating system of the voting station of FIG. 1.

Referring to FIG. 11, universal voting station 12 includes an operating system 160 executed by single board computer 118. Operating system 160 is based on Microsoft Windows CE .NET, version 6.0. Microsoft .NET Compact Framework, version 1.0 is the foundation upon which the operating system 160 applications are built, deployed and integrated.

The operating system 160 includes a presentation group 162 and API driver group 164. Presentation group 162 provides activation card voting access to disabled voters. In conjunction with the API driver group 164, presentation group 162 allows voters to do the following: enlarge/reduce the size of on-screen instructions and contests; change the contrast of on-screen instructions and contests; listen via headphones to the audio instructions and contests; respond via the touch screen display 24 to instructions and contests; respond via keypad 28 to instructions and contests; and respond via an accessible device connected to dual switch access port 68 to instructions and contests. Presentation group 162 contains and directly controls an election module 166 and setup and maintenance module 168. Presentation group 162 interacts through the API driver group 164 with the following modules: USB interface modules 170, log modules 172, user interface modules 174, card processing modules 176, EEPROM module 178, power module 180, user mode module 182, and tethered module 184. Visual Basic, C++, and C# support the presentation group 162. The screens displayed on touch screen display 24 are presented in Visual Basic.

Execution within the presentation group 162 is initiated after universal voting station 12 successfully completes power-on diagnostics. If the voter/official switch 148 is in the "Voter" position, then the election module 166, with its related screens, is active within the presentation group 162. However, if the voter/official switch 148 is in the "Official" position, then the setup and maintenance module 168, with its related screens, is active instead. Switching between these modules is done by toggling the voter/official switch 148.

API driver group 164 handles all low level communications between the software and hardware for universal voting station 12. API driver group 164 uses function calls and Windows messaging to communicate between the software's presentation group 162 and the hardware modules. API driver group 164 runs on top of the Windows CE Operating System platform. C++ and C# are the standard unit languages that support the API driver group 164.

The operating system 160 provides security access controls to limit or detect access to critical system components and to guard against loss of system integrity, availability, confidentiality, and accountability. Functions are only executable in the manner and order intended, and only under the intended conditions. Control logic prevents marking of activation card 20 if any preconditions to activation card 20 marking have not been met. Hardware of universal voting station 12 is designed to protect against tampering during system repair, or interventions in system operations, in response to system failure. System access during equipment preparation, testing and operation is limited by physical locks and access code. Security safeguards cannot be bypassed or deactivated during system installation or operation.

Tabulation Device

In the exemplary embodiment, tabulation device 14 is a DS200® optical scanner sold by Election Systems & Software, LLC. Referring to FIG. 2, tabulation device 14 includes a protective housing 186 with various internal components (as described in detail with reference to FIG. 12), a ballot insertion tray 188, a display 190 and a report printer 192. Each of these components will be described in detail below.

Protective housing 186 is preferably made of injection-molded plastic and has a modular "clamshell" design that provides easy access for maintenance and set up activities. Of course, other materials and designs are also within the scope of the present invention. Protective housing 186 preferably comprises three primary sections to assist in ease of manufacturing and maintenance: base section 186*a*, front cover section 186*b*, and rear cover section 186*c*. In addition, various access doors (not shown) may be included to provide access to a variety of switches, connections and interfaces. For example, in the exemplary embodiment, a locked access door is provided to secure access to a power switch, a "close polls" switch, and a modem with an RJ-11 connection and antenna (discussed further in connection with the main access board 210 of FIG. 12). Another locked access door is provided to secure access to various USB port interfaces for removable USB flash drives (discussed further in connection with the USB board 208 of FIG. 12).

The back of protective housing 186 preferably includes a variety of external ports, such as a USB hub 214 (FIG. 12), an Ethernet port 218 (FIG. 12), and other types of ports that are standard and well known in the art. Of course, the external ports may be located in other locations provided they do not interfere with the use of the tabulation device 14.

Figure 21:
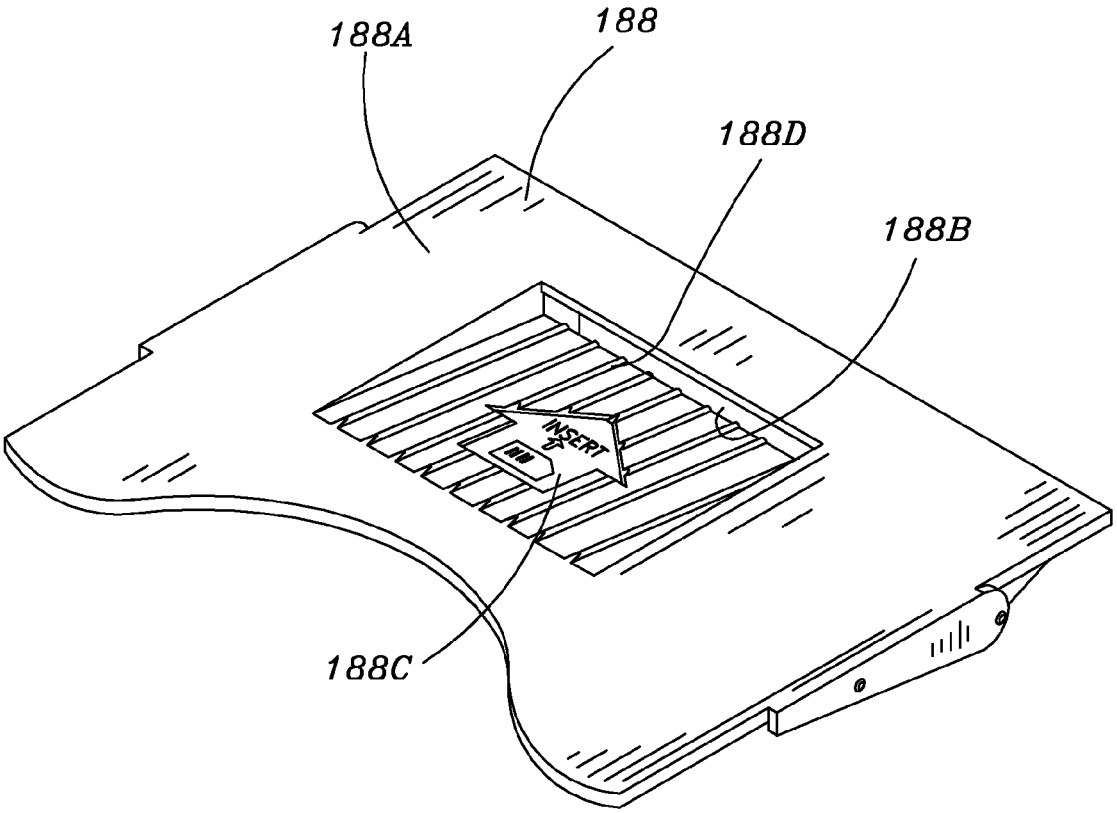
FIG. 21 is a perspective view of a ballot insertion tray of the tabulation device of FIG. 2.

The ballot insertion tray 188 is provided to receive both a conventional paper ballot and an activation card 20 (FIG. 6) for scanning and tabulation. The ballot insertion tray 188 is preferably molded into the front cover section 186*b* of protective housing 186 and is approximately 8.525 inches wide in order to accommodate an 8.5 inch wide standard-size conventional paper ballot. The ballot insertion tray 188 can, however, be designed to fit any size ballot. Referring to FIG. 21, conventional paper ballots are placed on upper surface 188*a* of ballot insertion tray 188, and activation cards 20 are placed within a slot 188*b* that is molded into the ballot insertion tray 188. The slot 188*b* preferably has a width that is slightly larger than the width of an activation card 20. An arrow graphic 188*c* is also preferably molded onto the ballot insertion tray 188 to indicate the proper insertion of an activation card 20. Lastly, the ballot insertion tray 188 preferably has a ribbed texture 188*d* to assist with reducing static buildup. It should be understood that tabulation device 14 may include any type of input device that is capable of receiving a paper ballot and activation card 20.

The display 190 is preferably an LCD touch screen display with a landscape orientation. The display 190 may be a standard, off-the-shelf component which is readily available and well known in the art. For example, the display 190 may be a standard size of 10.4 inches or 12.1 inches, measured diagonally, and approximately 82×82 dpi. Most preferably, the display 190 is a LG Philips 12.1" SVGA (800×600) TFT color display model LB121S03-TL01, which has a color depth of LVDS 6-bit, 262,144 colors and an anti-glare surface treatment. Of course, other types of touch screen displays may also be utilized in accordance with the present invention.

The display 190 is connected to the upper portion of tabulation device 14 by two hinges—one located on each side of the display 190—which enable the display 190 to open up during use or fold down flat during storage. For security and protection, the display 190 preferably incorporates a locking mechanism. The tabulation device 14 may include an LCD switch 216 (FIG. 12) that will sense that the display 190 is open to thereby power up without necessitating a poll worker physically turning on the display 190. Similarly, the LCD switch 216 will sense that the display 190 is closed to thereby power down after a specified period of time.

Alternatively, if the display 190 is not configured as a touch screen display, the tabulation device 14 would also include another type of input device, such as a keyboard, a joystick, a pointing device, a trackball or a touch pad. The display 190 may also comprise a cathode ray tube (CRT) display configured as a touch screen display located external to the tabulation device 14. In such a configuration, the display would be connected to the tabulation device 14 through a dedicated I/O connector of the tabulation device 14. Of course, other types of displays and input devices are also possible and within the scope of the present invention. As will be described in greater detail below, the display 190 provides a voter interface that may be used to display information associated with a scanned paper ballot or activation card 20 to the voter (e.g., information on ballot irregularities) and receive voter feedback.

The report printer 192 is an internal printer for device level and polling place level reporting, including the printing of reports at poll opening and poll closing (as are known in the art). The report printer 192 is a standard printer that is readily available and well known to those skilled in the art. The report printer 192 is capable of printing on paper that is approximately 3 inches wide and is of the drop-in roll paper type. The paper passes through an aperture in the protective housing 186 such that it is easily accessible by users.

As shown in FIG. 2, tabulation device 14 mounts onto the top of cart 16. The base of tabulation device 14 includes four mounting feet (not shown) that provide airflow under the unit and allow it to be securely inserted into a recessed area of the cart 16. In this embodiment, tabulation device 14 slides onto mounting rails (not shown) located on top of the cart 16. A hinged door (not shown) may be located on the front of the cart 16 and may be raised up and locked into place to further secure the tabulation device 14. The cart 16 is preferably made of steel or a durable plastic material for security purposes. In operation, scanned and tabulated ballots and activation cards 20 are deposited directly into the ballot box 18 within cart 16. In addition, the cart 16 preferably includes a compartment (not shown) that poll workers can use to temporarily store uncounted ballots in the event of a power failure, scanner error, or the like. Of course, the cart 16 may have other configurations as are well known to those skilled in the art.

Figure 12:
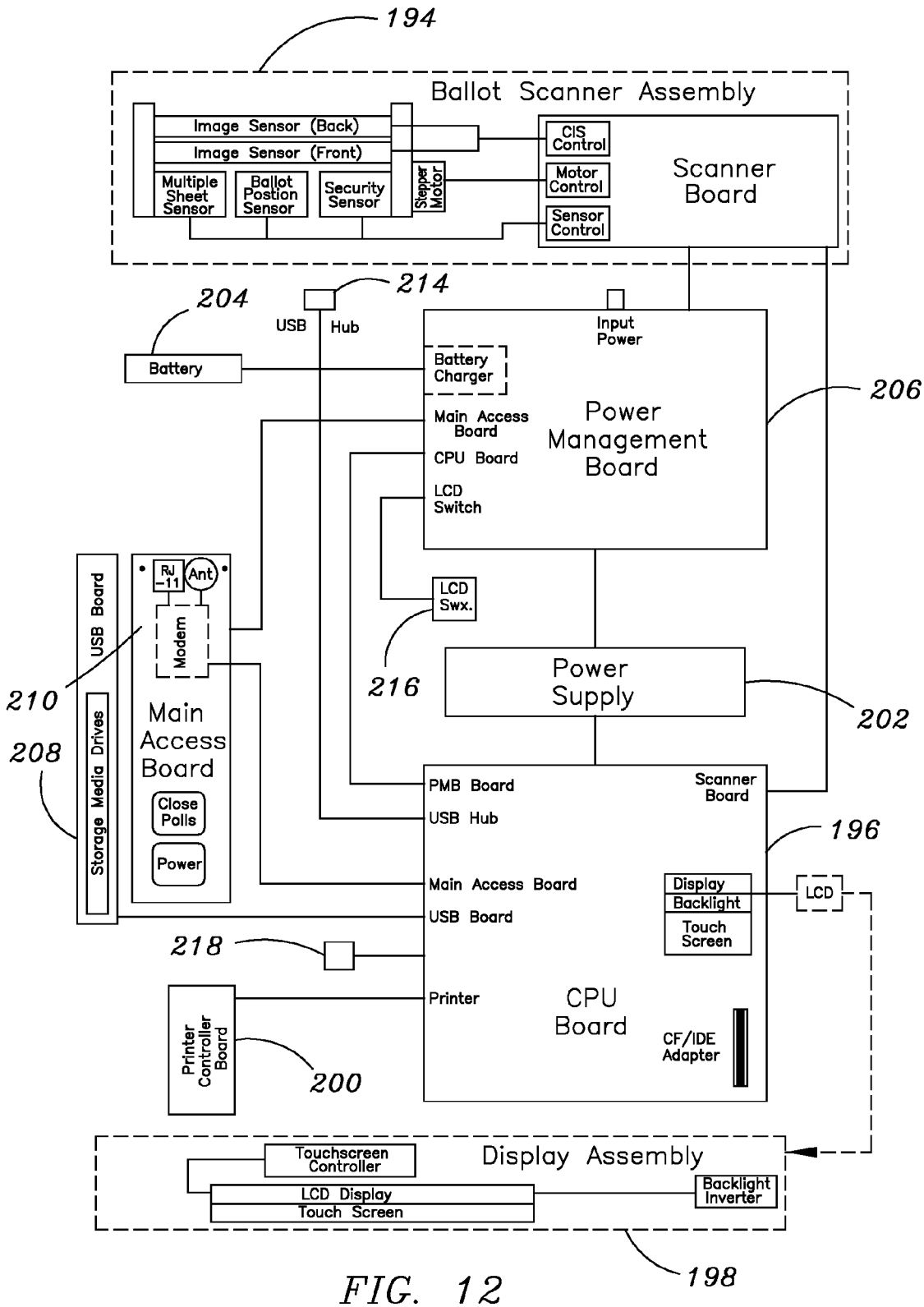
FIG. 12 is a diagram of the hardware of the tabulation device of FIG. 2.

Turning to FIG. 12, the internal components of tabulation device 14 are shown in a block diagram format and generally include: a ballot scanner assembly 194, a CPU board 196, a display assembly 198, a printer controller board 200, an internal power supply 202, an internal battery pack 204, a power management board 206, a USB board 208, a main access board 210, a USB hub 214, and an LCD switch 216 (discussed above). It should be understood that the various components and subsystems are connected to each other as shown in FIG. 12.

The ballot scanner assembly 194 includes a scanner board that provides the image capture, processing and transport control functions associated with scanning a paper ballot or activation card 20 (FIG. 5). The ballot scanner assembly 194 utilizes a set of sensors to monitor each paper ballot or activation card 20 as it is placed in the ballot insertion tray 188 of tabulation device 14 and travels through the ballot transport mechanism (not shown). These sensors detect the position of the ballot or activation card, check for multiple ballots or activation cards and confirm the release of the ballot or activation card into the ballot box 18. There may also be a security sensor that detects counterfeit ballots and ballots or activation cards that have been tampered with. The ballot scanner assembly 194 utilizes two contact image sensors to produce a bitmap image of the paper ballot or activation card (preferably at 200 dpi or greater). One contact image sensor is positioned to read the top surface of the ballot or activation card and the other contact image sensor is positioned to read the bottom surface of the ballot or activation card. The imaging of the top and bottom surfaces of the ballot or activation card preferably occurs simultaneously. The paper ballot or activation card is pulled across the contact image sensors to capture the ballot or activation card image. In this embodiment, the ballot scanner assembly 194 utilizes image capture technology available from Ricoh Electronics, Inc. It should be understood that other types of imaging devices may be used in ballot scanner assembly 194 for producing an image of the paper ballot or activation card 20 and transmitting that image to a processor of CPU board 196. The ballot or activation card image captured by the ballot scanner assembly 194 is passed to the processor of CPU board 196, which decodes and tabulates the voting selections marked on the scanned ballot or printed on the activation card 20 (described further below).

The CPU board 196 is a commercial off-the-shelf board that generally controls the operation of tabulation device 14. The CPU board 196 is preferably capable of executing at least two independent processes concurrently so that tabulation device 14 may concurrently accept, scan and tabulate paper ballots or activation cards and electronically receive voting selections from universal voting station 12 for tabulation. Accordingly, it is preferable to use an operating system that includes multi-tasking functionality, such as Linux and other operating systems known in the art. In this embodiment, the CPU board 196 is a VIA Embedded Platform EPIA-CL with a VIA C3™ or VIA Eden™ ESP processor. The CPU board 196 may include any type of memory that is suitable for storing information necessary for the operation of tabulation device 14, as is well known in the art.

Many of the other internal components of tabulation device 14 are also well known in the art. For example, the display assembly 198 includes an LCD display touch screen, a backlight inverter and a touch screen controller that provides an interface to display 190. The printer controller board 200 provides an interface to the report printer 192. In addition, the USB hub 214 provides a plurality of external USB ports that provide a connection for a variety of external devices.

The USB board 208 includes a plurality of external USB port interfaces that accommodate removable USB flash drives or any other type of removable data storage system or storage device. The storage device or removable USB flash drives may be used to store the election definition and the accumulated vote totals for tabulation device 14. Also, the storage device or removable USB flash drives may be used to store the images of the scanned ballots and activation cards 20, which may be accessed at a later time for audit purposes. The storage device or removable USB flash drives may further be used to store a back-up copy of an electronic audit log, which may be removed after the election for transport to election headquarters.

The main access board 210 includes a power switch and a "close polls" switch. The main access board 210 also includes a modem with an RJ-11 connector and antenna, which provide both landline and wireless modem options for transmitting vote results to a central vote accumulation site.

The tabulation device 14 is powered by a power management subsystem that includes the power management board 206, an internal battery pack 204, and an internal ITX power supply 202. The power management board 206 is a custom power supply board which receives its input from an external brick power supply that operates on standard AC-volt lines. The internal battery pack 204 (preferably a re-chargeable Lithium-Ion type) provides up to two hours of operation during a loss of AC power. The internal ITX power supply 202 provides power to the CPU board 196, as is known in the art. The power management board 206 monitors the status of and charges the internal battery pack 204, and automatically switches from the external brick power supply to the internal battery pack 204 as needed.

Ethernet port 218 is connected to the Ethernet port 44 of universal voting station 12, shown in FIG. 10A, with an Ethernet cable (not shown) when the universal voting station 12 and tabulation device 14 are tethered as shown in FIGS. 1 and 2. This connection permits universal voting station 12 to electronically transmit voting selections and activation card images to tabulation device 14 for storage and tabulation.

Cart 16 provides a convenient base on which universal voting station 12 and tabulation device 14 are mounted in a back-to-back manner. Universal voting station 12 and tabulation device 14 may preferably be locked to cart 16. Cart 16 includes wheels so that it may be easily moved around an election site. Ballot box 18 is positioned within an internal compartment of cart 16 beneath universal voting station 12 and tabulation device 14 where the ballot box 18 is accessible via a lockable door 220 (FIG. 2). Cart 16 may include other compartments accessible via lockable doors for receiving and storing provisional ballots and/or spoiled ballots. Cart 16 preferably has a height that permits physically disabled voters to access and utilize the universal voting station 12 to make his/her voting selections. Ballot box 18 has a lid 222 that is preferably lockable for securely storing marked paper ballots and activation cards 20 within the box 18. The lid 222 is moved to an open position when the ballot box 18 is positioned within cart 16 so that box 18 may receive paper ballots and activation cards 20 that exit universal voting station 12 or tabulation device 14 and drop through an opening (not shown) in the top of cart 16. Ballot box 18 may be removed from cart 16 after an election is over for transport to a central election office. Lid 222 is preferably moved to a closed position and locked before ballot box 18 is transported. Ballot box 18 may include separate compartments, one for receiving activation cards from universal voting station 12 and one for receiving paper ballots and activation cards from tabulation device 14. In an alternative embodiment, the voting system 10 may include two ballot boxes, one for receiving activation cards from universal voting station 12 and one for receiving paper ballots and activation cards from tabulation device 14.

Voting system 10 preferably includes a number of tamper evident seals (not shown) to protect sensitive areas of the system 10. For instance, tamper evident security label seals are preferably adhered over the locks for front access door 26 (FIG. 1), paper path access door 34 (FIG. 1), security compartment door 36 (FIG. 7A), rear access door 38 (FIG. 7B), door 220 (FIG. 2), and any other desirable location. Voting system 10 preferably includes a form-fitting security cover (not shown) that covers and protects universal voting station 12 and tabulation device 14 when not in use. Tamper evident wire seals (not shown) are preferably received by grommets in the security cover and openings in cart 16 when the security cover is in place. Wire seals are also preferably received by openings in the cart 16 and tabulation device 14 to detect tampering with the tabulation device 14. A tamper evident pull-up seal is also preferably received by openings in door 220 (FIG. 2) and cart 16 to detect tampering with door 220. USB flash drive 127*a* (FIG. 10A) containing the election definition is preferably wired to USB port 122*a* for detecting tampering with the flash drive 127*a*.

Exemplary Operation of Voting System

Voting system 10 has two modes of operation: (1) a tethered mode in which universal voting station 12 is connected to tabulation device 14; and (2) a standalone mode in which universal voting station 12 operates on its own without any connection to tabulation device 14. Each of these modes of operation will be described in detail below.

Tethered Mode

Figure 13A:
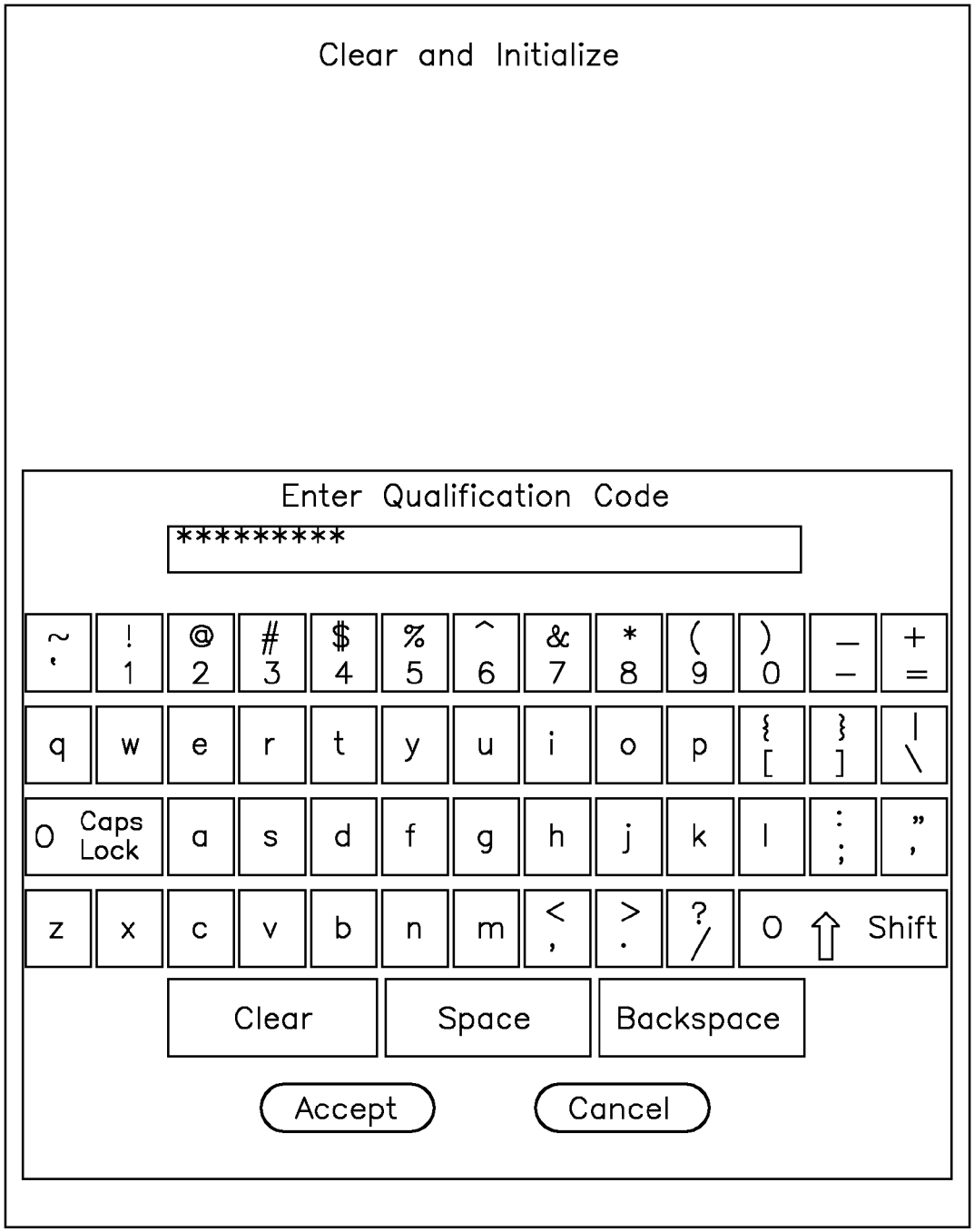

An exemplary operation of voting system 10 in the tethered mode will now be described. First, universal voting station 12 is powered on and a flash drive containing an election qualification code ("EQC") is inserted into one of the USB ports 122*a-c* of universal voting station 12. Upon insertion of the flash drive with the EQC, display 24 shows the "Clear and Initialize" screen shown in FIG. 13A, which prompts an operator to enter a Qualification Code. If the operator enters the correct qualification code, display 24 shows the screen shown in FIG. 13B, which requests the operator to confirm that he/she wishes to continue the "Clear and Initialize" process. If the operator chooses "Continue," universal voting station 12 clears the previous election's hash files, public key, date, and name from EEPROM 152 and the new election's hash files, public key, date and name on the flash drive are sent to and stored on EEPROM 152. When this process is complete, display 24 shows the screen shown in FIG. 13C, which instructs the operator to remove the inserted media device.

Figure 13D:
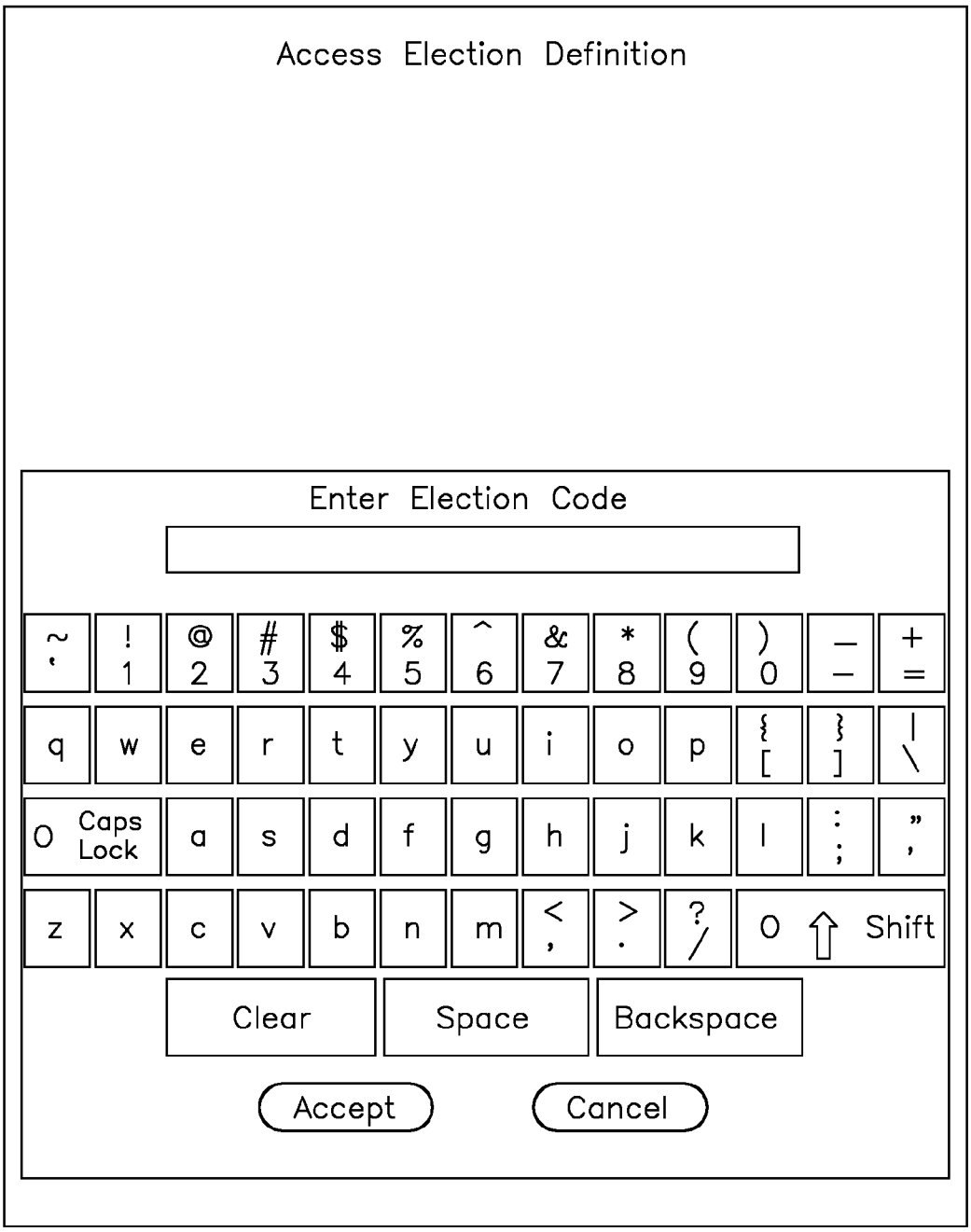

The operator then inserts a flash drive containing the election definition into one of the USB ports 122*a-c* of universal voting station 12. Universal voting station 12 conducts a validity test to ensure that the election definition matches the EQC previously loaded into EEPROM 152. When universal voting station 12 is tethered to tabulation device 14, universal voting station 12 also uses the EQC code to check the validity of tabulation device 14. If the election definition matches the EQC, display 24 shows the screen shown in FIG. 13D, which prompts the operator to enter an "Election Code." If the correct Election Code is entered, display 24 shows the screen shown in FIG. 13E, which prompts the operator to continue the "Access Election" process. If the operator chooses "Continue," the election definition on the flash drive is decrypted and most of the decrypted data is stored in universal voting station 12 for quick access during voting sessions. The election definition contains information on all of the candidates, contests, and card variations that universal voting station 12 processes at the polling place. The flash drive containing the election definition is left in the USB port of universal voting station 12 throughout the election. All significant operational events that occur on universal voting station 12 are stored on the flash drive containing the election definition. Once the election definition is loaded, display 24 shows the screen shown in FIG. 13F.

Next, tabulation device 14 is powered on and the EQC and election definition are loaded into tabulation device 14 in a similar manner as described above with respect to universal voting station 12. Of course, the transfer of the EQC and election definition to universal voting station 12 and tabulation device 14 may be effectuated by a variety of different means other than insertion of a flash drive into a USB port, as is known in the art.

After universal voting station 12 and tabulation device 14 are powered on and receive the election definition, universal voting station 12 is ready to assist voters in making their voting selections. In order to use universal voting station 12, a voter is first given an activation card 20 (FIG. 5) that contains activation barcode 104, verification digits 106 and ballot header text 108. The activation barcode 104, verification digits 106 and ballot header text 108 may be preprinted on the activation card 20 prior to the election, or alternatively, a poll worker may insert a blank activation card 20 into an external printer (not shown) at the voting site in order to print the activation barcode 104, verification digits 106 and ballot header text 108 on the activation card 20.

Figure 14A:
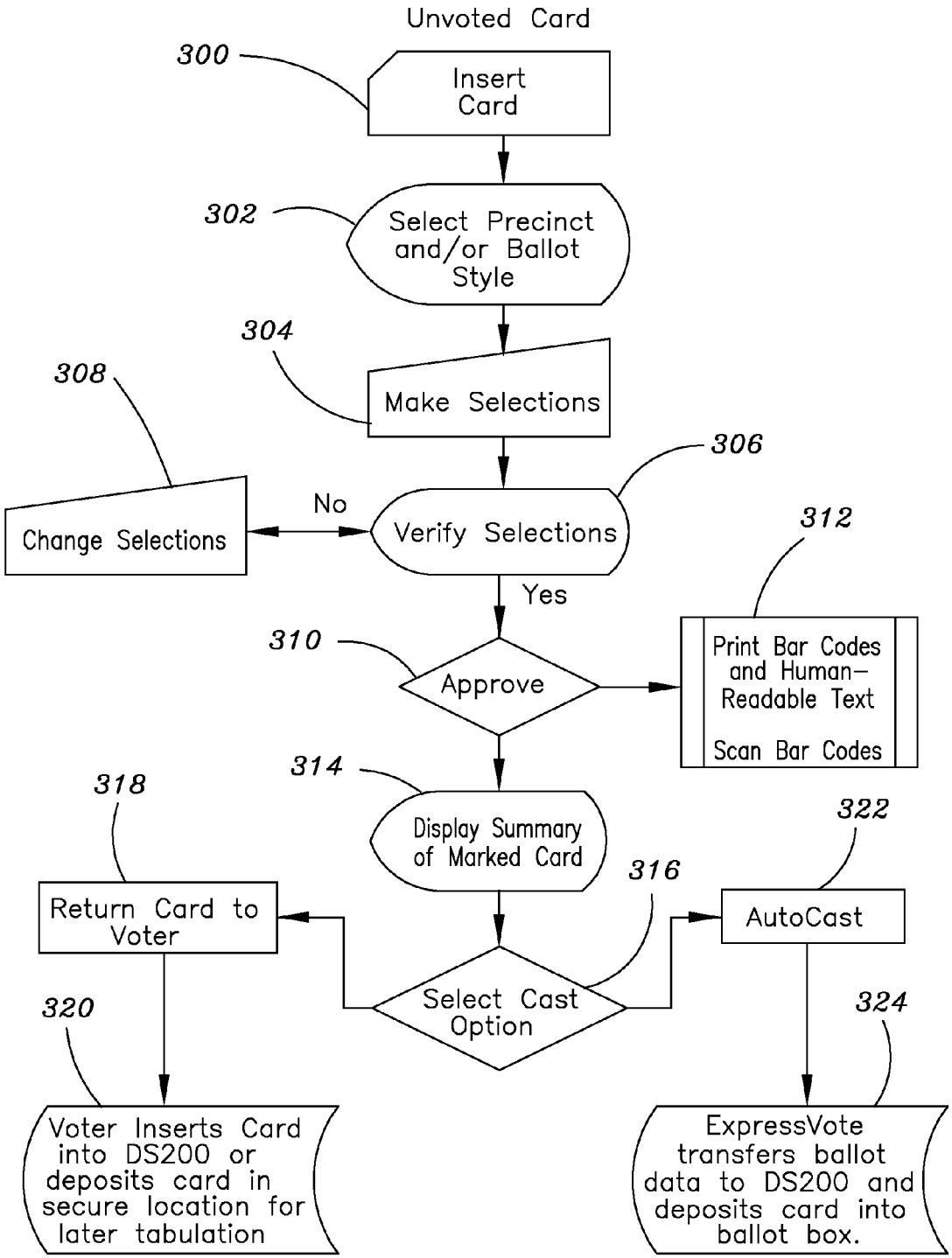
FIG. 14A is a flow chart of a process for voting using the voting station of FIG. 1.
Figure 15A:
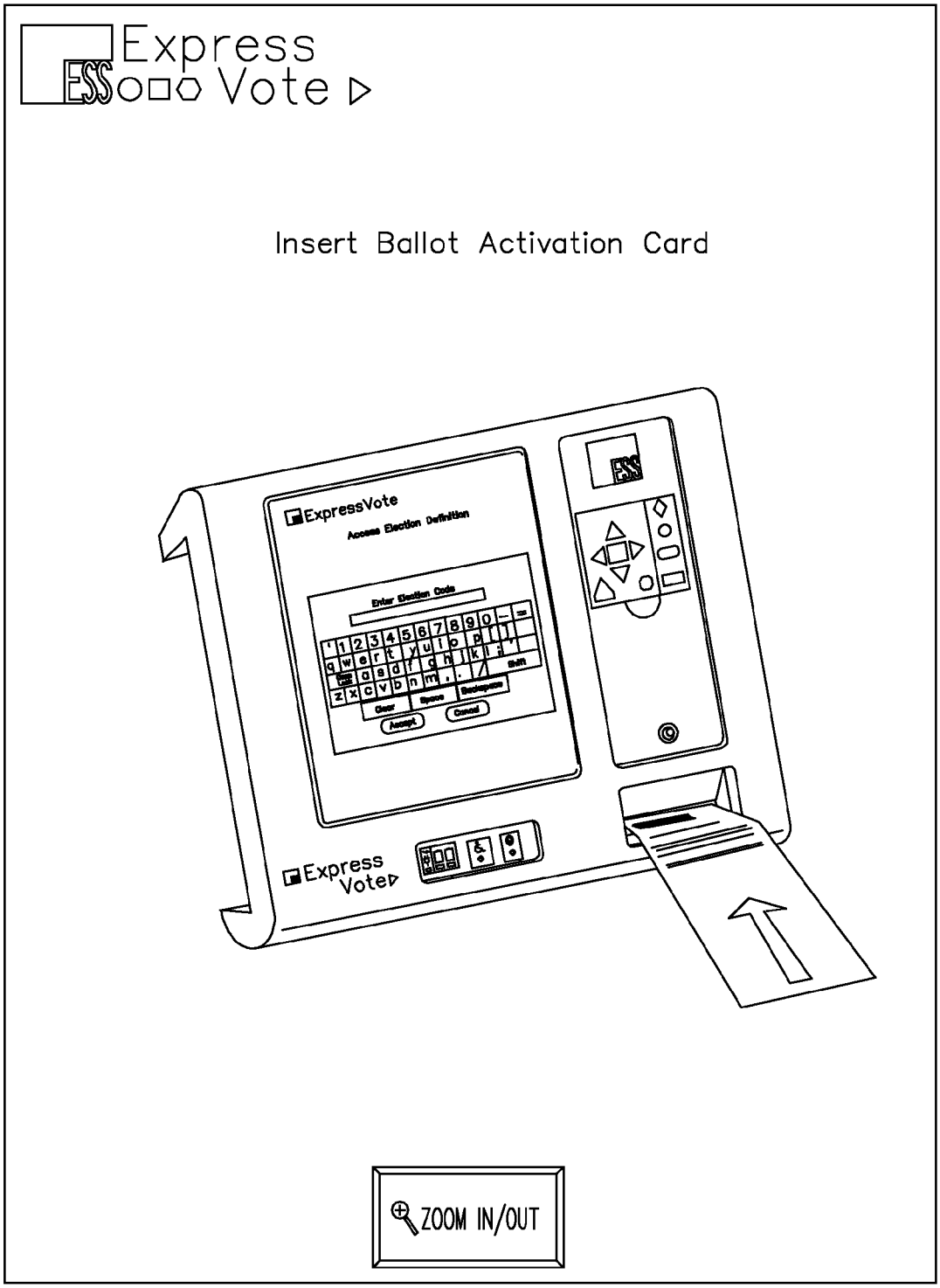
FIGS. 15A-I are screen shots of the display of the voting station of FIG. 1 during the voting process.

The voter takes the activation card 20 to universal voting station 12, which displays the "Insert Ballot Activation Card" screen shown in FIG. 15A. This screen displays the correct orientation for inserting activation card 20 into the activation card opening 32 of universal voting station 12, which is with the text facing up and the chamfer 102 to the right. Referring to FIG. 14A, the voter then inserts the activation card 20 into universal voting station 12 at step 300. Paper path module 46 scans the activation card 20 to ensure that it was inserted with the correct orientation. If it was not inserted correctly, the activation card 20 is ejected and the voter is prompted to re-insert the card 20. If it was inserted correctly, paper path module 46 scans the activation card 20 to ensure that it is the correct length. If the card 20 is not the correct length, it is ejected and the voter is prompted to ask a poll worker for a replacement. If the card 20 is the correct length, paper path module 46 positions the card 20 as shown in FIG. 9D and scanner 74 scans the activation card 20 to produce an image of the activation card 20. Scanner 74 transmits the image of activation card 20 to the processor of single board computer 118. The processor decodes the activation barcode 104, and compares the decoded activation barcode 104 to the election definition to determine whether the activation card 20 is valid. If the activation card 20 is valid, the processor identifies an applicable ballot style, and its associated election contests, for the activation card 20 from the election definition. If the activation card 20 is not valid, it is ejected. The process then moves to step 304 (FIG. 14A) at which the voter begins making voting selections.

Figure 18A:
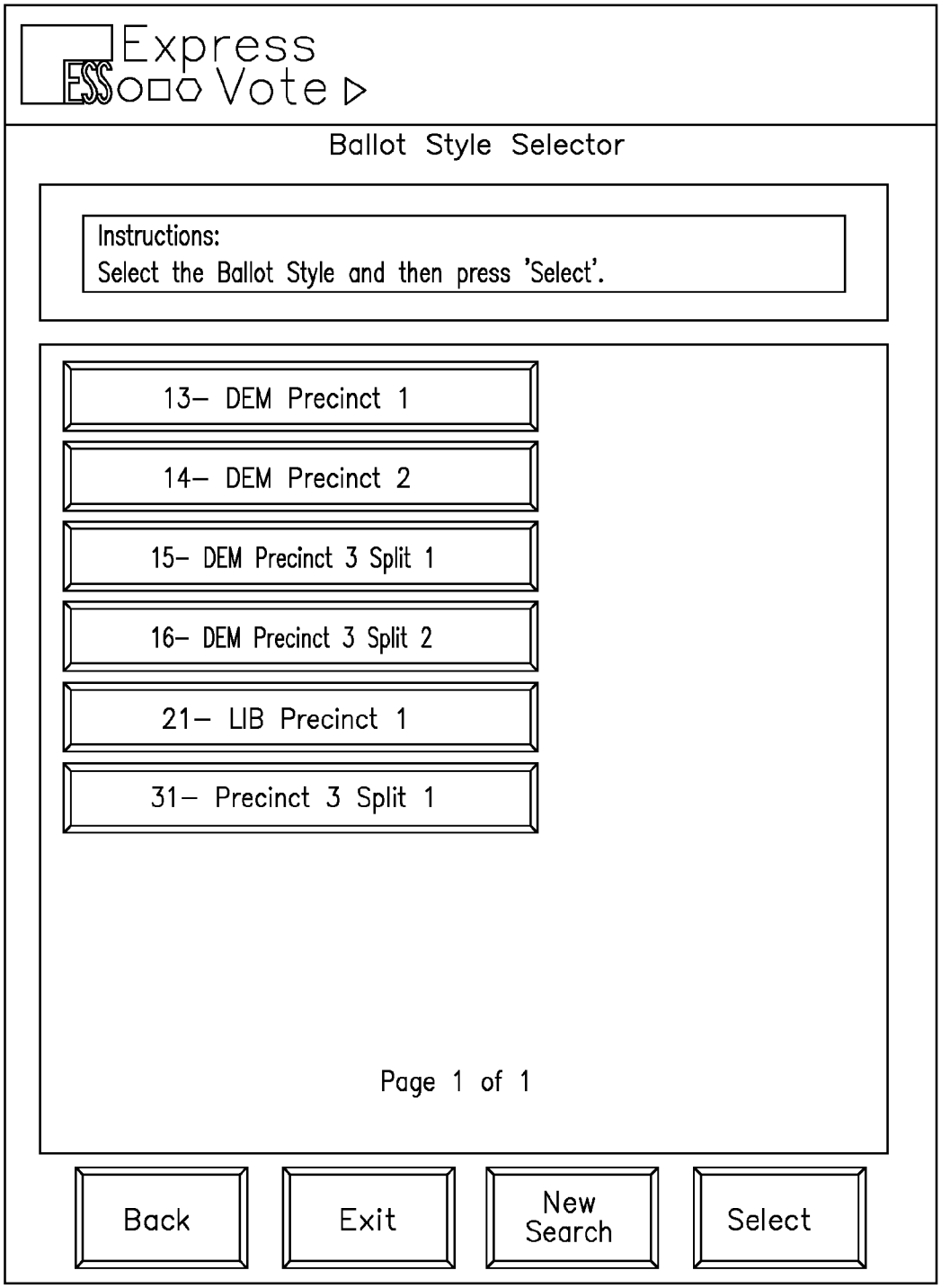
FIGS. 18A-C are screen shots of the display of the voting station of FIG. 1 when choosing a ballot style.
Figure 18B:
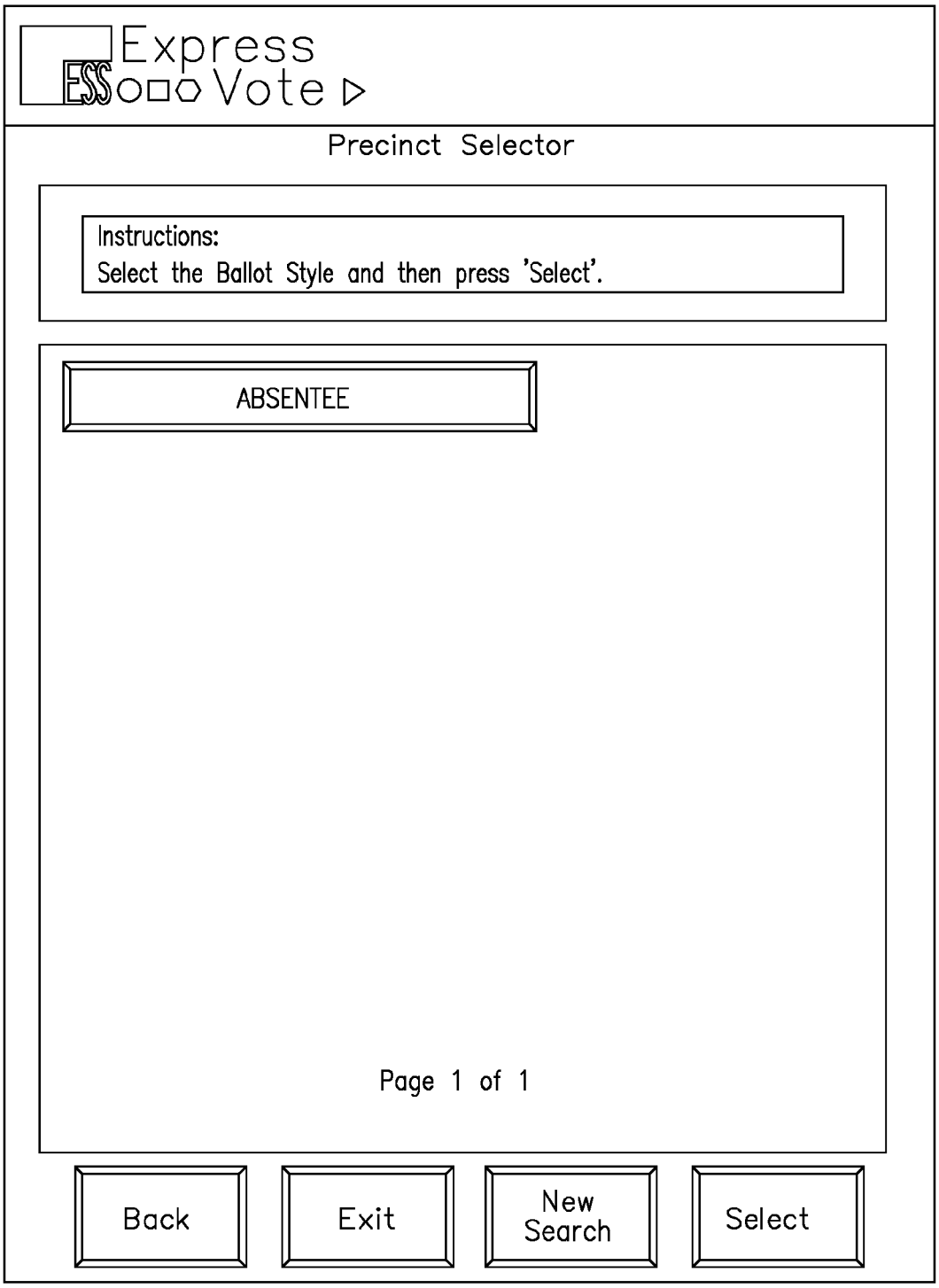
Figure 18C:
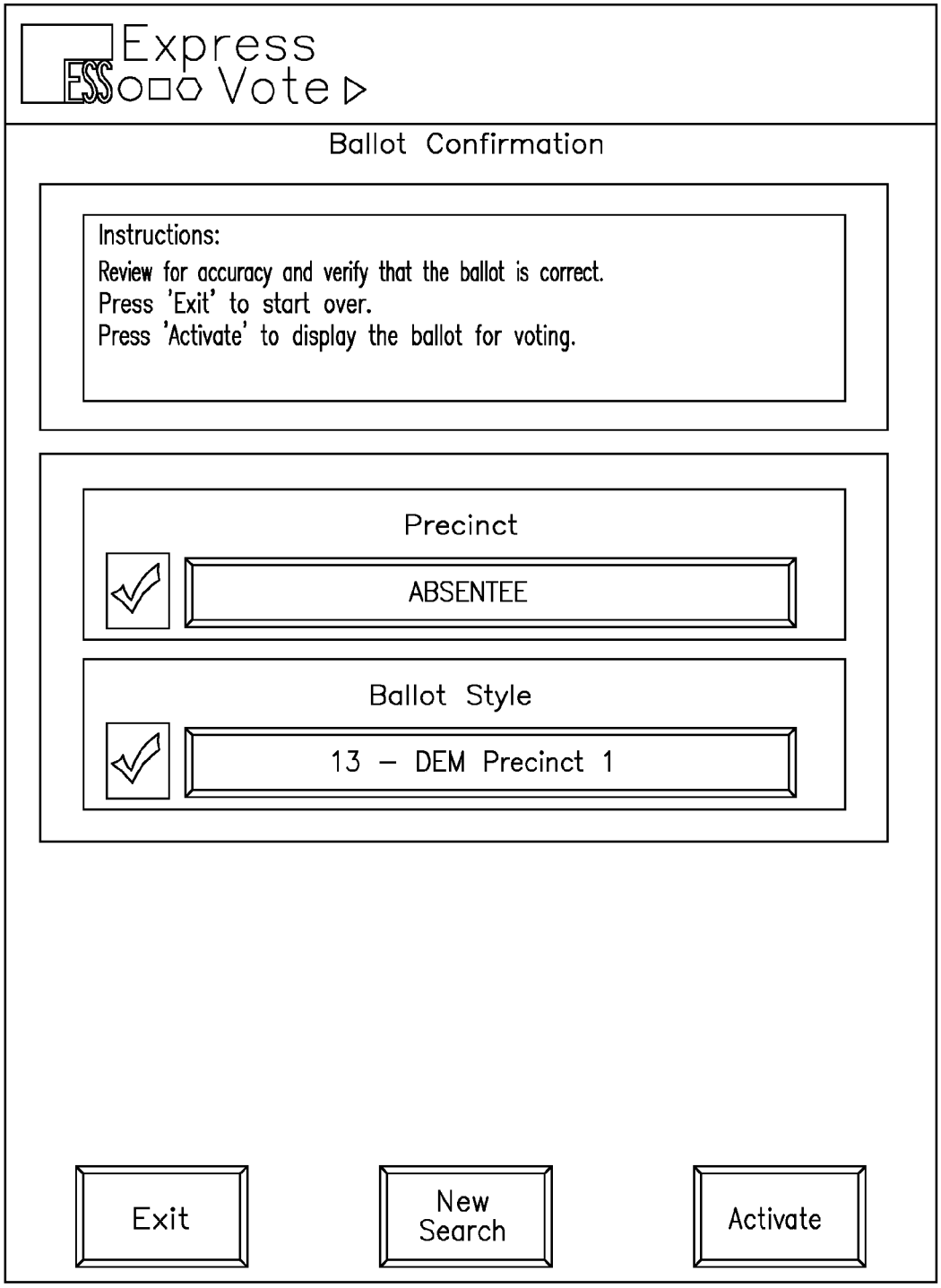

Alternatively, if an activation card 20 is inserted into activation card opening 32 that does not have an activation barcode 104, the process moves to step 302 (FIG. 14A). At this step, after the card 20 is correctly inserted into the activation card opening 32, universal voting station 12 detects that the activation card 20 is blank and displays the "Ballot Style Selector" screen shown in FIG. 18A. A poll worker or the voter chooses the correct ballot style and selects the "Select" button. Universal voting station 12 then displays the "Precinct Selector" screen shown in FIG. 18B. A poll worker or the voter chooses the correct precinct and selects the "Select" button. After the ballot style and precinct have been selected, the "Ballot Confirmation" screen shown in FIG. 18C is displayed. If the correct precinct and ballot style have been selected, the "Activate" button is selected. If the correct precinct and ballot style have not been selected, the poll worker or voter selects either "Exit," or "New Search" to begin a new search for an applicable ballot style and precinct. Alternatively, the "Precinct Selector" screen in FIG. 18B may appear before the "Ballot Style Selector" screen shown in FIG. 18A. Printer 72 preferably prints an activation barcode 104 on activation card 20 that corresponds with the selected ballot style and precinct. The process then moves to step 304 (FIG. 14A).

Figure 15B:
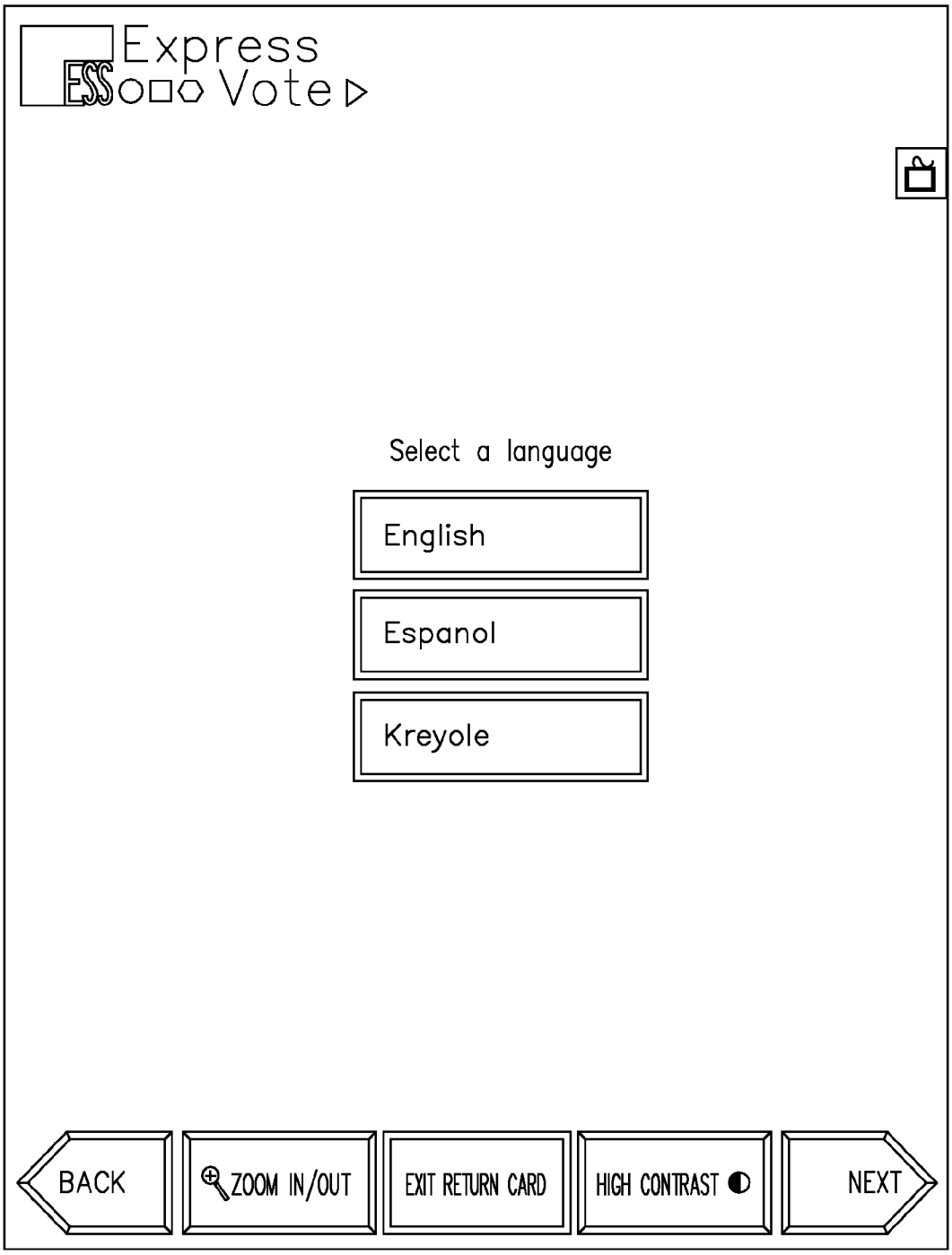
Figure 15C:
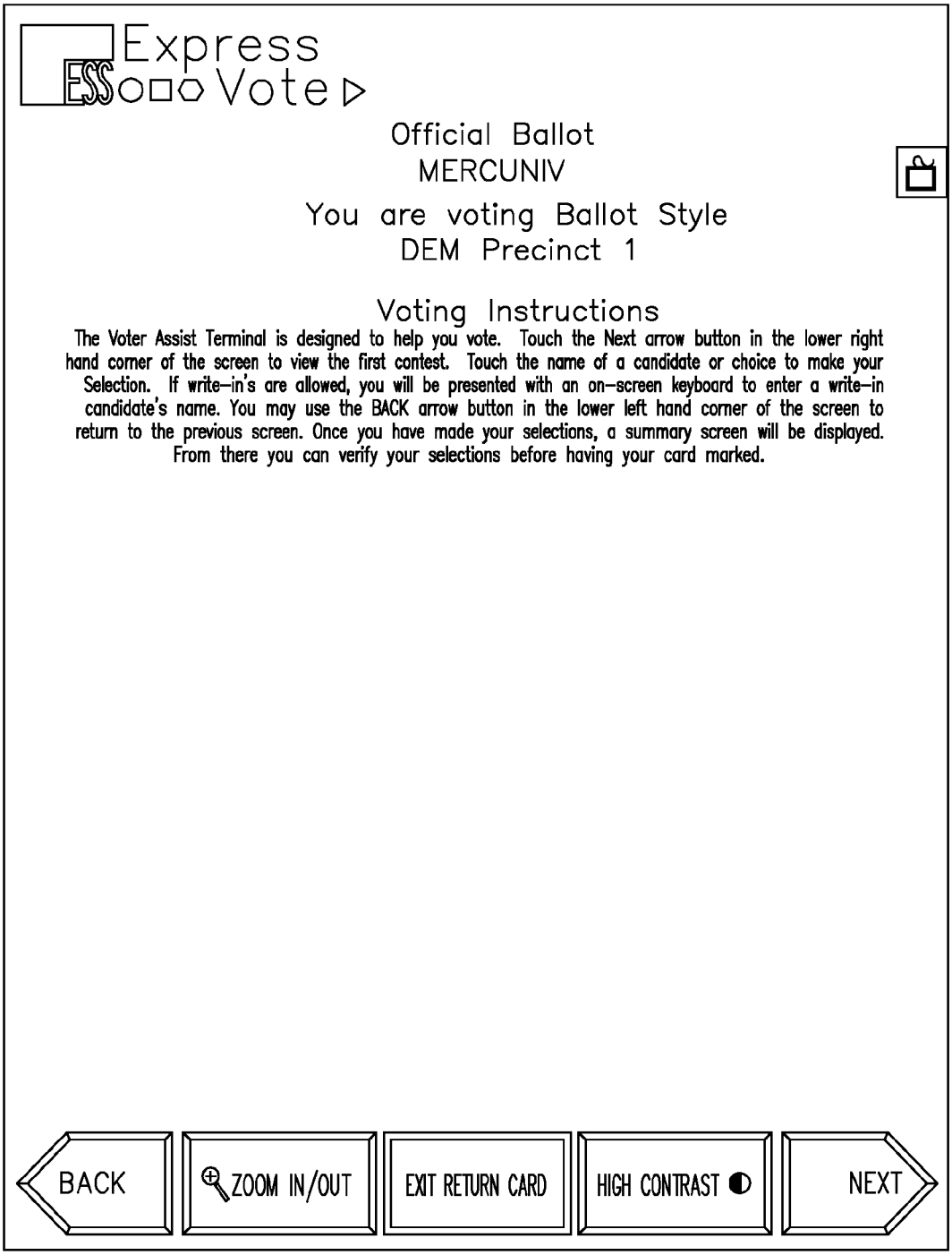

At step 304, universal voting station 12 displays the "Select a language" screen shown in FIG. 15B, which displays a list of different languages authorized by the particular jurisdiction in which the election is held. The voter chooses a language by either touching the appropriate box on display 24, using the arrow and select buttons 48*a-e* on keypad 28 (FIG. 8), or using a dual switch access device connected to dual switch access port 68 (FIG. 4) as is known in the art. After a language is selected, that language is used for text on display 24 and the audio track outputted to headphones connected to audio port 70. When the proper language is selected, the voter selects the "Next" button to advance to the "Voting Instructions" screen shown in FIG. 15C. This screen displays the ballot style and instructions to assist the voter in making his/her voting selections. The voter then selects the "Next" button to advance to the screen shown in FIG. 15D.

Figure 15D:
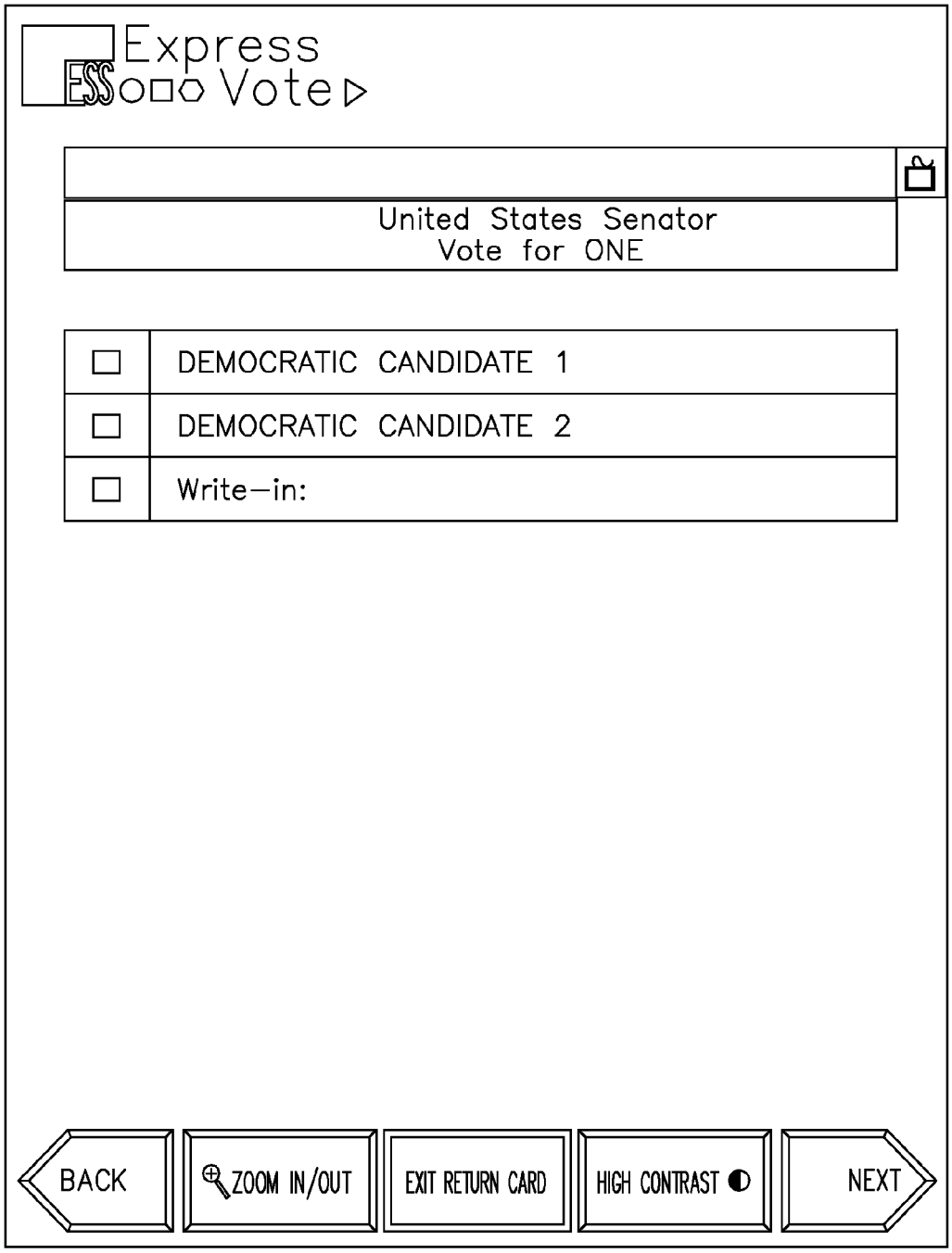
Figure 15E:
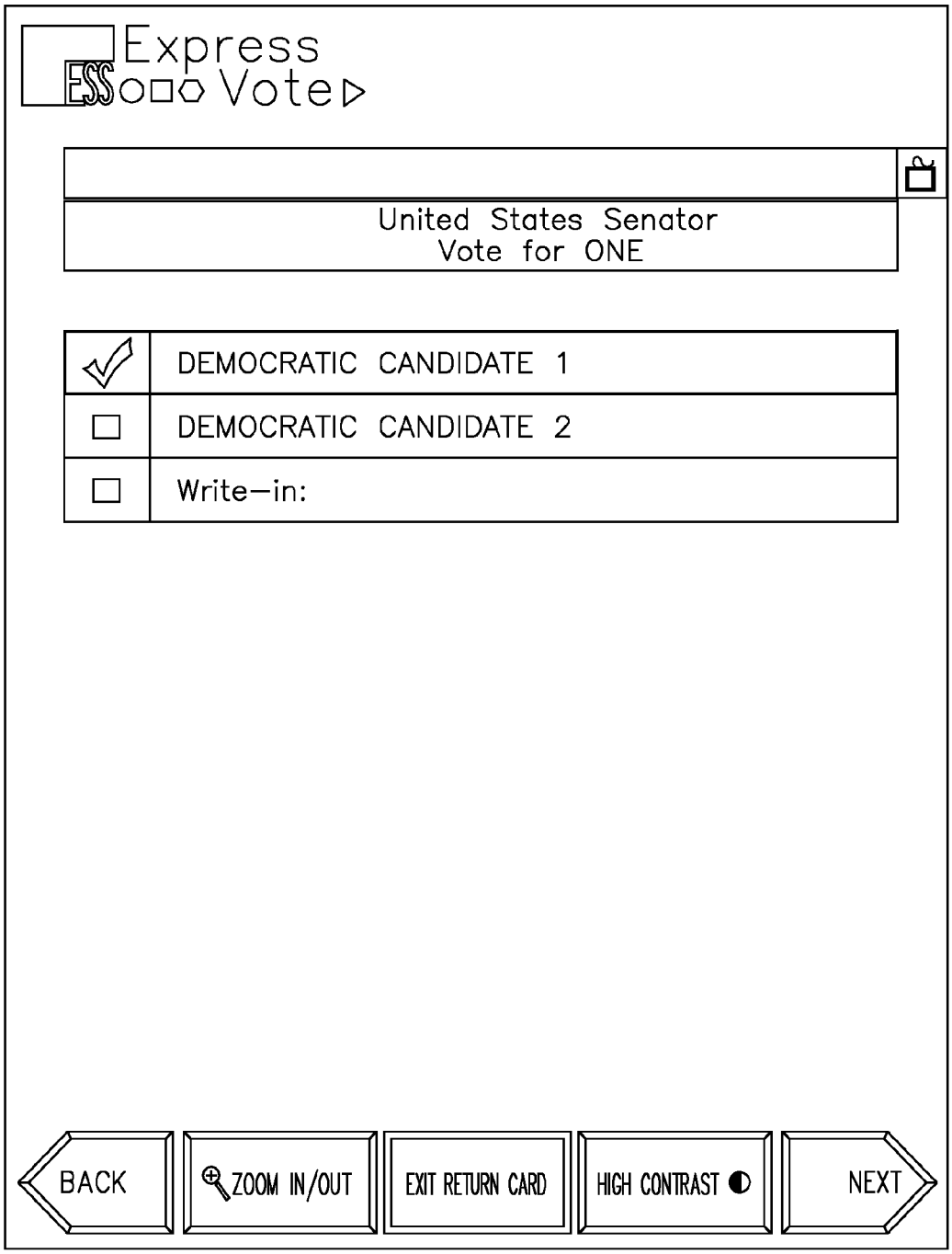
Figure 16A:
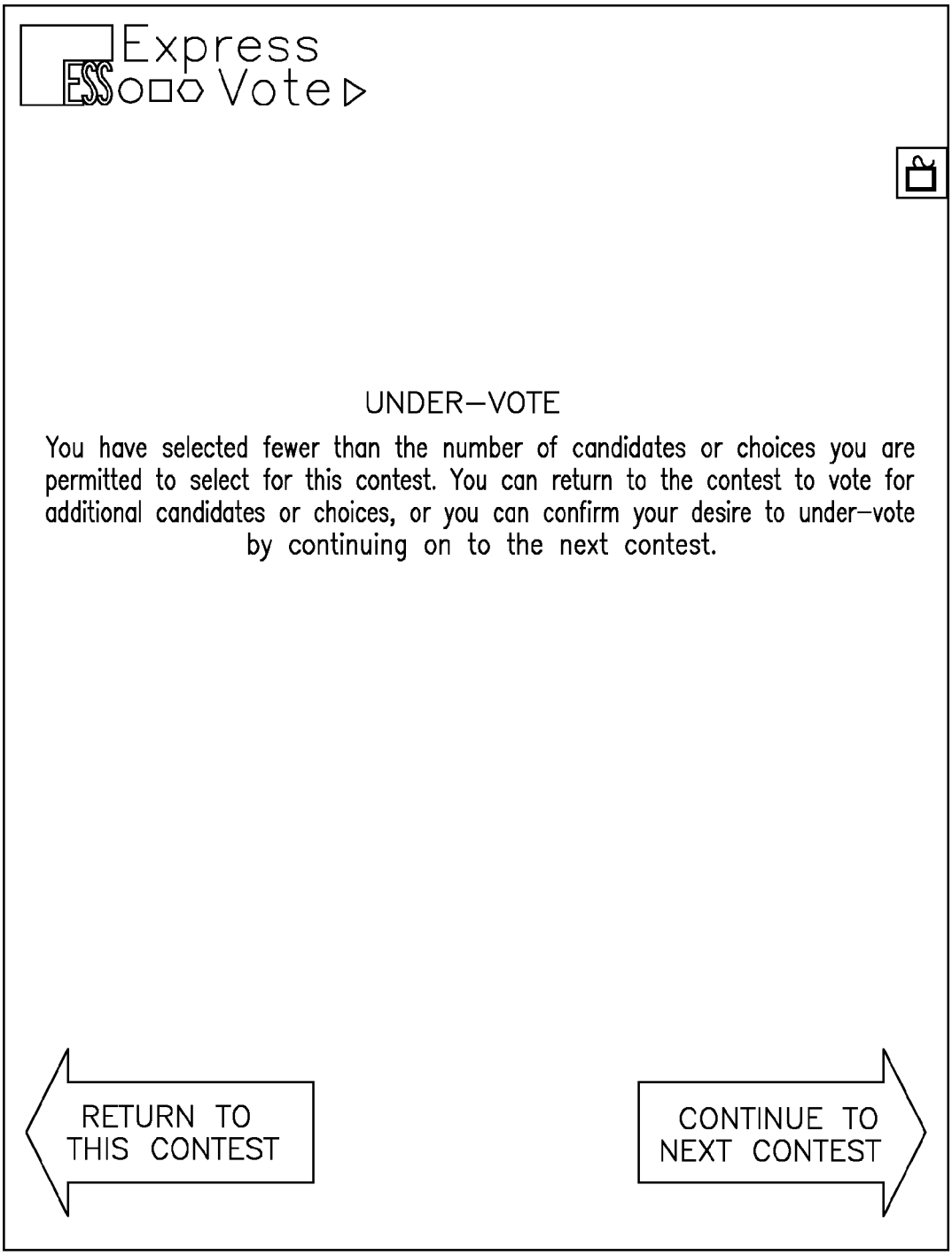
FIGS. 16A-C are screen shots of the display of the voting station of FIG. 1 when a contest has been undervoted.
Figure 17:
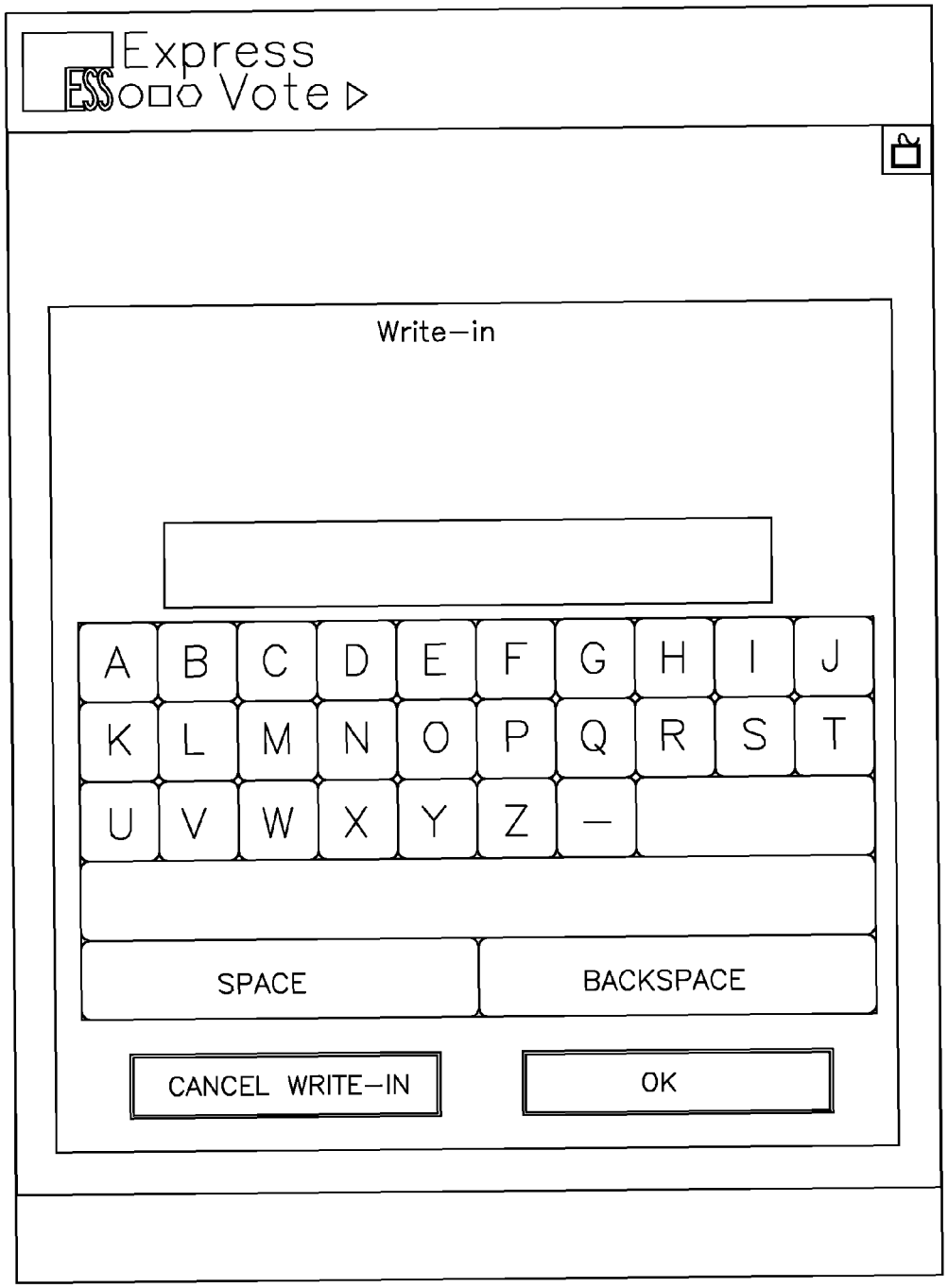
FIG. 17 is a screen shot of the display of the voting station of FIG. 1 when entering a write-in candidate for a contest.

FIG. 15D shows a screen shot of an election contest displayed to a voter on display 24, which includes the title of the contest (i.e., "United States Senator"), instructions regarding the particular contest (i.e., "Vote for ONE"), two candidates to choose from (i.e., "DEMOCRATIC CANDIDATE 1" and "DEMOCRATIC CANDIDATE 2"), and a "Write-In" option. The voter makes his/her voting selection for the contest by selecting either of the candidates or the "Write-In" option. If the voter selects one of the candidates, then display 24 shows the screen shown in FIG. 15E, which displays a checkmark next to the selected candidate. If the voter selects the "Write-In" option, then the screen shown in FIG. 17 is displayed. The voter may select the letters on screen to type a write-in candidate's name for the particular contest, and then choose the "OK" button. The voter may cancel the write-in option by choosing the "CANCEL WRITE-IN" button. Once the voter has made his/her voting selection by choosing a displayed candidate or the "Write-In" option, the voter selects the "Next" button to advance to the next election contest. The voter makes his/her voting selections for each of the election contests in the manner described above. If the voter selects the "Next" button without making a voting selection for a contest, display 24 shows the "Under-Vote" screen shown in FIG. 16A. This screen gives the voter the option of either returning to the contest to make a voting selection or advancing to the next contest.

Figure 14B:
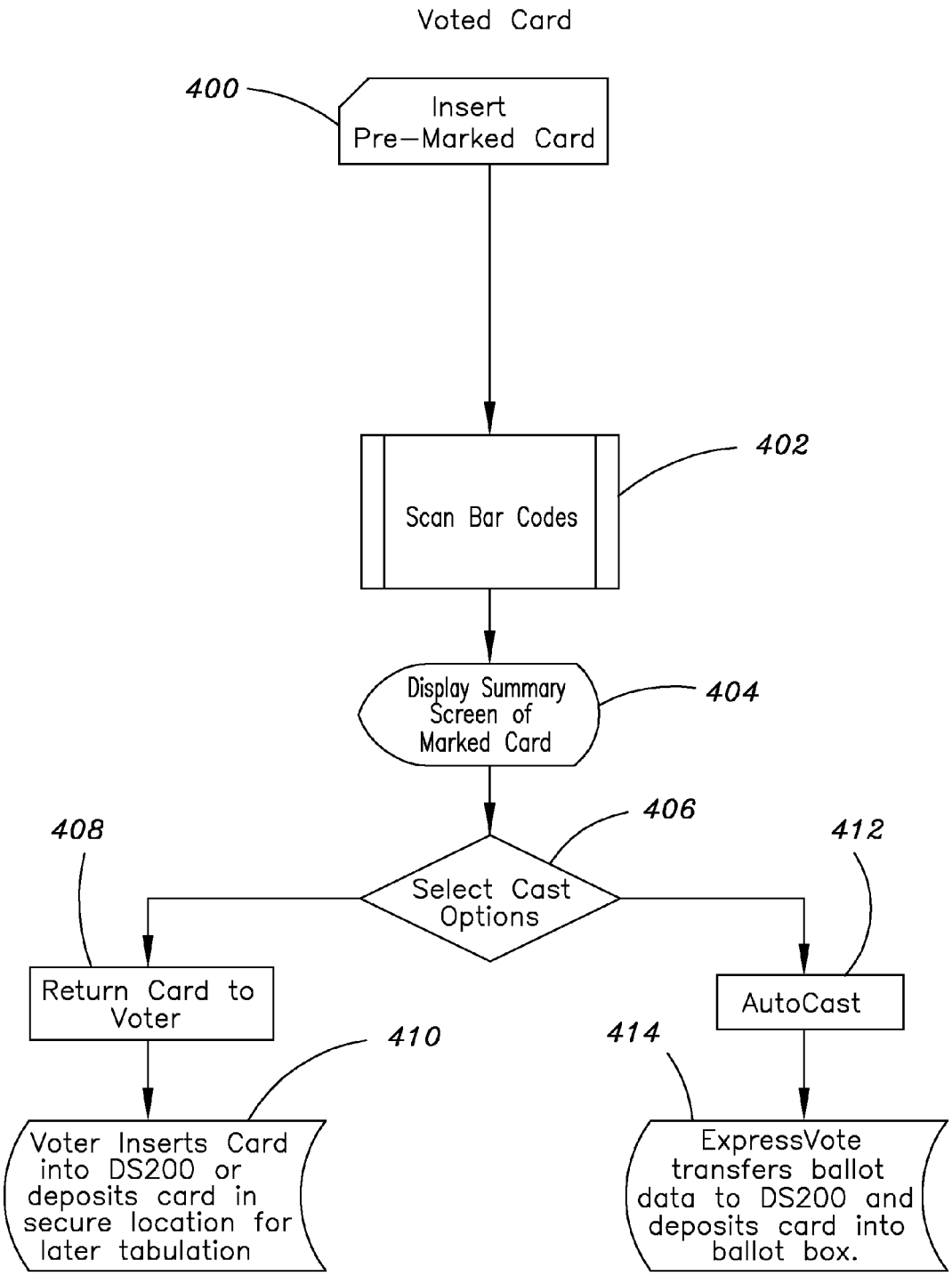
FIG. 14B is a flow chart of a process for scanning an activation card with a vote record printed thereon using the voting station of FIG. 1.
Figure 15F:
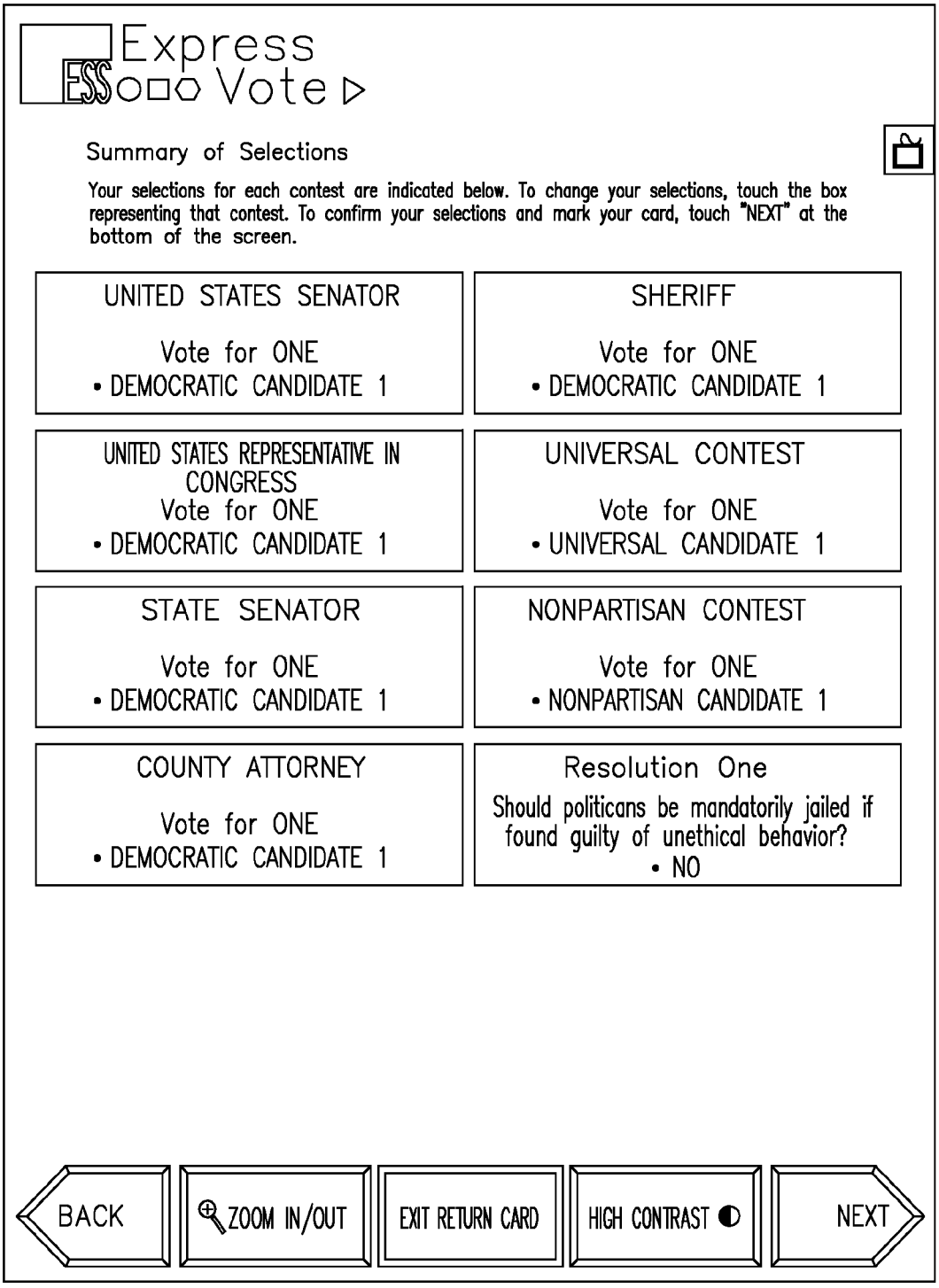

After the voter makes a voting selection for the last election contest, the process moves to step 306 (FIG. 14A) at which universal voting station 12 displays the "Summary of Selections" screen shown in FIG. 15F. This screen displays each of the election contests and the corresponding voting selections made by the voter. If the voter wants to change any of the voting selections, he/she can touch the box on the display 24 associated with the election contest to advance to step 308 (FIG. 14). If the voter does not want to change any voting selections, the voter selects the "Next" button at the bottom of the screen to advance to the "Mark Card" screen shown in FIG. 15G. If the voter did not make a voting selection for a particular contest, display 24 shows a "Summary of Selections" screen such as the one shown in FIG. 16B, on which the "Sheriff" contest is identified as a contest for which no selection was made. The "Sheriff" contest is preferably highlighted in a different color than the remainder of the contests so that the voter can easily determine that he/she did not choose a selection for that particular contest. If a voter selects the "Sheriff" contest, he/she can make a voting selection for the contest. After a voting selection is made for that contest, display 24 shows the "Summary of Selections" screen shown in FIG. 16C, which shows that a selection has been made for that contest. Selecting the "Next" button advances to the "Mark Card" screen shown in FIG. 15G.

Figure 15G:
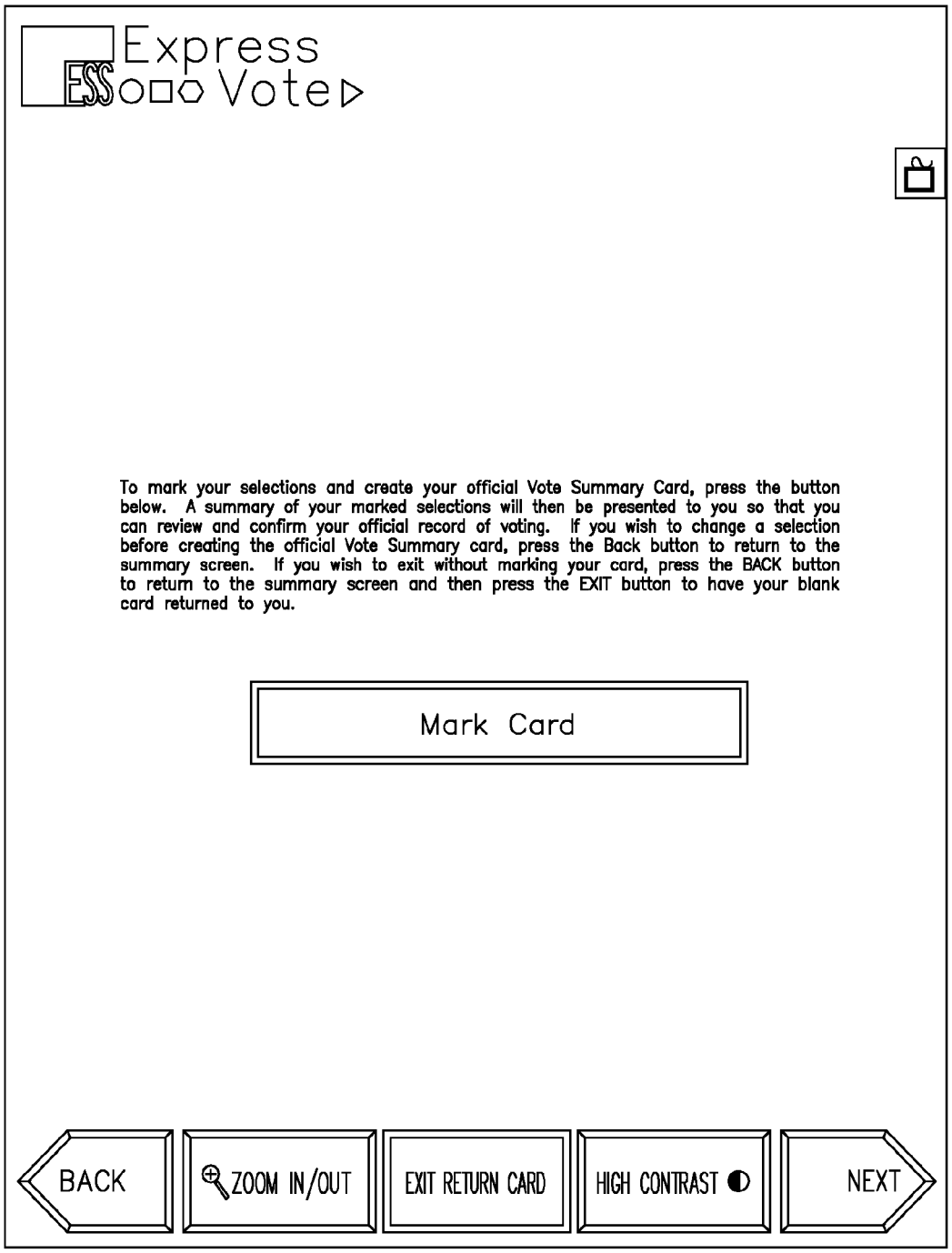
Figure 15H:
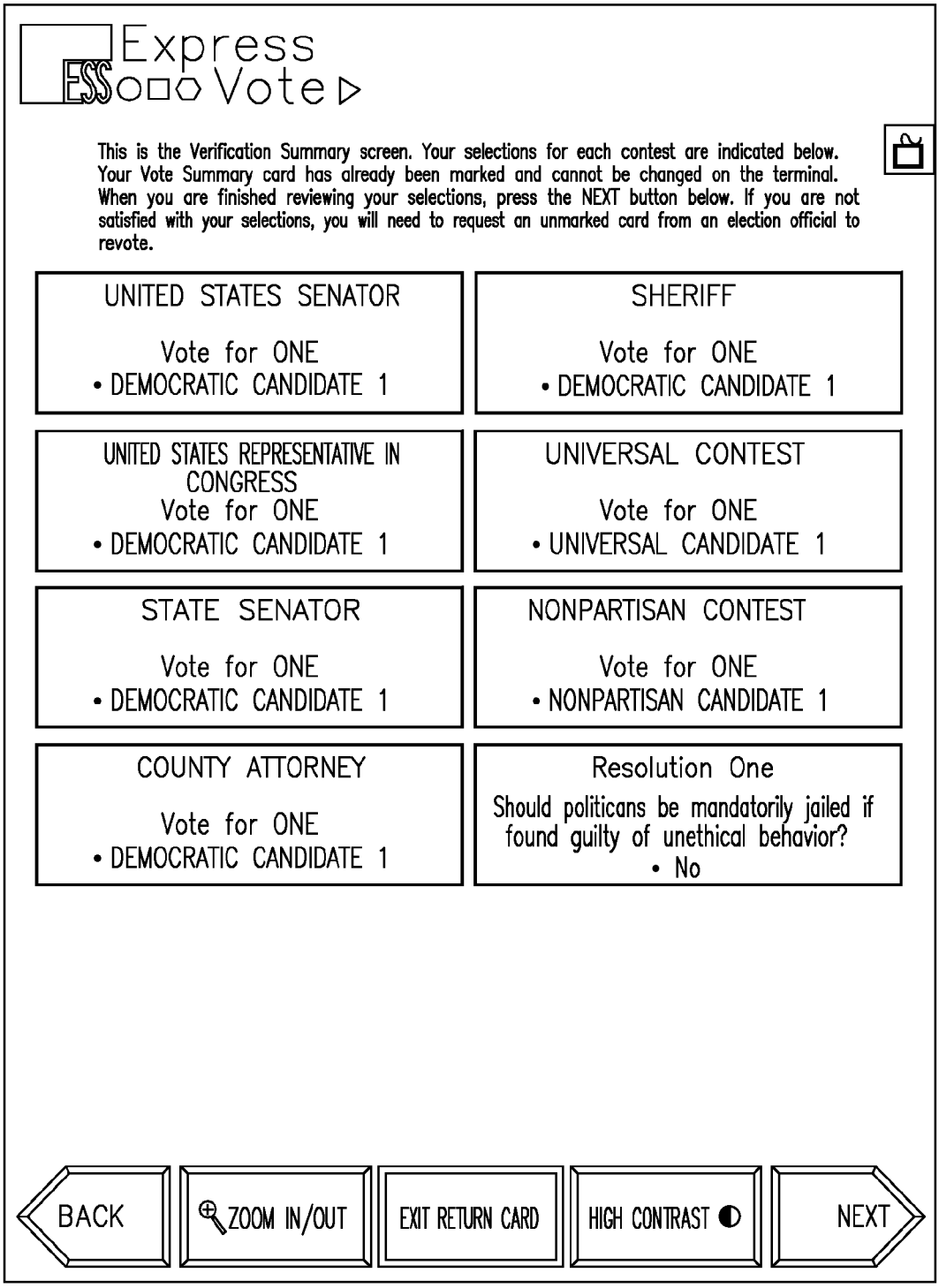
Figure 16B:
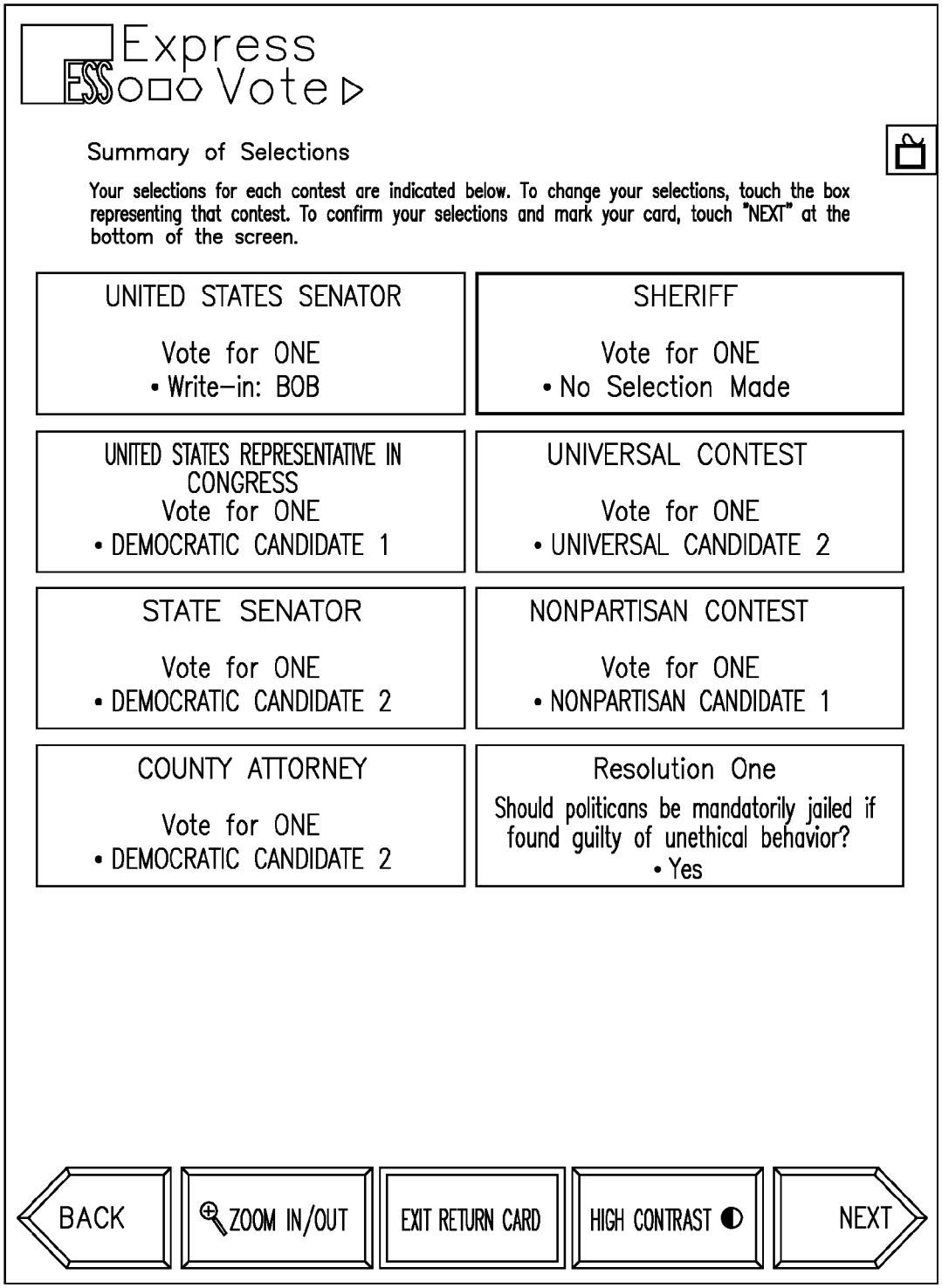
Figure 16C:
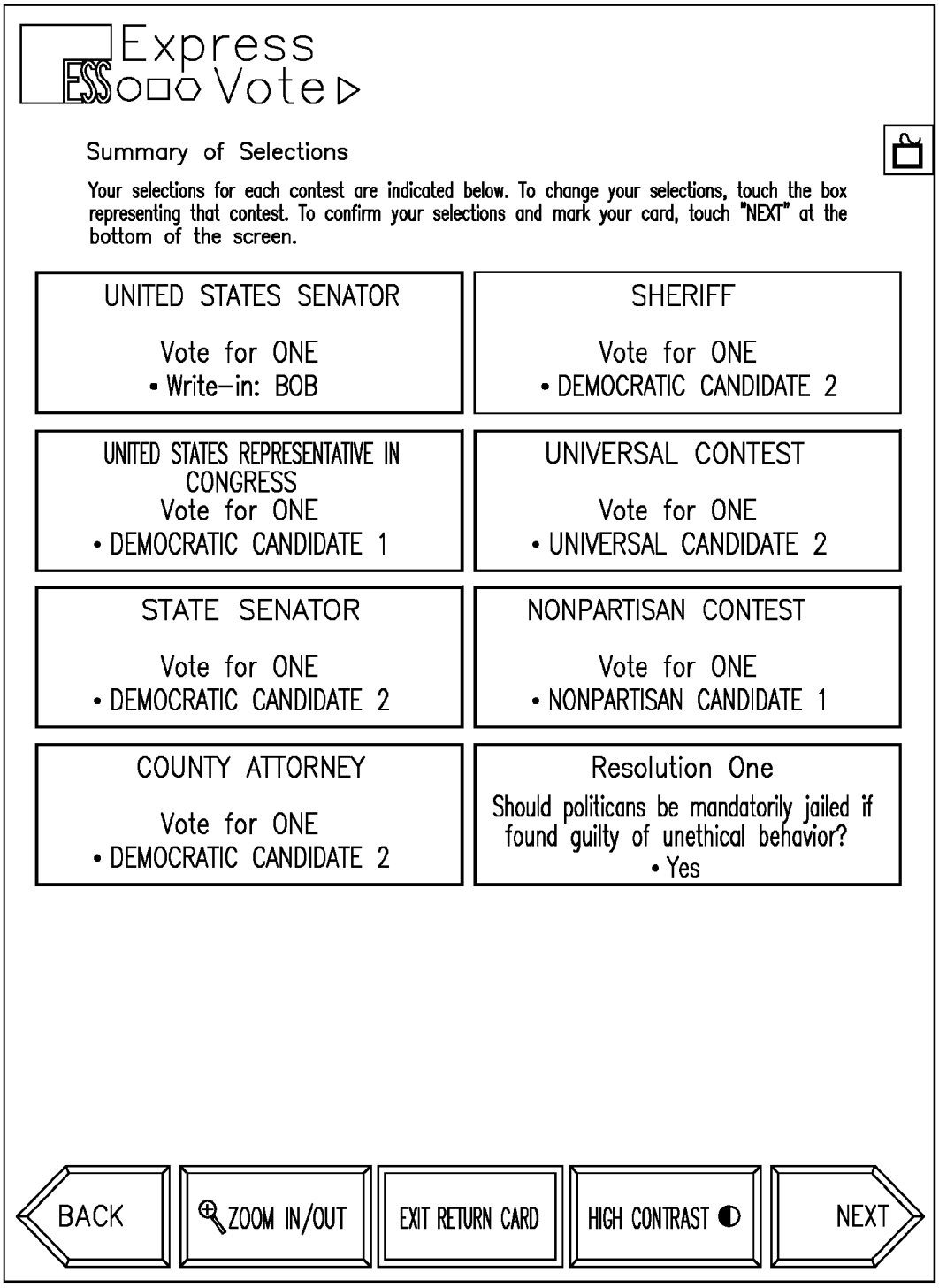

If the voter is satisfied with his/her voting selections, the voter selects the "Mark Card" button on the screen shown in FIG. 15G. After the voter selects this button at step 310 (FIG. 14A), paper path module 46 moves activation card 20 into the position shown in FIG. 9E to prepare it for printing. The paper path module 46 then moves the activation card 20 along the path shown in FIG. 9F past the printer 72 and scanner 74. Printer 72 prints on activation card 20 the master barcode 110, vote selection barcodes 112, and vote selections 114 corresponding to the vote selections made by the voter, as shown in FIG. 6. Scanner 74 produces an image of the activation card 20 and the master barcode 110, vote selection barcodes 112, and vote selections 114 printed thereon. The activation card then moves into the position shown in FIG. 9G. The image of activation card 20 from scanner 74 is sent to the processor of single board computer 118 (FIG. 10A), which decodes the vote selection barcodes 112 to determine the corresponding voting selections. At step 314 (FIG. 14A), the processor of single board computer 118 instructs the display 24 to display the screen shown in FIG. 15H, which shows the voting selections corresponding to the decoded vote selection barcodes 112 printed on activation card 20 so that the voter can confirm that the actual voting selections printed on activation card 20 correspond with his/her voting selections. If one of the voting selections is a write-in candidate, universal voting station 12 displays "Write-in:" and not the actual candidate name entered by the voter for his/her write-in selection because the actual candidate name is not encoded in the vote selection barcode 112. Alternatively, universal voting station 12 uses optical character recognition ("OCR") to determine a write-in vote selection 116 from the image of activation card 20 and displays the actual candidate name entered by the voter for his/her write-in selection. If the selections are not correct, the voter must select the "Exit Return Card" button and request a new activation card 20 from a poll worker. If the voter is satisfied with the selections, he/she selects the "Next" button to confirm that the selections are correct. Thus, in this embodiment, it can be seen that the voter confirms and verifies the accuracy of the voting selections that have been printed on activation card 20 without any reference to the voting selections stored in the memory of universal voting station 12.

Figure 15I:
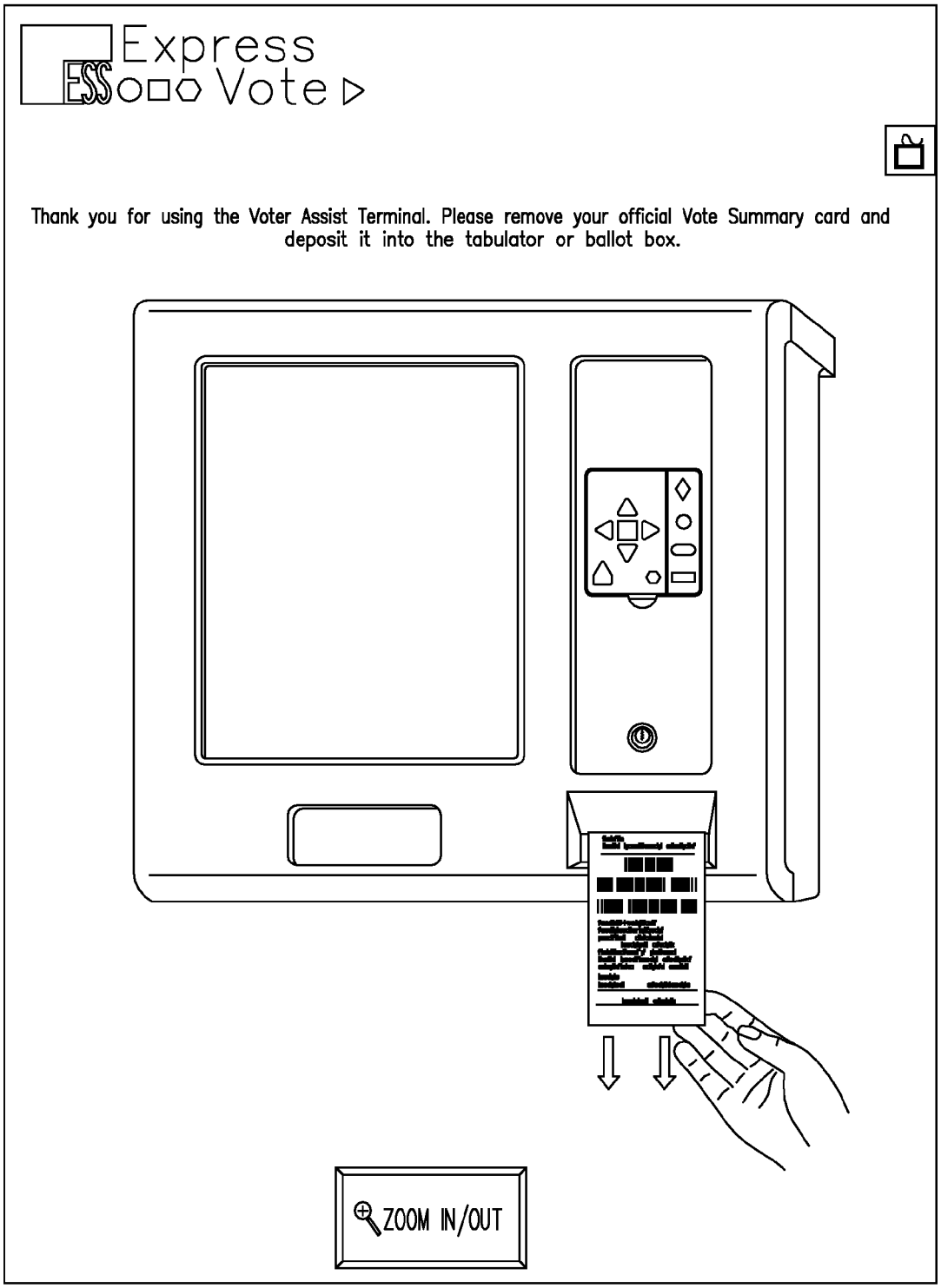

After the voter has confirmed that his/her voting selections printed on activation card 20 are correct, the voting process moves to step 316 (FIG. 14A) at which the display 24 displays two options to the voter for casting his/her votes—a return activation card option and an electronic vote option. The first return activation card option returns the activation card 20 with the voting selections printed thereon to the voter at step 318. If this option is selected, the processor of single board computer 118 instructs the transport mechanism of paper path module 46 to return the activation card 20 to the voter. Display 24 shows the screen shown in FIG. 15I when the voter selects this option. After the activation card 20 is returned to the voter, at step 320, the voter may deposit the activation card 20 into a secure bin for later tabulation by election officials, or insert the activation card 20 into tabulation device 14 for imaging and tabulation in accordance with a process described below.

The voter's second option for casting his/her votes is to select the AutoCAST or electronic vote option at step 322. This option is available only if universal voting station 12 is tethered to a tabulation device 14 such that universal voting station 12 is operable to electronically transmit voting selections and activation card images to the tabulation device 14 for storage and tabulation. If this option is selected, the process moves to step 324, at which the processor of single board computer 118 electronically transmits to tabulation device 14 the voter's voting selections and the scanned image of the activation card 20. The voting selections electronically transmitted from universal voting station 12 to the tabulation device 14 are the voting selections decoded from the scanned image of activation card 20, and not voting selections that are stored in memory of universal voting station 12. The tabulation device 14 receives the voting selections and scanned image of activation card 20, validates the data, converts the data into a cast vote record and digitally signs the data. The tabulation device 14 then instructs the processor of single board computer 118 to instruct the transport mechanism of paper path module 46 to deposit the marked activation card 20 in ballot box 18. The voting selections electronically transmitted by universal voting station 12 to tabulation device 14 are preferably provided in the data format of the vote selection barcodes 112 described above. After the voting selections and image of the activation card 20 are transmitted to tabulation device 14, universal voting station 12 erases the voting selections and image from its memory such that universal voting station 12 does not permanently store, save or record the voter's voting selections or the image of the activation card 20.

If one of the voting selections transmitted from universal voting station 12 to tabulation device 14 is for a write-in candidate, the name of the write-in candidate is not encoded within vote selection barcode 112 as discussed above. In order to determine the name of the write-in candidate, an election official must review the image of activation card 20 sent to tabulation device 14 (or the activation card 20 itself) which includes the name of the write-in candidate in the write-in vote selection 116 (FIG. 6). When tabulation device 14 receives a vote selection barcode 112 that is associated with a write-in voting selection, tabulation device 14 preferably stores the image of the activation card 20 corresponding to the write-in voting selection in a file with a name that starts with "W" so that an election official can easily identify all of the activation cards 20 containing write-in vote selections 116. Alternatively, universal voting station 12 uses optical character recognition ("OCR") to determine a write-in vote selection 116 from the image of activation card 20 and transmits to tabulation device 14 the actual candidate name entered by the voter for his/her write-in selection so that an election official does not need to manually review the image of activation card 20.

As shown in FIGS. 15B-H, at any time throughout the voting process, the voter may select the "Back" button at the bottom of the display 24 to move to the previous screen and revisit a selection made thereon. The "Zoom In/Out" button allows a voter to enlarge the text on display 24. Preferably, when this button is selected, the universal voting station 12 dynamically adjusts the size of the text on display 24 to maximize the size of the text while still displaying all of the text on display 24. The "Exit Return Card" button cancels the voting session, and returns activation card 20 to the voter. The "High Contrast" button adjusts the contrast of display 24.

In accordance with the process shown in FIG. 14B, universal voting station 12 is also capable of receiving an activation card 20 that has already been marked with voting selections, displaying those voting selections to a voter, and allowing the voter to cast his/her voting selections via tabulation device 14 if universal voting station 12 is tethered to tabulation device 14. At step 400, the voter inserts the activation card 20 having voting selections printed thereon into the activation card opening 32 of universal voting station 12. At step 402, scanner 74 images activation card 20 to capture an image of the master barcode 110, vote selection barcodes 112, and vote selections 114. The image from scanner 74 is sent to single board computer 118 (FIG. 10A), which decodes the vote selection barcodes 112 to determine the corresponding voting selections. At step 404, universal voting station 12 displays a screen similar to the screen shown in FIG. 15H, which shows the voting selections corresponding to the decoded vote selection barcodes 112 printed on activation card 20. At step 406, the voter can preferably choose between one of two options for casting his/her votes in the same manner as described above for the process shown in FIG. 14A. The voter can choose to have the activation card 20 returned to him/her at step 408 so that the voter may insert the card 20 into tabulation device 14 for tabulation at step 410. Alternatively, if universal voting station 12 is tethered to tabulation device 14, the voter may choose the AutoCAST option at step 412, which electronically transmits the voting selections and image of the activation card 20 to tabulation device 14 for tabulation and storage at step 414. Universal voting station 12 then deposits the activation card 20 into ballot box 18.

While the operation of voting system 10 in tethered mode has been described above in connection with a voter who makes his/her selections via the touch screen display 24, it should be understood that voters could also make selections by using any other input device, including the arrow buttons 48*a-e* on keypad 28 (FIG. 8) or by using a dual switch access device connected to dual switch access port 68 (FIG. 4) as is known in the art.

Standalone Mode

In an alternative configuration, universal voting station 12 of voting system 10 is operable in a standalone mode, in which case it is not tethered to tabulation device 14. In the standalone mode, universal voting station 12 may be used without cart 16 and simply sit on a table propped up by kickstand 40 as shown in FIGS. 7A-B. When universal voting station 12 is operated in the standalone mode, it operates in a similar manner as described above with respect to the tethered mode (but without the AutoCAST option for casting votes). In the standalone mode, universal voting station 12 receives an activation card 20 from a voter, allows a voter to make his/her voting selections, prints those voting selections on the activation card 20, images the activation card 20, decodes the voting selections on the activation card 20, and displays the decoded voting selections for confirmation by the voter. The operational difference between the two modes is that in the standalone mode, after a voter has confirmed his/her voting selections as printed on activation card 20, the processor of single board computer 118 instructs the transport mechanism of paper path module 46 to automatically return the activation card 20 to the voter instead of allowing the voter to choose between returning the activation card 20 and electronically transmitting the voting selections and image of activation card 20 to tabulation device 14. After the activation card 20 is returned to the voter, it is preferably placed in a tabulation device for tabulation or a secure bin for later scanning and tabulation.

Alternatively, universal voting station 12 may be used with an attached ballot box (not shown) in another embodiment of the standalone mode. In this embodiment, universal voting station 12 operates in a similar manner as described above with respect to the tethered mode with the exception that the AutoCAST option results in the activation card 20 being deposited into the attached ballot box. However, unlike the tethered mode, the voting selections and image of the activation card 20 would not be electronically transmitted to tabulation device 14 for tabulation and storage insofar as the voting station is not tethered to tabulation device 14 in the standalone mode. The operational difference between this embodiment and the other standalone embodiment described above is that this embodiment enables a voter to choose between returning the activation card 20 to the voter (wherein the activation card 20 is preferably placed in a tabulation device for tabulation or a secure bin for later scanning and tabulation) or depositing the activation card 20 into the attached ballot box (wherein the activation card 20 is later collected for scanning and tabulation).

Operation of Tabulation Device

Tabulation device 14 is designed to operate in three different modes: (1) a paper ballot tabulation mode in which it scans and tabulates a conventional full-page paper ballot that has been hand-marked by a voter; (2) an activation card tabulation mode in which it scans and tabulates an activation card 20 that has been ejected from universal voting station 12 and provided to a voter; and (3) an electronic tabulation mode in which it tabulates voting selections that have been electronically transmitted to it by universal voting station 12. Tabulation device 14 is preferably capable of automatically switching between the paper ballot tabulation mode and activation card tabulation mode depending on whether a paper ballot or activation card 20 has been inserted into ballot insertion tray 188 (FIG. 2). Further, tabulation device 14 is preferably capable of multi-tasking so that it can operate in either of the paper ballot or activation card tabulation modes at the same time as the electronic tabulation mode. In each of the three tabulation modes, tabulation device 14 permanently stores the cast vote record for each paper ballot or activation card 20, as well as the image of each paper ballot or activation card 20.

Figure 19A:
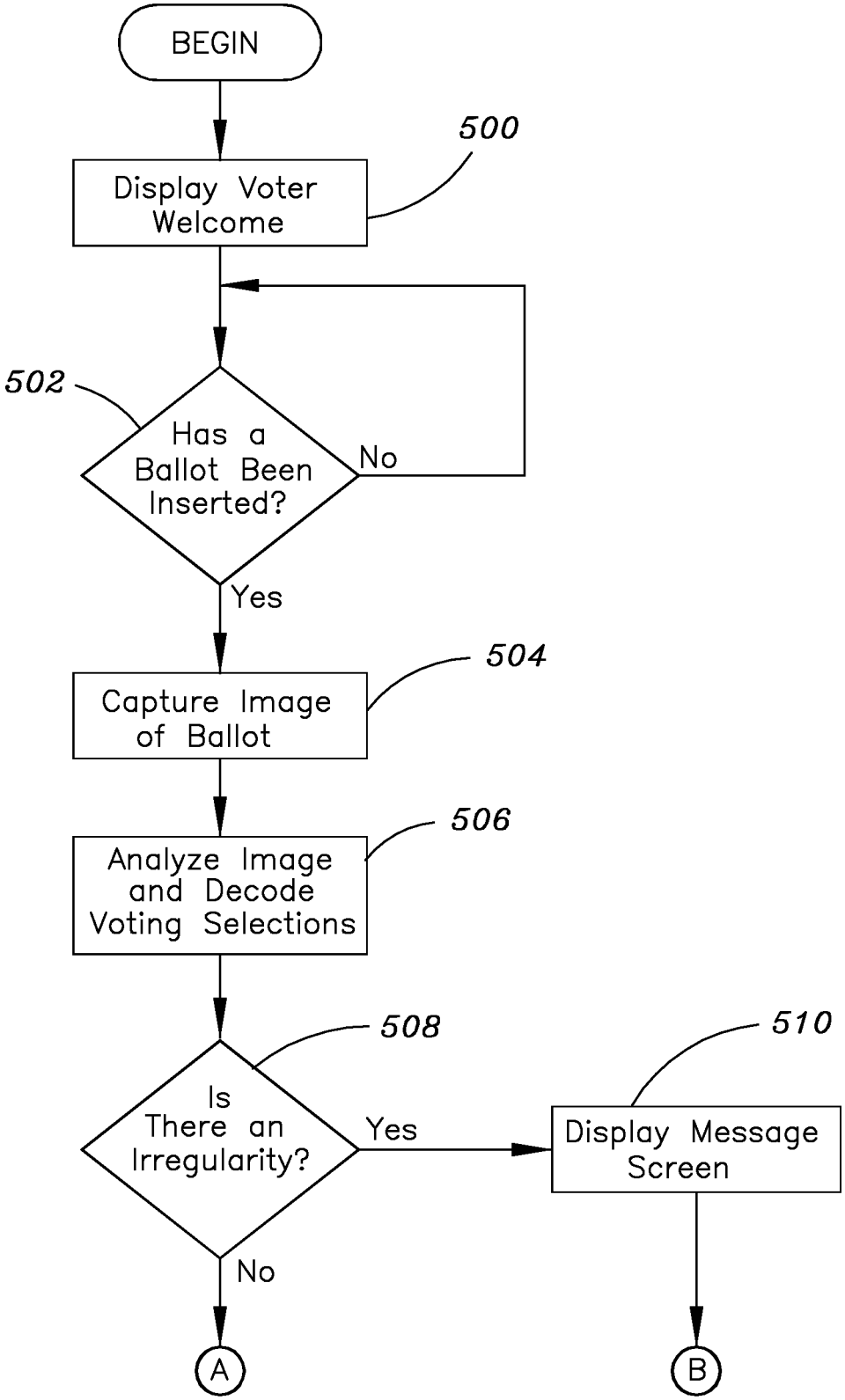
FIGS. 19A-B are a flow chart of a process for tabulating ballots with the tabulation device of FIG. 2.

An exemplary operation of the tabulation device 14 in the paper ballot tabulation mode will now be described with reference to blocks 500 to 522 of the process flow diagram shown in FIGS. 19A and 19B. At block 500, the tabulation device 14 displays a "welcome" screen on display 190 as shown in FIG. 20A. The "welcome" screen displays a message (e.g., "Welcome. Please insert your ballot.") and a graphical depiction of the tabulation device demonstrating the proper insertion of the ballot into the ballot insertion tray 188 (wherein the demonstration may be either static or moving). The "welcome" screen also includes a horizontally scrollable list of available languages at the bottom of the screen. The list of languages can be customized to include the most frequently used languages for a particular precinct location. Furthermore, the "welcome" screen may be set up to offer the most frequently used languages on the display, wherein other languages are available by scrolling through the list using the scroll bar.

Figure 20A:
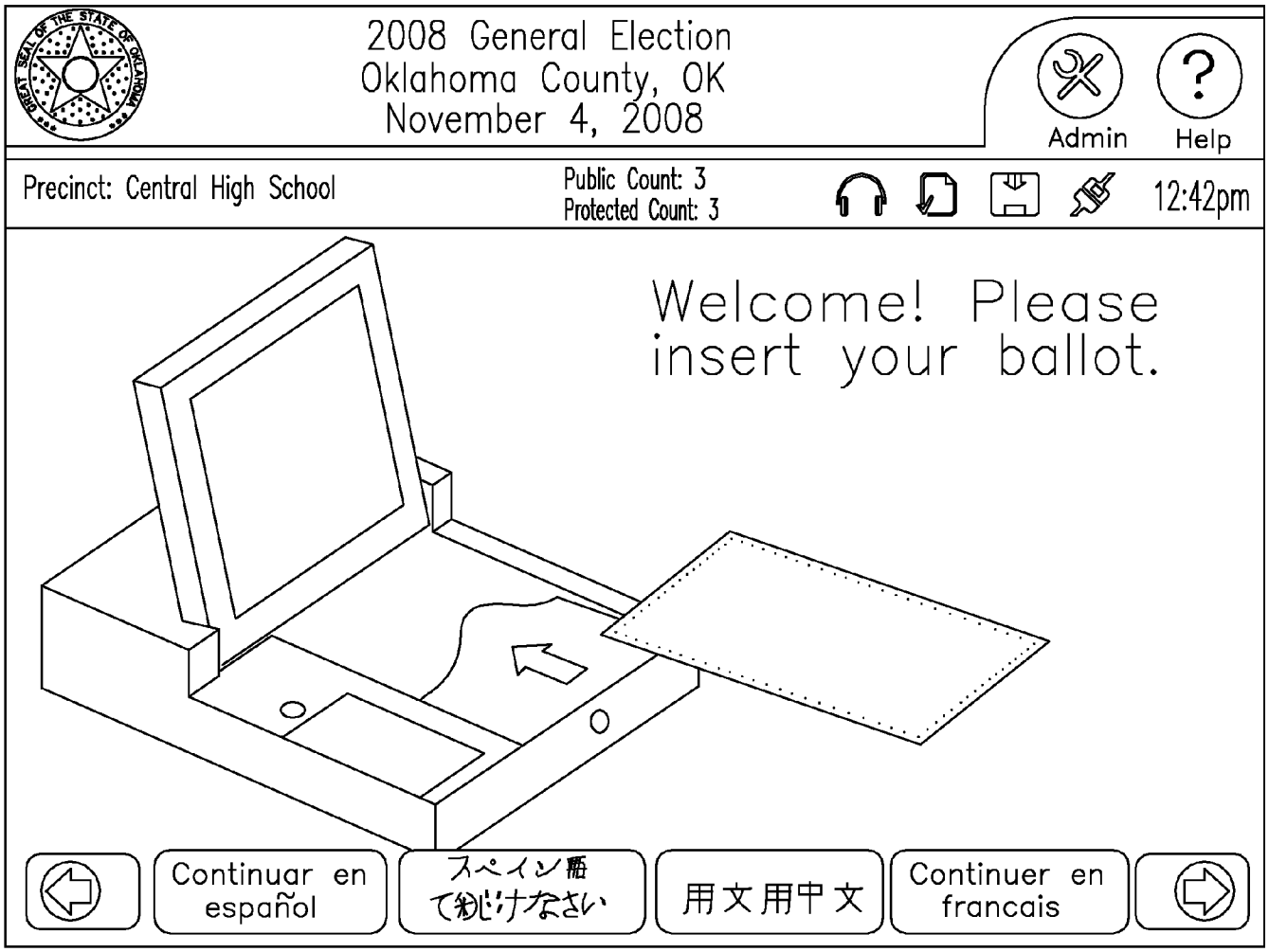
FIGS. 20A-G are screen shots of the display of the tabulation device of FIG. 2 when tabulating a ballot.
Figure 20B:
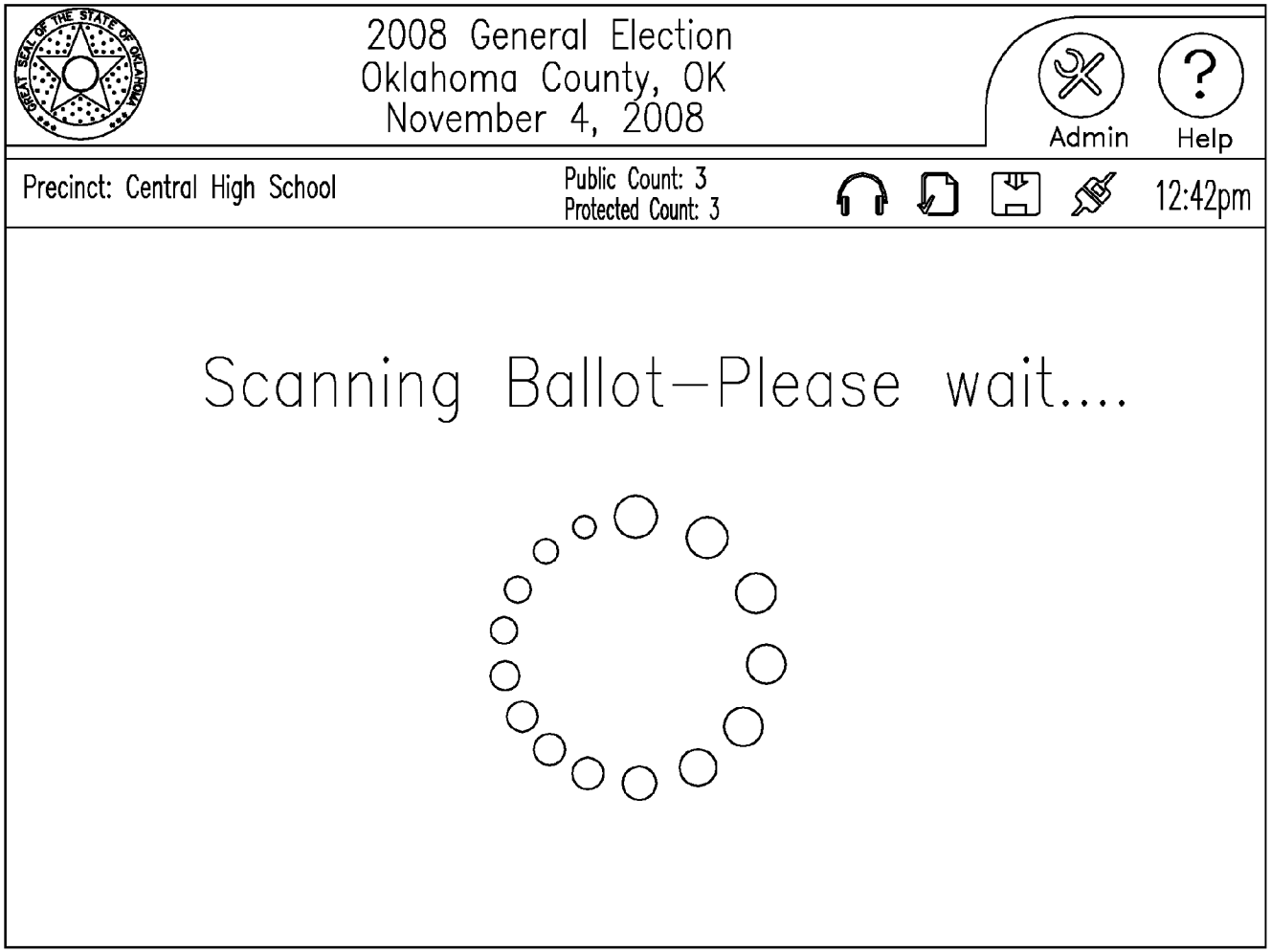

At block 502, the ballot position sensors continuously monitor whether a paper ballot has been inserted into the ballot insertion tray 188 (FIG. 2) and, upon detection of a ballot, the ballot is fed into the ballot scanner assembly 194 (FIG. 12). Upon receiving a paper ballot, the tabulation device 14 displays a "scanning ballot" screen on display 190 as shown in FIG. 20B, prompting the voter to wait until the voting selections marked on the ballot have been processed. Referring back to FIG. 19A, at block 504, the ballot scanner assembly 194 scans the paper ballot so as to capture an image of the ballot. For double-sided ballots, both sides of the paper ballot are preferably scanned simultaneously so as to capture an image of each side of the ballot. As discussed above, the removable USB flash drives of USB board 208 may be used to store the images of the scanned ballots, which may be accessed at a later time for audit purposes.

At block 506, the processor of CPU board 196 analyzes the captured image of the ballot transmitted to it by ballot scanner assembly 194 so as to decode the voting selections marked on the ballot. Preferably, the voting selections are decoded using intelligent mark recognition (IMR) technology as described in U.S. Pat. No. 6,854,644 assigned to the assignee of the present application, which is incorporated herein by reference in its entirety. The paper ballot may contain identification marks that allow the CPU board 196 to verify that the ballot is valid for a specific polling place, and to select the proper ballot style (which is provided as part of the election definition loaded into the tabulation device 14 via the removable USB flash drive at poll opening) for decoding the voting selections marked on the ballot.

Figure 20C:
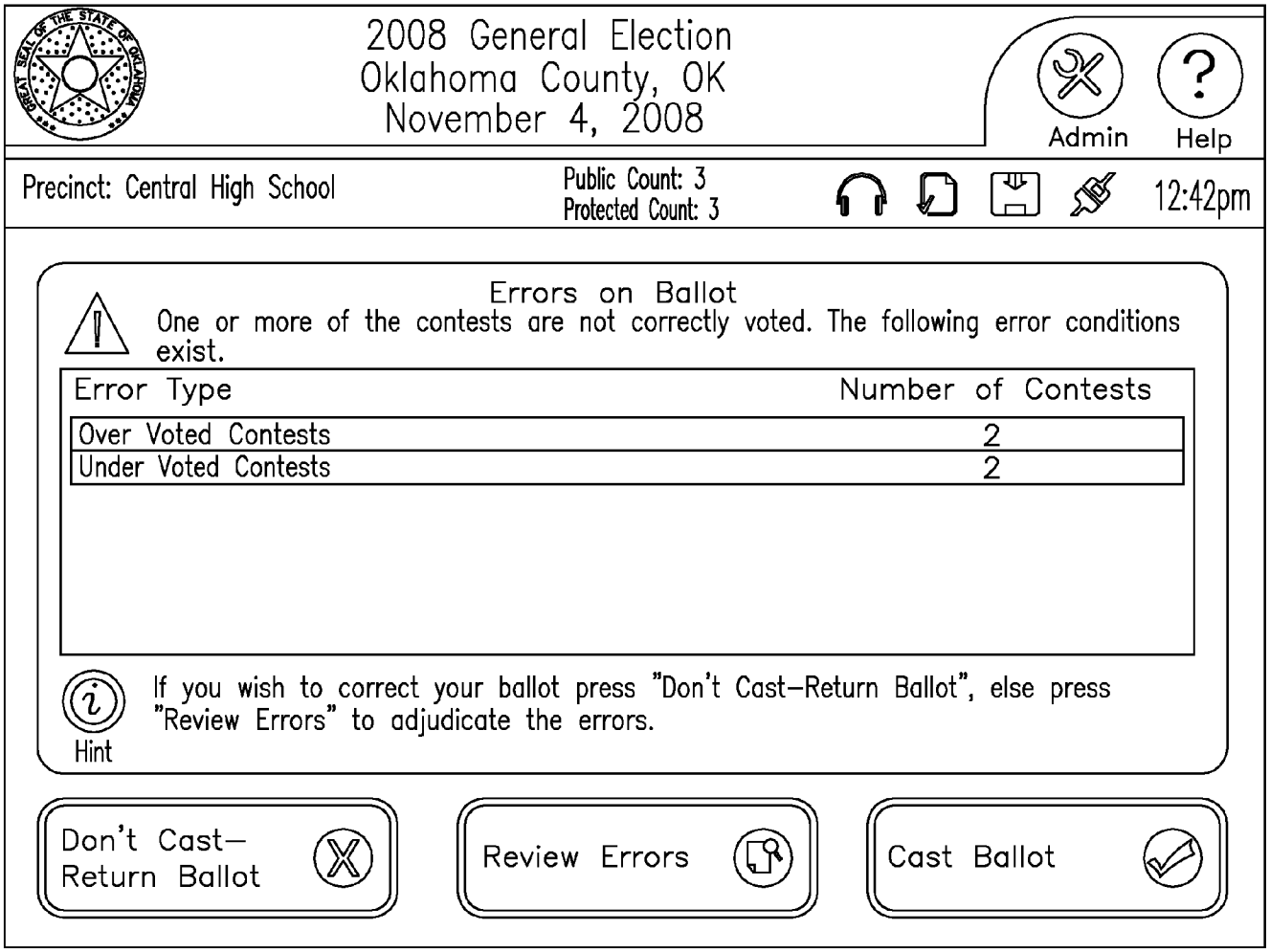

At block 508, the tabulation device 14 identifies any irregularities associated with the paper ballot, including scanning errors (e.g., read errors or unclear marks) and errors relating to the decoding of the voting selections marked on the ballot (e.g., over votes and under votes). At block 510, if one or more irregularities are detected, the tabulation device 14 displays a "ballot errors" screen on display 190 identifying the nature of the identified errors, as shown in FIG. 20C. The "ballot errors" screen provides clear feedback to the voter on the disposition of his/her paper ballot. The "ballot errors" screen displays a notification that one or more contests are not correctly voted (e.g., "One or more of the contests are not correctly voted. The following error conditions exist."), a list of encountered error types (e.g., "Over Voted Contests" and "Under Voted Contests"), and the number of contests affected with each listed error type. It can be seen that the "ballot errors" screen also includes instructions on how to proceed (e.g., "If you wish to correct your ballot press 'Don't Cast—Return Ballot', else press 'Review Errors' to adjudicate the errors."). Finally, it can be seen that the "ballot errors" screen includes three selection buttons—"Don't Cast—Return Ballot" (described below), "Review Errors," and "Cast Ballot" (described below).

Generally, by selecting one of the detected irregularities and then touching the "Review Errors" button, the voter is presented with a new screen listing the affected contests and describing the selected error type. Examples of the types of message screens that may be displayed on the display 190 of tabulation device 14 will now be described with reference to FIGS. 20D to 20F.

Figure 20D:
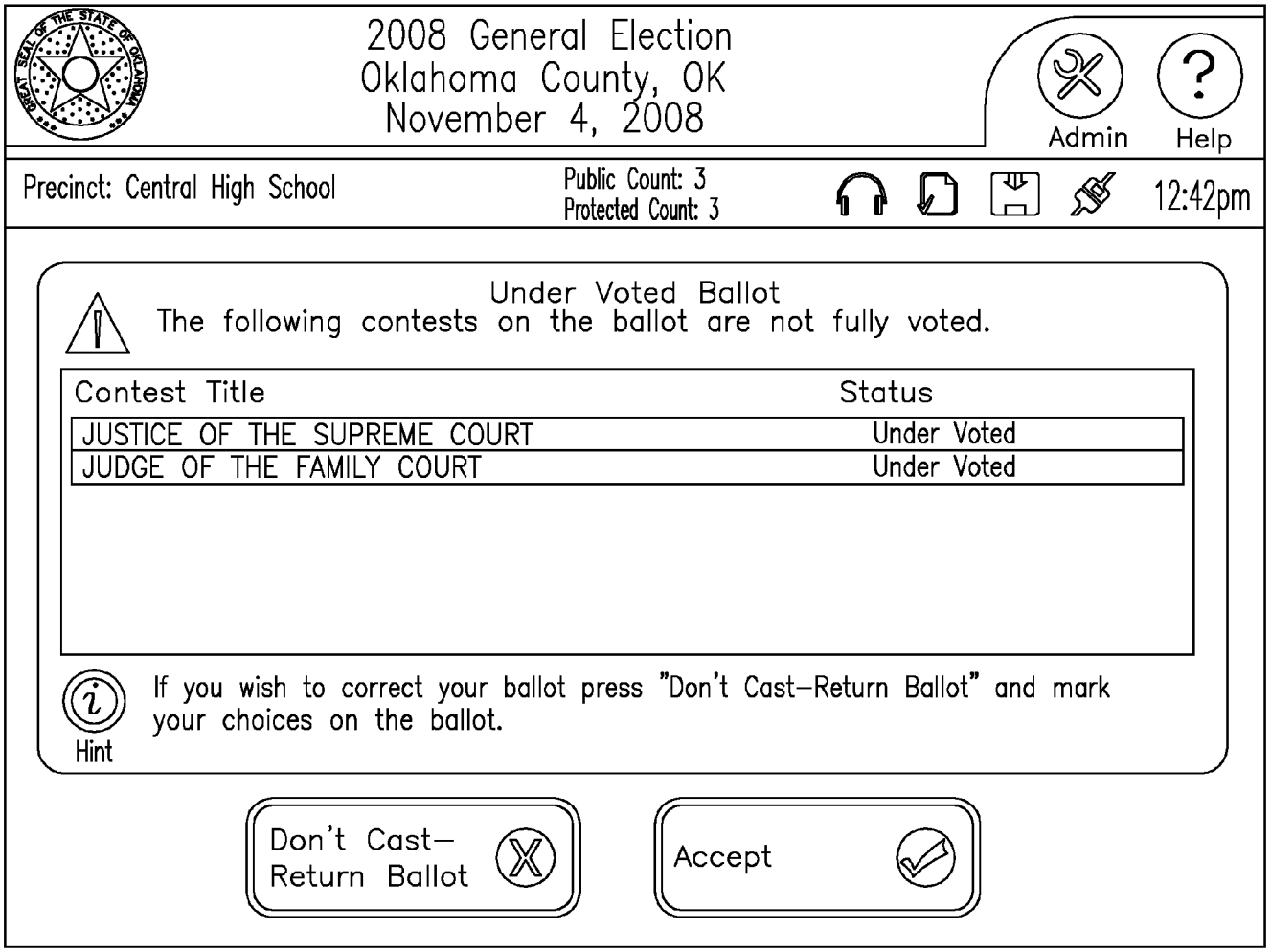

An exemplary "under-vote" screen listing the under voted contests is shown in FIG. 20D. The "under-vote" screen includes identifying information for each of the under-voted contests (e.g., the "Contest Title") and instructions for correcting the under-voted contests on the ballot (e.g., "If you wish to correct your ballot press 'Don't Cast—Return Ballot' and mark your choices on the ballot."). Finally, it can be seen that the "under-vote" screen includes two selection buttons—"Don't Cast—Return Ballot" (described below) and "Accept" (described below).

Figure 20E:
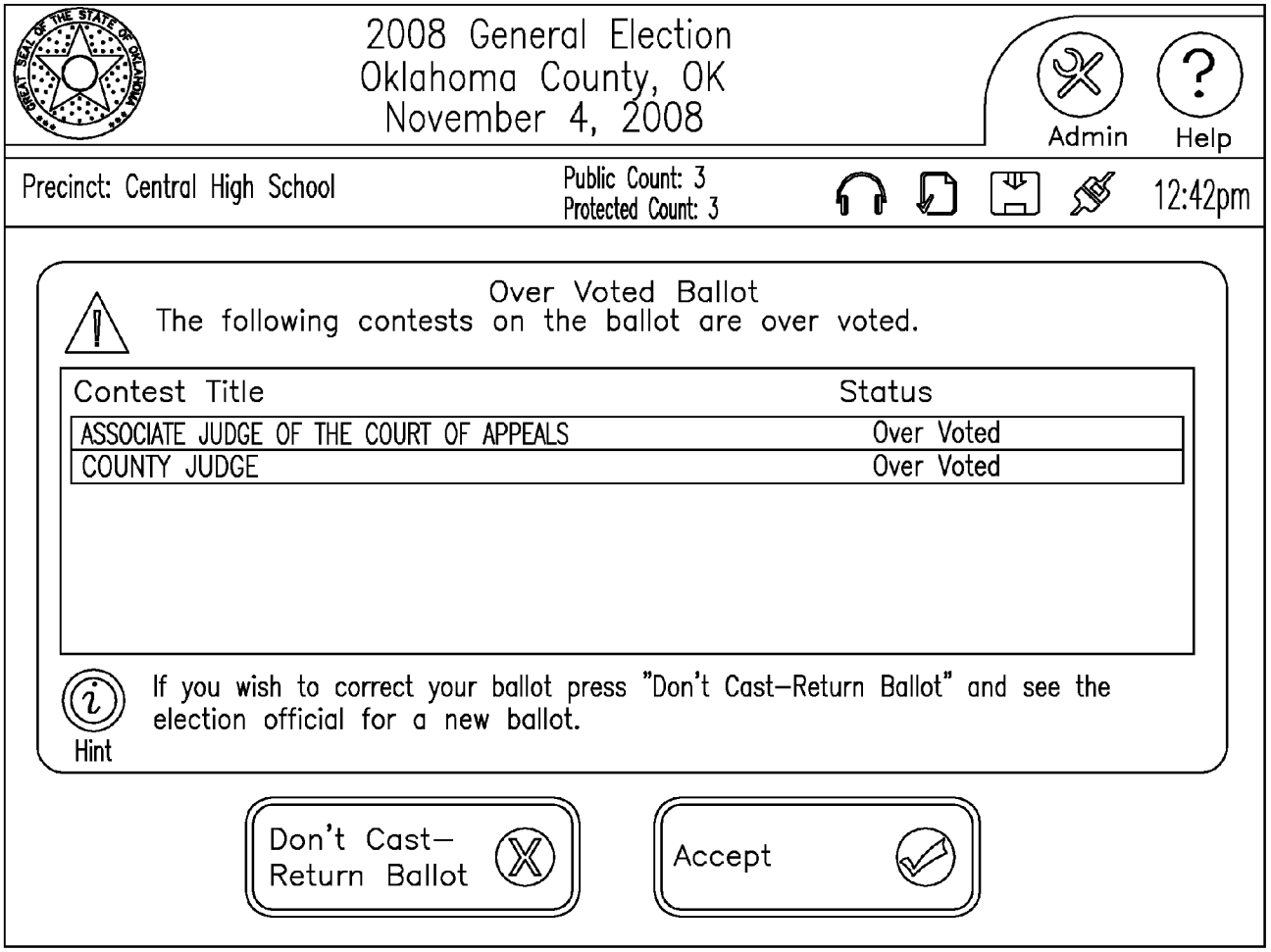

An exemplary "over-vote" screen listing the over-voted contests is depicted in FIG. 20E. The "over-vote" screen includes identifying information for each of the over-voted contests (e.g., "Contest Title") and instructions for correcting the over-voted contests on the ballot (e.g., "If you wish to correct your ballot press 'Don't Cast—Return Ballot' and see the election official for a new ballot."). Finally, it can be seen that the "over-vote" screen includes two selection buttons—"Don't Cast—Return Ballot" (described below) and "Accept" (described below).

Figure 20F:
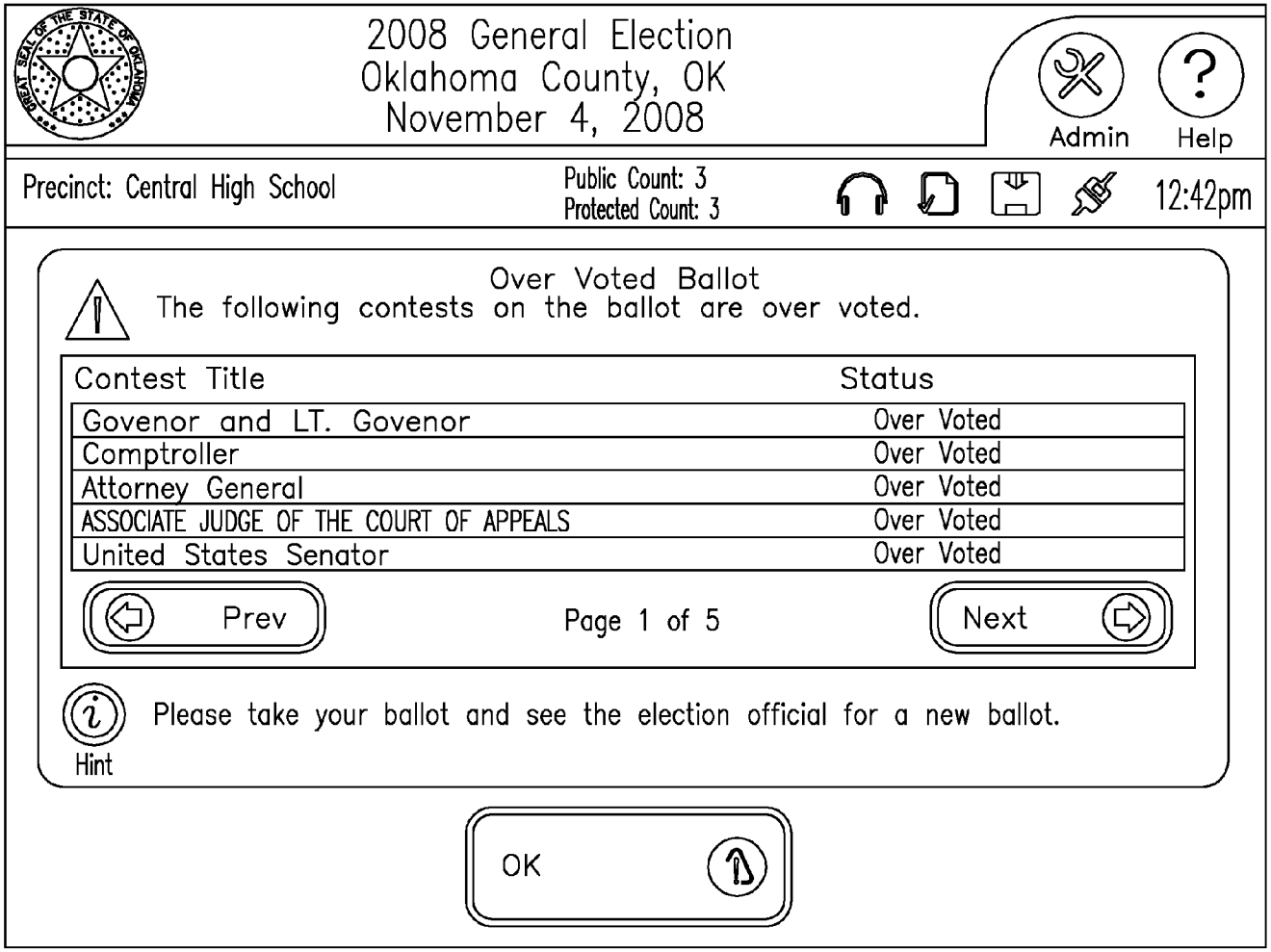

An example of an "over-vote" screen used in jurisdictions that prohibit casting of over-voted ballots is depicted in FIG. 20F. It can be seen that the "over-vote" screen does not allow casting the ballot, providing only one button—"OK"—for returning the ballot to the voter. The screen shown in FIG. 20F also depicts a method for displaying a list of contests where the number of contests with irregularities exceeds the available screen space reserved for the list. The contests are distributed among a number of pages, with left-pointing and right-pointing arrows that allow scrolling through the pages.

Figure 19B:
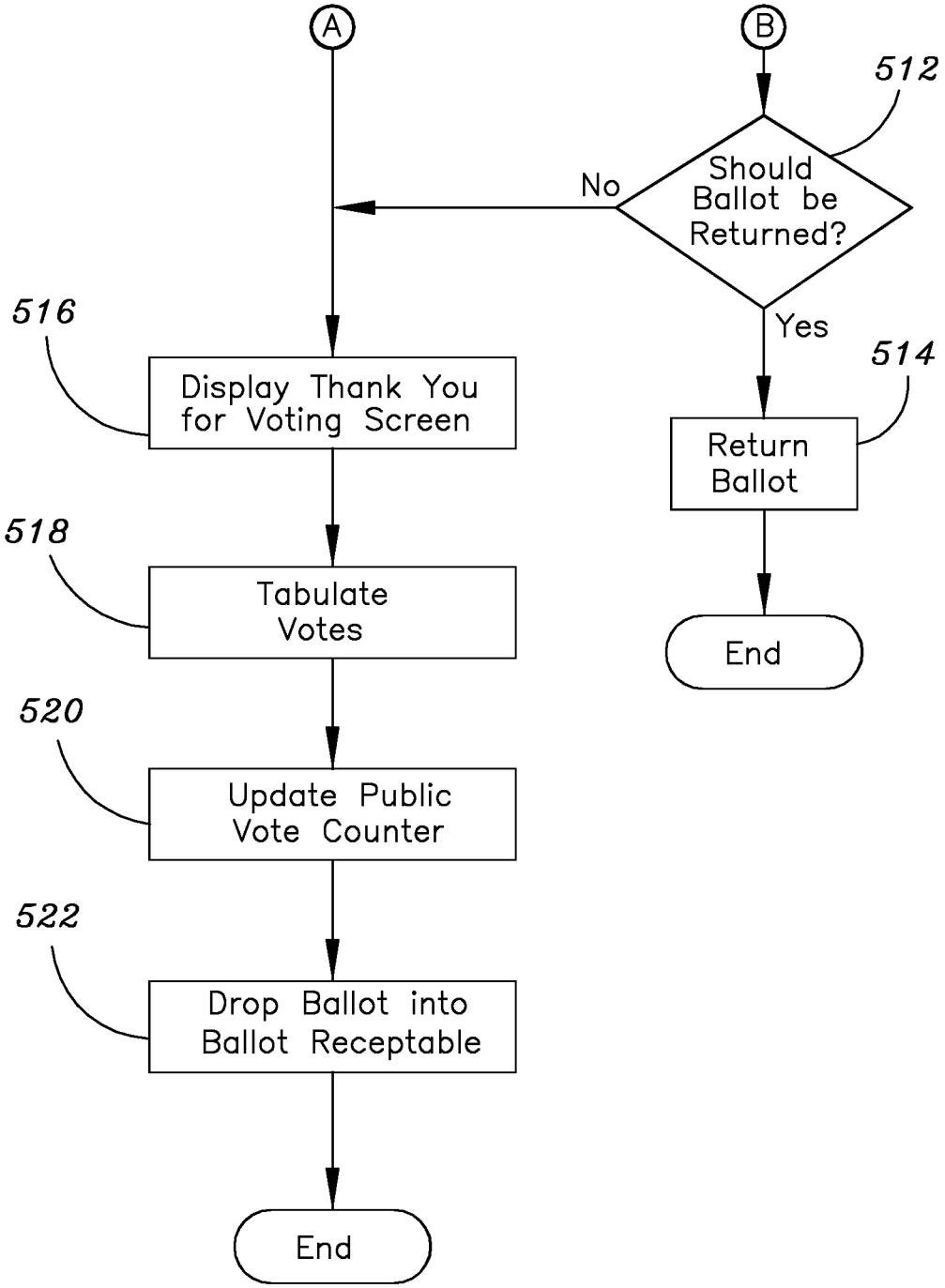

Referring to FIG. 19B, at block 512, a determination is made as to whether the paper ballot should be returned to the voter. It can be appreciated that this determination is made based upon whether the voter selects the "Don't Cast—Return Ballot" button or the "Cast Ballot/Accept" button on the screens depicted in FIGS. 20C to 20E, or, whether the error relates to the scanning of the ballot. If the voter selects the "Don't Cast—Return Ballot" button or if the error relates to the scanning of the ballot, the ballot is returned to the voter at block 514, preferably by feeding the ballot in the opposite direction through the ballot insertion tray 188. At this point, the voter may either correct the error on the same paper ballot or obtain a new ballot from a poll worker. If the voter selects the "Cast Ballot" button, the contests with irregularities (e.g., under-votes and/or over-votes) will not be included in the final tabulation while the remaining contests will be tabulated appropriately. It should be noted that the voting rules in some jurisdictions may prohibit casting ballots containing certain voting irregularities (e.g., over voted ballots). In those jurisdictions, if one or more prohibited irregularities are detected, the "Cast Ballot" button will not be displayed as an option.

Figure 20G:
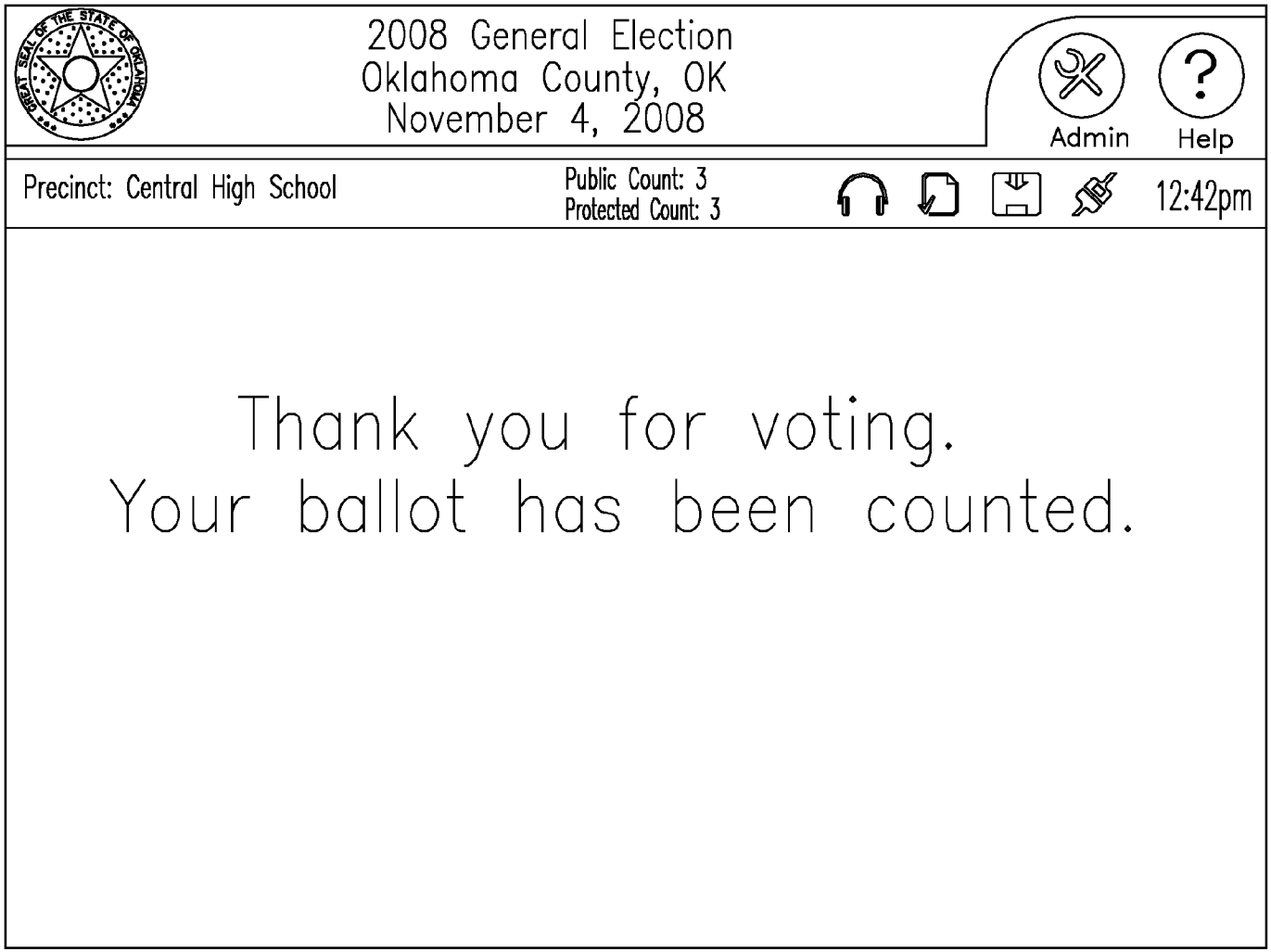

At block 516, upon casting the ballot, the tabulation device 14 displays a "thank you for voting" screen on the display 190 informing the voter that his/her voting selections have been tabulated. An example of such a "thank you for voting" screen is depicted in FIG. 20G. The "thank you for voting" screen displays a short message (e.g., "Thank you for voting. Your ballot has been counted."). Preferably, the message will be displayed for approximately 3 seconds or until the next ballot is inserted into the ballot insertion tray 188.

Next, at block 518 in FIG. 19B, the votes are tabulated by the CPU board 196 and stored in one of the removable USB flash drives of USB board 208 (noting, of course, that any contest with errors, such as under-votes and/or over-votes, are not tabulated). Then, at block 520, the public vote counter is incremented by one to thereby provide confirmation that the ballot has been tabulated. At block 522, the ballot is dropped into the secure ballot box 18 where it is retained for audit purposes, as is known in the art.

If a ballot contains a write-in candidate, CPU board 196 does not determine the actual name of the write-in candidate when it analyzes the captured image of the ballot. In order to determine the name of the write-in candidate, an election official must review an image of the ballot stored by tabulation device 14 (or the paper ballot itself). When tabulation device 14 analyzes a ballot that contains a write-in candidate, tabulation device 14 preferably recognizes that the ballot contains a write-in candidate by detecting a mark in a mark space indicating that the voter is choosing a write-in candidate for a particular contest. Tabulation device 14 then stores the image of the ballot corresponding to the write-in voting selection in a file with a name that starts with "W" so that an election official can easily identify all of the ballots containing write-in vote selections. Alternatively, tabulation device 14 uses optical character recognition ("OCR") to determine the actual candidate name entered by the voter for his/her write-in selection from the image of the ballot so that an election official does not need to manually review the image of the ballot.

In the activation card tabulation mode, tabulation device 14 operates in a similar manner as described above with respect to the paper ballot tabulation mode. In the activation card tabulation mode, tabulation device 14 receives an activation card 20 in ballot insertion tray 188 instead of receiving a paper ballot. Ballot scanner assembly 194 scans activation card 20 to capture its image as it does with a paper ballot, and transmits the captured image to the processor of CPU board 196. Because the voting selections on activation card 20 are encoded in vote selection barcodes 112, the processor of CPU board 196 processes the image of activation card 20 in a different manner than the image of a marked paper ballot. The processor of CPU board 196 processes the image of activation card 20 by decoding the vote selection barcodes 112 to identify the voting selections associated with those barcodes. CPU board 196 also decodes the activation barcode 104 to select the proper ballot style for decoding the vote selection barcodes 112. After the voting selections on activation card 20 are decoded, they are tabulated in the same manner as set forth above with respect to the paper ballot tabulation mode, and the activation card is deposited into ballot box 18. If activation card 20 contains a write-in voting selection, tabulation device 14 preferably stores the image of the activation card 20 corresponding to the write-in voting selection in a file with a name that starts with "W" so that an election official can easily identify all of the activation cards 20 containing write-in vote selections 116. Alternatively, tabulation device 14 uses optical character recognition ("OCR") to determine the actual candidate name entered by the voter for his/her write-in selection from the image of the activation card 20 so that an election official does not need to manually review the image of the activation card 20. If an error is detected on activation card 20, tabulation device 14 may display screens similar to those shown in FIGS. 20C-20F to alert the voter and attempt to remedy the error. Of course, one skilled in the art will understand that the various barcodes printed on activation card 20 could alternatively be scanned by one or more separate barcode readers rather than decoding the barcodes from the image of activation card 20.

In the electronic tabulation mode, tabulation device 14 electronically receives voting selections and the image of the activation card 20 associated with the voting selections from universal voting station 12. The voting selections transmitted to tabulation device 14 are preferably provided in the same data format as vote selection barcodes 112 described above. Universal voting station 12 also preferably transmits to tabulation device 14 the precinct ID and ballot ID contained within the activation barcode 104 of the activation card 20 so that the tabulation device 14 can select the proper ballot style from the election definition for the voting selections. CPU board 196 tabulates the voting selections in the same manner as set forth above with respect to the paper ballot tabulation mode. The cast vote record and image of the activation card 20 are preferably stored by tabulation device 14 on a removable USB flash drive of USB board 208. After the voting selections have been tabulated, universal voting station 12 deposits the activation card 20 into ballot box 18 as described above. If an activation card 20 contains a write-in vote selection 116, tabulation device 14 preferably processes the voting selections and image of the activation card 20 as set forth above with respect to operation of universal voting station 12 when the AutoCAST option is selected at step 322 (FIG. 14A).

Finally, at poll closing, the accumulated vote totals for tabulation device 14 are transmitted to a central site via a landline or wireless modem, such as the modem of main access board 210. Alternatively, the accumulated vote totals for tabulation device 14 may be transported to the central site via a removable USB flash drive inserted into one of the USB ports of USB board 208. The cast vote records and images of the paper ballots and activation cards, as described above, may also be provided to the central site in the same manner In an alternative embodiment, universal voting station 12 may be operable as a standalone direct-recording electronic ("DRE") voting station with a voter verifiable paper audit trail ("VVPAT"). When used in this manner, universal voting station 12 is preferably not tethered to tabulation device 14, but it preferably includes a ballot box positioned to receive printed activation cards 20. When universal voting station 12 operates as a DRE voting station with VVPAT, universal voting station 12 operates in accordance with the description of the standalone mode described above with the following differences. After universal voting station 12 scans and displays the marked voting selections on activation card 20 and the voter confirms that those voting selections are accurate, universal voting station 12 allows the voter to choose between casting his/her votes without reviewing the activation card 20 or ejecting the activation card 20 for review (in which case the activation card 20 serves as a VVPAT). If the voter chooses to cast his/her votes without reviewing the activation card 20, universal voting station 12 electronically stores the voter's voting selections and an image of the activation card 20 with the voting selections printed thereon in memory of universal voting station 12 or memory inserted into universal voting station 12. Universal voting station 12 then deposits the activation card 20 into the ballot box to serve as an auditable record of the voter's voting selections. If the voter instead chooses to eject and review the activation card 20, then universal voting station 12 ejects the activation card 20 and clears from its memory the voting selections on the activation card 20 and image of the activation card 20. The voter may review the ejected activation card 20 to ensure that it accurately reflects his/her voting selections. The voter may then reinsert the activation card 20 into universal voting station 12 or another voting station, which will read the vote selection barcodes 112 on the activation card 20, and display a summary of the voting selections on the activation card 20 for the voter's review. The voter may then choose to cast his/her votes, which prompts universal voting station 12 to store the voting selections and image of the activation card 20 in memory and deposit the activation card 20 into the ballot box. In both cases, the electronically stored voting selections are tabulated by universal voting station 12, and the cast vote records are transferred to a central site in any suitable manner known in the art. Universal voting station 12 may also include a transparent window that allows the voter to view the activation card 20 and the voter's voting selections printed thereon without ejecting the activation card 20. If the voter is satisfied that the activation card 20 accurately reflects his/her voting selections, the voter may instruct universal voting station 12 to cast his/her voting selections and deposit the activation card into the ballot box.

In each of the embodiments described above, universal voting station 12 and/or tabulation device 14 may use optical character recognition (OCR) to decode the vote selections 114 on the printed activation cards 20 as an alternative to decoding the vote selection barcodes 112 to determine the corresponding voting selections. If universal voting station 12 and tabulation device 14 are programmed to decode the vote selections 114 with OCR, universal voting station 12 may be programmed so that it does not print vote selection barcodes 112 on activation card 20.

While the present invention has been described and illustrated hereinabove with reference to an exemplary embodiment, it should be understood that various modifications could be made to this embodiment without departing from the scope of the invention. Therefore, the present invention is not to be limited to the specific configuration or methodology of the exemplary embodiment, except insofar as such limitations are included in the following claims.

What is claimed and desired to be secured by Letters Patent is as follows:

1. A voting station configured to operate in a tethered mode in which the voting station is connected to a tabulation device and a standalone mode in which the voting station operates as a standalone unit, comprising:

a transport mechanism that receives an activation card;

a display that displays to a voter at least one election contest, wherein the display also displays to the voter an electronic vote option and a return activation card option when the voting station operates in the tethered mode;

an input device that receives from the voter at least one voting selection corresponding to the election contest, wherein the input device also receives from the voter an instruction corresponding to a choice between the electronic vote option and the return activation card option when the voting station operates in the tethered mode;

a printer that prints the voting selection on the activation card; and a processor that (1) electronically transmits the voting selection to the tabulation device when the voting station operates in the tethered mode and the input device receives an instruction corresponding to the electronic vote option, (2) instructs the transport mechanism to return the activation card with the voting selection printed thereon to the voter when the voting station operates in the tethered mode and the input device receives an instruction corresponding to the return activation card option, and (3) instructs the transport mechanism to return the activation card with the voting selection printed thereon to the voter when the voting station operates in the standalone mode.

2. The voting station of claim 1, further comprising a housing within which the transport mechanism, the display, the input device, the printer and the processor are mounted.

3. The voting station of claim 2, further comprising a cart to which the housing and the tabulation device are mounted when the voting station operates in the tethered mode.

4. The voting station of claim 3, further comprising a ballot box positioned within the cart underneath the housing and the tabulation device, and wherein the processor instructs the transport mechanism to deposit the activation card with the voting selection printed thereon into the ballot box when the voting station operates in the tethered mode and the input device receives an instruction corresponding to the electronic vote option.

5. The voting station of claim 1, further comprising an imaging device that produces an image of the activation card.

6. The voting station of claim 5, wherein the activation card includes an identification code printed thereon, wherein the imaging device produces an image of the activation card with the identification code printed thereon, and wherein the processor decodes the identification code from the image of the activation card to identify a ballot style that determines the election contest displayed to the voter.

7. The voting station of claim 5, wherein the imaging device produces an image of the activation card with the voting selection printed thereon, and wherein the processor determines the voting selection from the image of the activation card and instructs the display to display the voting selection determined from the image of the activation card for voter confirmation.

8. The voting station of claim 7, wherein the printer prints the voting selection on the activation card as one of the following: machine readable code and human readable text; text that is both human readable and machine readable; and machine readable code that is not human readable.

9. The voting station of claim 7, wherein the processor transmits to the tabulation device the image of the activation card with the voting selection printed thereon when the voting station operates in the tethered mode and the input device receives an instruction corresponding to the electronic vote option.

10. The voting station of claim 7, wherein the processor transmits to the tabulation device the voting selection determined from the image of the activation card with the voting selection printed thereon when the voting station operates in the tethered mode and the input device receives an instruction corresponding to the electronic vote option.

11. The voting station of claim 5, wherein the transport mechanism, the printer and the imaging device are integrated in a single module.

12. A voting system, comprising:

a tabulation device that receives a paper ballot with at least one voting selection marked thereon, scans the paper ballot to create an image of the paper ballot, decodes the voting selection from the image of the paper ballot, and tabulates the voting selection;

a voting station connected to the tabulation device, wherein the voting station receives an activation card, displays at least one election contest to a voter, receives at least one voting selection corresponding to the election contest from the voter, prints the voting selection on the activation card, and transmits the voting selection to the tabulation device for tabulation; and a common ballot box positioned to receive the paper ballot from the tabulation device and the printed activation card from the voting station.

13. The voting system of claim 12, further comprising a cart to which the tabulation device and the voting station are mounted, wherein the common ballot box is positioned within the cart underneath the tabulation device and the voting station.

14. The voting system of claim 12, wherein the activation card includes an identification code printed thereon, wherein the voting station produces an image of the activation card with the identification code printed thereon, and wherein the voting station decodes the identification code from the image of the activation card to identify a ballot style that determines the election contest displayed to the voter.

15. The voting system of claim 12, wherein the voting station produces an image of the activation card with the voting selection printed thereon, and wherein the voting station determines the voting selection from the image of the activation card and instructs the display to display the voting selection determined from the image of the activation card for voter confirmation.

16. The voting system of claim 15, wherein the voting station prints the voting selection on the activation card as one of the following: machine readable code and human readable text; text that is both human readable and machine readable; and machine readable code that is not human readable.

17. The voting system of claim 15, wherein the voting station transmits to the tabulation device the image of the activation card with the voting selection printed thereon.

18. The voting system of claim 15, wherein the voting station transmits to the tabulation device the voting selection determined from the image of the activation card with the voting selection printed thereon.

19. The voting system of claim 12, wherein the tabulation device and the voting station are connected with an Ethernet cable.

20. The voting system of claim 12, wherein the voting station receives a second activation card, displays at least one election contest to a second voter, receives at least one voting selection corresponding to the election contest from the second voter, prints the voting selection on the second activation card, and returns the second activation card to the second voter.

21. The voting system of claim 20, wherein the tabulation device receives the second activation card with the voting selection printed thereon, scans the second activation card to create an image of the activation card, decodes the voting selection from the image of the activation card, tabulates the voting selection, and deposits the second activation card in the common ballot box.

22. The voting system of claim 21, wherein the tabulation device comprises an insertion tray that receives the paper ballot and the second activation card.

* * * * *